US010905239B2

(12) United States Patent
Newman

(10) Patent No.: US 10,905,239 B2
(45) Date of Patent: Feb. 2, 2021

(54) WALL HANGING GARAGE SHELF AND RACK STORAGE SYSTEM

(71) Applicant: GG Acquisition Company, LLC, Holland, MI (US)

(72) Inventor: Jared J. Newman, Pocatello, ID (US)

(73) Assignee: GG Acquisition Company, LLC, Holland, MI (US)

( * ) Notice: Subject to any disclaimer, the term of this patent is extended or adjusted under 35 U.S.C. 154(b) by 0 days.

(21) Appl. No.: 16/200,271

(22) Filed: Nov. 26, 2018

(65) Prior Publication Data

US 2019/0239646 A1 Aug. 8, 2019

Related U.S. Application Data

(63) Continuation-in-part of application No. 15/889,036, filed on Feb. 5, 2018, now Pat. No. 10,750,867.

(51) Int. Cl.
*A47B 96/02* (2006.01)
*A47B 96/06* (2006.01)
(Continued)

(52) U.S. Cl.
CPC ..... *A47B 96/028* (2013.01); *A47B 96/061* (2013.01); *A47B 96/067* (2013.01); *A47B 43/00* (2013.01); *A47B 57/42* (2013.01); *A47B 57/46* (2013.01); *A47B 57/52* (2013.01); *A47B 81/005* (2013.01); *A47B 96/021* (2013.01); *A47B 96/1441* (2013.01); *A47B 2220/0041* (2013.01)

(58) Field of Classification Search
CPC ..... A47B 96/02; A47B 96/06; A47B 96/07; A47B 96/021; A47B 96/028; A47B 96/061; A47B 96/063; A47B 96/067; A47B 96/1441; A47B 43/00; A47B 57/42; A47B 57/46; A47B 57/52; A47B 2220/0041
USPC ..... 211/90.01
See application file for complete search history.

(56) References Cited

U.S. PATENT DOCUMENTS 170,115 A 11/1875 Roberts
306,335 A 10/1884 Highley
(Continued)

FOREIGN PATENT DOCUMENTS

EP 3556261 A1 * 10/2019 ..... A47F 5/13
WO WO-9529613 A1 * 11/1995 ..... A47B 57/42

OTHER PUBLICATIONS

Non-Final Office Action, dated Aug. 21, 2019, received in U.S. Appl. No. 15/889,036.

*Primary Examiner* — Patrick D Hawn
(74) *Attorney, Agent, or Firm* — Varnum LLP

(57) ABSTRACT

A kit that includes rod supports, three shelf bases, and first and second shelf supports. The first and second shelf supports are each separate from the three shelf bases. Each of the three shelf bases has first and second legs. The first leg is directly positionable against a wall and couplable thereto. The second leg supports at least a portion of the rod supports. The first shelf support is couplable to the second leg of the first shelf base to form a first brace. The first shelf support includes a first wall mount bracket that is directly positionable against the wall and is couplable thereto. The second shelf support is couplable to the second leg of the third shelf base to form a second brace. The second shelf support includes a second wall mount bracket that is directly positionable against the wall and is couplable thereto.

19 Claims, 34 Drawing Sheets

(51) Int. Cl.

| | |
|---|---|
| *A47B 57/46* | (2006.01) |
| *A47B 57/42* | (2006.01) |
| *A47B 43/00* | (2006.01) |
| *A47B 57/52* | (2006.01) |
| *A47B 81/00* | (2006.01) |
| *A47B 96/14* | (2006.01) |

(56) References Cited

U.S. PATENT DOCUMENTS

| | | | | | |
|---|---|---|---|---|---|
| 913,228 | A | | 2/1909 | McCarthy | |
| 1,809,216 | A | | 10/1927 | Quandt | |
| 2,633,998 | A | | 4/1950 | Henrietta | |
| 2,659,879 | A | | 10/1955 | Rogers | |
| 2,908,471 | A | | 12/1956 | McFerrell | |
| 2,959,297 | A | | 9/1958 | Larson | |
| 2,954,125 | A | | 12/1958 | Husted | |
| 3,113,678 | A | | 12/1962 | Dickinson | |
| 3,184,068 | A | | 5/1965 | Wende | |
| 3,220,363 | A | * | 11/1965 | Gingher | A47B 96/027 108/147.17 |
| 3,233,852 | A | * | 2/1966 | Azar | A47B 96/027 248/68.1 |
| 3,563,182 | A | | 2/1971 | MacFarlane | |
| 3,669,395 | A | | 6/1972 | Gehrke | |
| 3,702,591 | A | | 11/1972 | Banse | |
| 4,185,566 | A | | 1/1980 | Adams | |
| 4,603,781 | A | | 8/1986 | Ryan, Jr. | |
| 4,624,376 | A | * | 11/1986 | Bertram | A47B 96/028 108/152 |
| 4,809,941 | A | | 3/1989 | Sheridan | |
| 5,253,837 | A | * | 10/1993 | Loux | A47B 96/00 108/152 |
| 5,351,842 | A | | 10/1994 | Remmers | |
| 5,580,018 | A | | 12/1996 | Remmers | |
| 5,647,490 | A | | 7/1997 | Hull | |
| 5,921,412 | A | * | 7/1999 | Merl | A47B 96/028 211/181.1 |
| 6,082,560 | A | | 7/2000 | Timm | |
| 6,098,566 | A | | 8/2000 | Metcalf | |
| 6,257,425 | B1 | | 7/2001 | Liu | |
| 6,796,445 | B2 | | 9/2004 | Cyrluk | |
| 6,969,036 | B2 | * | 11/2005 | Magnusson | A47B 96/02 248/339 |
| 6,978,975 | B1 | * | 12/2005 | Magnusson | A47B 96/028 248/249 |
| 7,004,335 | B2 | * | 2/2006 | Remmers | A47B 96/021 211/105.1 |
| 7,086,544 | B1 | * | 8/2006 | Doench | A47B 61/003 211/105.1 |
| 7,249,685 | B2 | | 7/2007 | Newman | |
| 7,497,343 | B2 | | 3/2009 | Newman | |
| 7,866,491 | B2 | | 1/2011 | Newman | |
| 8,408,404 | B2 | | 4/2013 | Miller | |
| 8,646,624 | B2 | | 2/2014 | Fernandez | |
| 9,289,065 | B1 | * | 3/2016 | Lambertson | A47B 96/027 |
| 9,433,114 | B2 | | 8/2016 | Hilburn | |
| 10,426,263 | B1 | * | 10/2019 | Whaley | A47B 77/08 |
| 2002/0170870 | A1 | | 11/2002 | Callis | |
| 2003/0051643 | A1 | | 3/2003 | Remmers | |
| 2004/0020885 | A1 | | 2/2004 | Newman | |
| 2005/0279723 | A1 | | 12/2005 | Newman | |
| 2006/0037923 | A1 | | 2/2006 | Newman | |
| 2006/0175495 | A1 | * | 8/2006 | Gregory | A47B 96/028 248/250 |
| 2007/0108148 | A1 | * | 5/2007 | Stitchick | A47B 96/06 211/187 |
| 2007/0241072 | A1 | * | 10/2007 | Bryant | A47B 96/061 211/90.02 |
| 2009/0008348 | A1 | | 1/2009 | Newman | |
| 2014/0265772 | A1 | | 9/2014 | Newman | |

* cited by examiner

WALL HANGING GARAGE SHELF AND RACK STORAGE SYSTEM

CROSS REFERENCE TO RELATED APPLICATION

This application is a continuation-in-part of U.S. patent application Ser. No. 15/889,036, filed on Feb. 5, 2018, and titled "Wall Hanging Garage Shelf and Rack Storage System," which is incorporated herein by reference in its entirety.

BACKGROUND OF THE INVENTION

Field of the Invention

The present invention is directed generally to shelving and more particularly to modular systems used to construct shelves.

Description of the Related Art

Shelves may be constructed using conventional single piece L-shaped or triangularly shaped braces. Unfortunately, such shelves have a shelf depth fixed by the size of the braces. For example, conventional single piece triangularly shaped braces are typically made in two sizes: small and large. The small sized braces may be used to construct a shallow or small shelf and the large sized braces may be used to construct a deep or large shelf. Unfortunately, such small and large shelfs are often not well suited for a user's particular storage needs.

For example, while the small shelf might work well in a smaller garage, the small shelf has limited storage space. On the other hand, the large shelf typically does not work well in a small garage because the large sized braces extend into walkways (e.g., between the wall and a vehicle). Additionally, items hanging from the large shelf may intrude into the walkways.

Additionally, different garages may have different garage widths, ceiling heights, and garage depths as well as different wall configurations. Many garages also contain physical obstacles (such as windows, doors, vacuums, water heaters, garage door rails, cabinets, etc.) that may prevent conventional single piece triangularly shaped braces from being attached to the wall in some locations. This can create problems in garages where storage space is limited because the small and large sized braces simply do not offer the flexibility necessary to utilize such diverse spaces effectively.

For example, many garages do not have enough room for the large shelf to be positioned in between a horizontal garage door rail and the wall. While the small shelf may be positionable between the horizontal garage door rail and the wall, the small shelf cannot be positioned right next to a large shelf because these shelfs have separate braces that need to be anchored on separate studs. Thus, the large sized brace at the end of the large shelf cannot be anchored to the same wall stud as the small sized brace at the end of the small shelf. This leaves an unusable gap (e.g., about 16 inches or about 24 inches) between the ends of the small and large shelves.

Conventional single piece triangularly shaped braces also require significant amounts of packaging for shipping. This packaging can be bulky and require a large storage space. Thus, such braces have a number of shortcomings.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
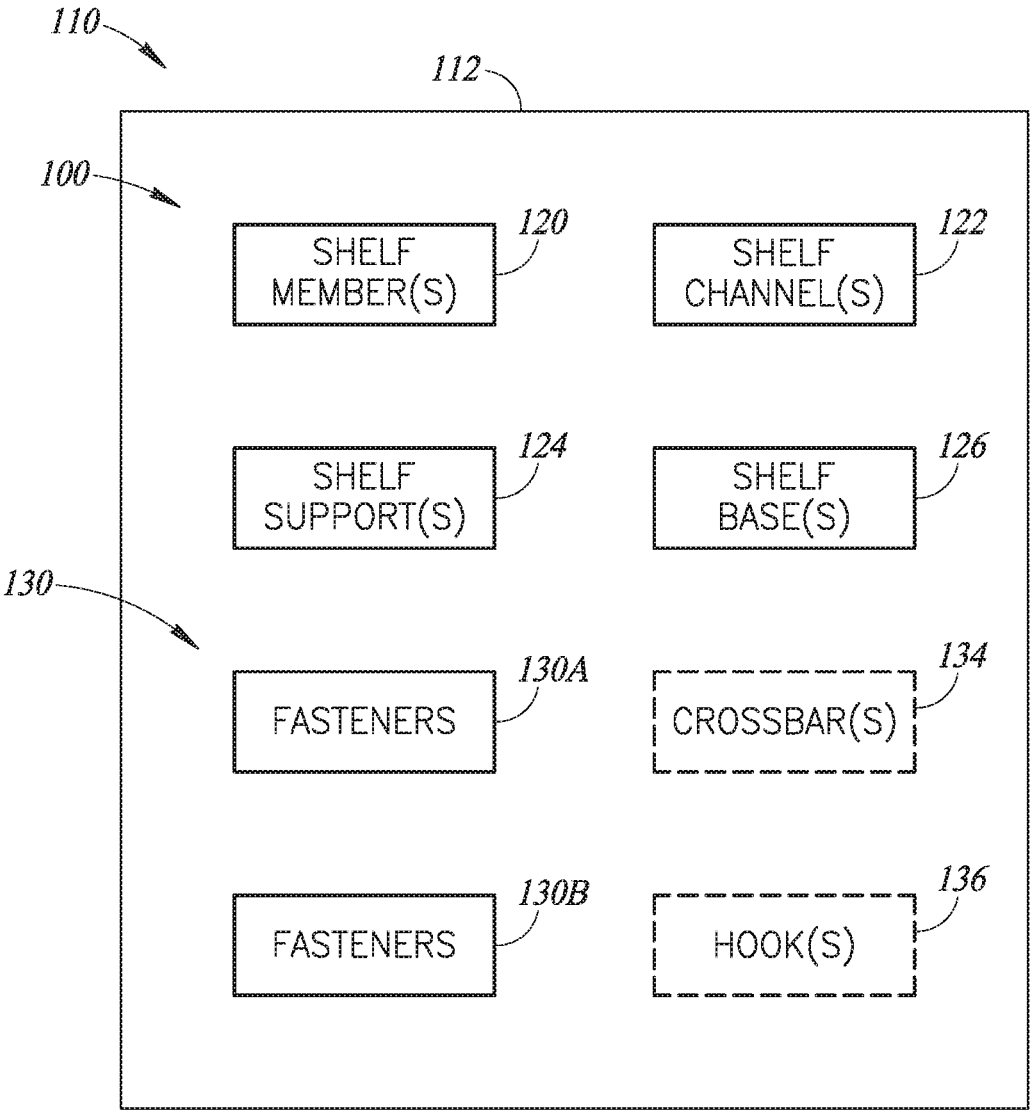
FIG. 1 is a block diagram illustrating components of a first embodiment of a wall hanging shelf and rack storage system.

FIG. 1 illustrates exemplary modular components 100 of a wall hanging shelf and rack storage system 110. Optionally, the components 100 may be included in a kit 112. The components 100 of the kit 112 may be packaged and sold together. The components 100 may include one or more of the following:

1. one or more shelf boards or members 120;
2. one or more shelf channels 122;
3. one or more shelf supports 124;
4. one or more shelf bases 126;
5. fasteners 130 (which include fasteners 130A and 130B);
6. one or more optional crossbars 134; and
7. one or more optional hooks 136.

As will be described below, the components 100 are configured to be assembled in numerous ways to produce a number of different shelf and/or rack configurations. The shelves constructed from the components 100 are mountable on and fully supported by a vertical support surface or wall 190 (see FIGS. 4, 9, 11, 14-21, and 31A-34).

Shelf Member(s)

Figure 21:
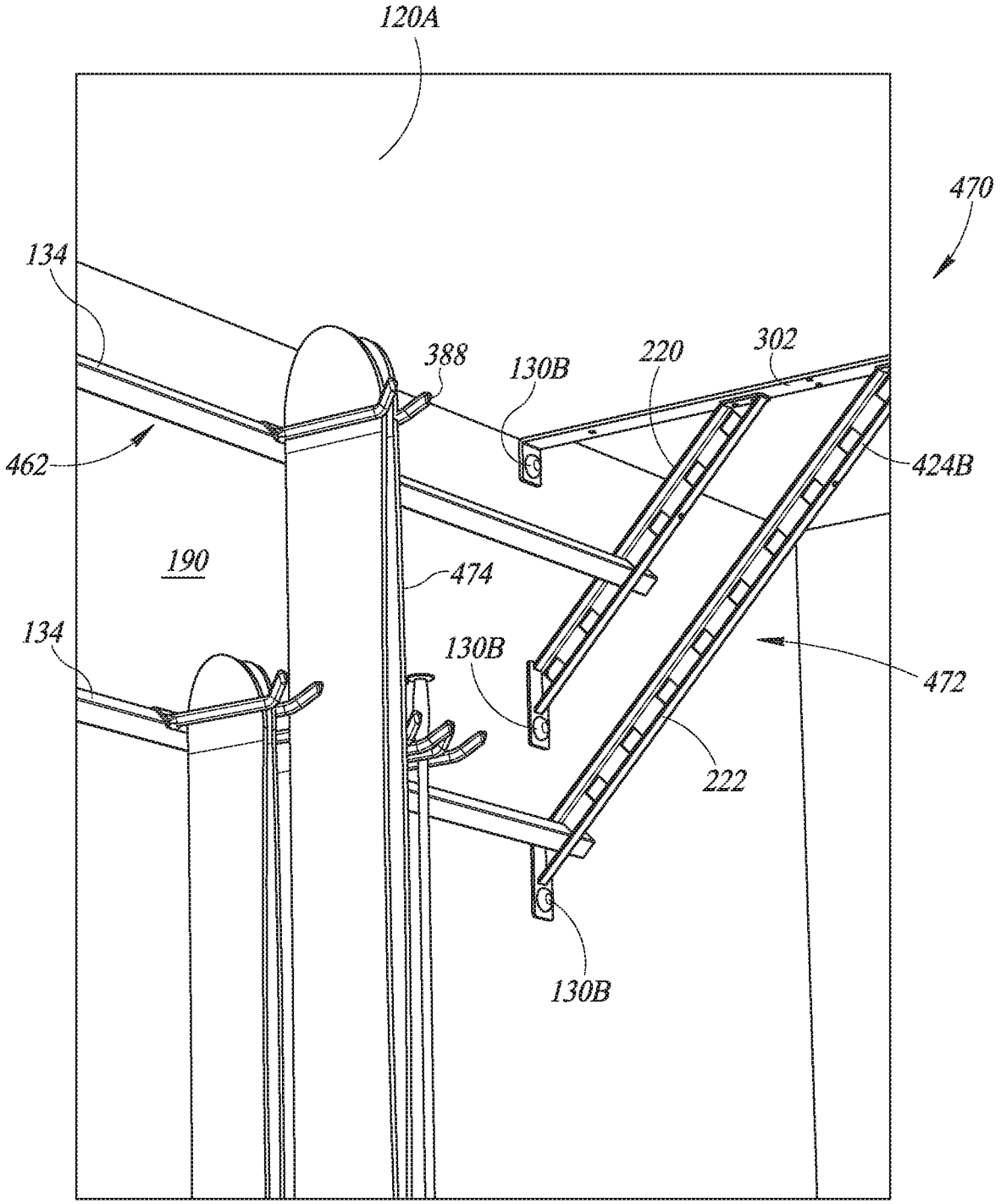
FIG. 21 is an enlarged perspective view of the second embodiment of the large shelf of FIG. 15 with the pair of skis hanging from a hook positioned on a short angled rack.
Figure 22:
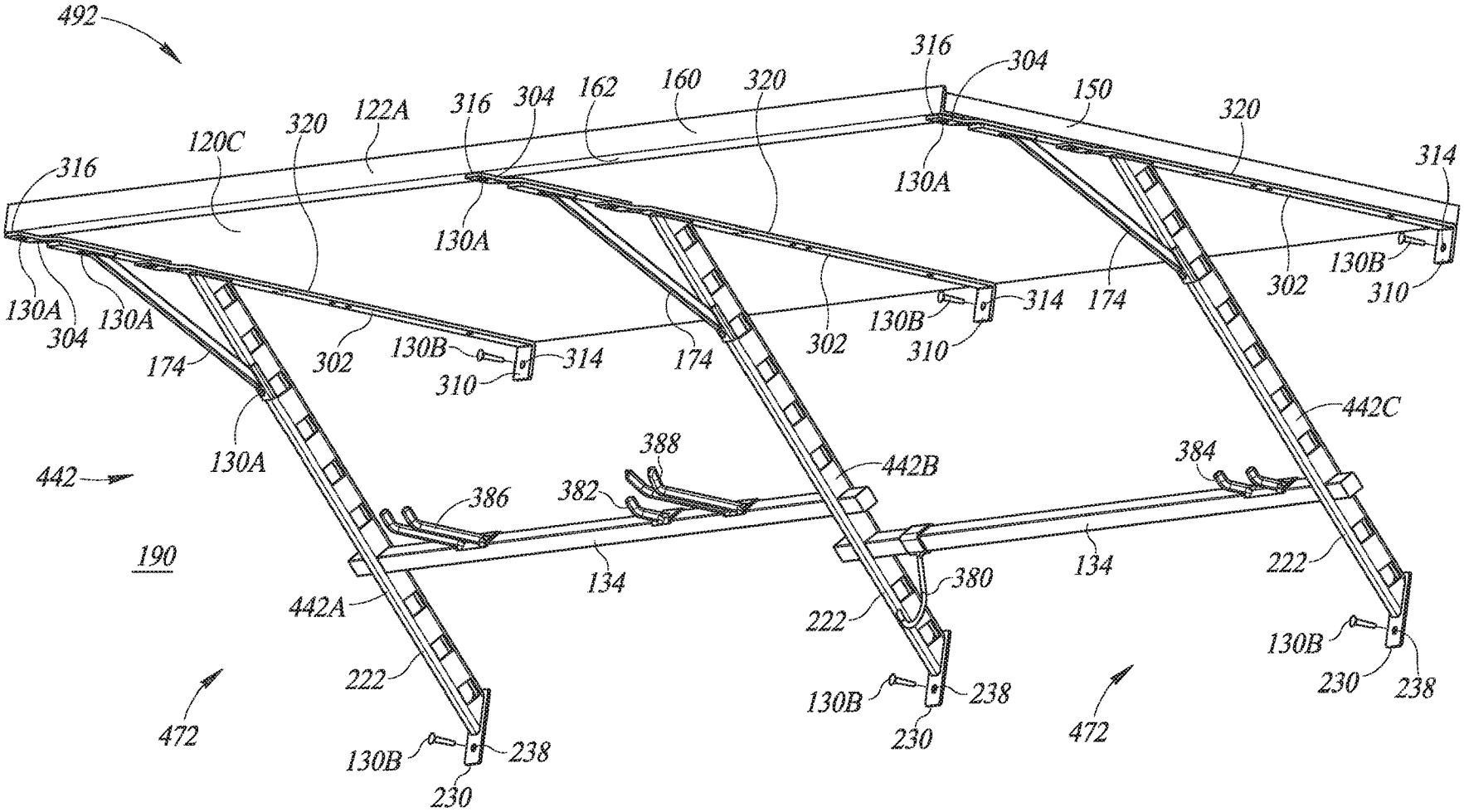
FIG. 22 is a perspective view of an underside of an extended large shelf constructed using the components of FIG. 1.

Referring to FIG. 1, the shelf member(s) 120 may include a deep shelf member 120A (see FIGS. 2, 9, and 14-21), a shallow shelf member 120B (see FIGS. 11, 17 and 18), and/or an extra deep shelf member 1200 (see FIG. 22). Each of the shelf member(s) 120 is implemented as a platform with a generally rectangular outer shape. Thus, referring to FIG. 2, each of the shelf member(s) 120 (see FIG. 1) has an upper surface 140 opposite a lower surface 142, a front edge 144 opposite a rear edge 146, and a right side edge 150 opposite a left side edge 152. By way of a non-limiting example, referring to FIG. 1, each of the shelf member(s) 120 may be implemented as a sheet of particleboard, plywood, and the like. By way of a non-limiting example, referring to FIG. 2, the deep shelf member 120A may have a depth from the front edge 144 to the rear edge 146 of about 24 inches. By way of another non-limiting example, the shallow shelf member 120B (see FIGS. 11, 17 and 18) may have a depth from the front edge 144 to the rear edge 146 of about 16 inches. By way of another non-limiting example, the extra deep shelf member 120C (see FIG. 22) may have a depth from the front edge 144 to the rear edge 146 of about 32 inches. Each of the shelf member(s) 120 (see FIG. 1) may have any suitable length from the right side edge 150 to the left side edge 152. By way of another non-limiting example, this length may range from about 32 inches to an unlimited length along any wall (e.g., the wall 190). Each of the shelf member(s) 120 (see FIG. 1) may have any suitable thickness from the upper surface 140 to the lower surface 142. By way of another non-limiting example, this thickness may range from about ½ inches to about 1 inch.

Shelf Channel(s)

Figure 3:
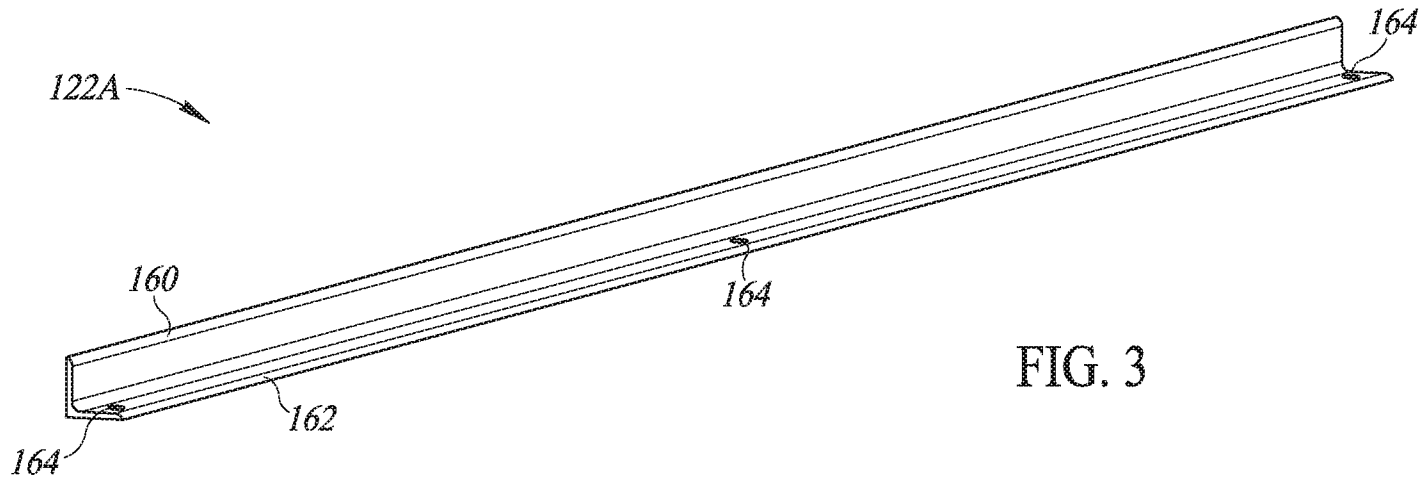
FIG. 3 is a perspective view of a rear-facing portion of a shelf channel of the system of FIG. 1.
Figure 16:
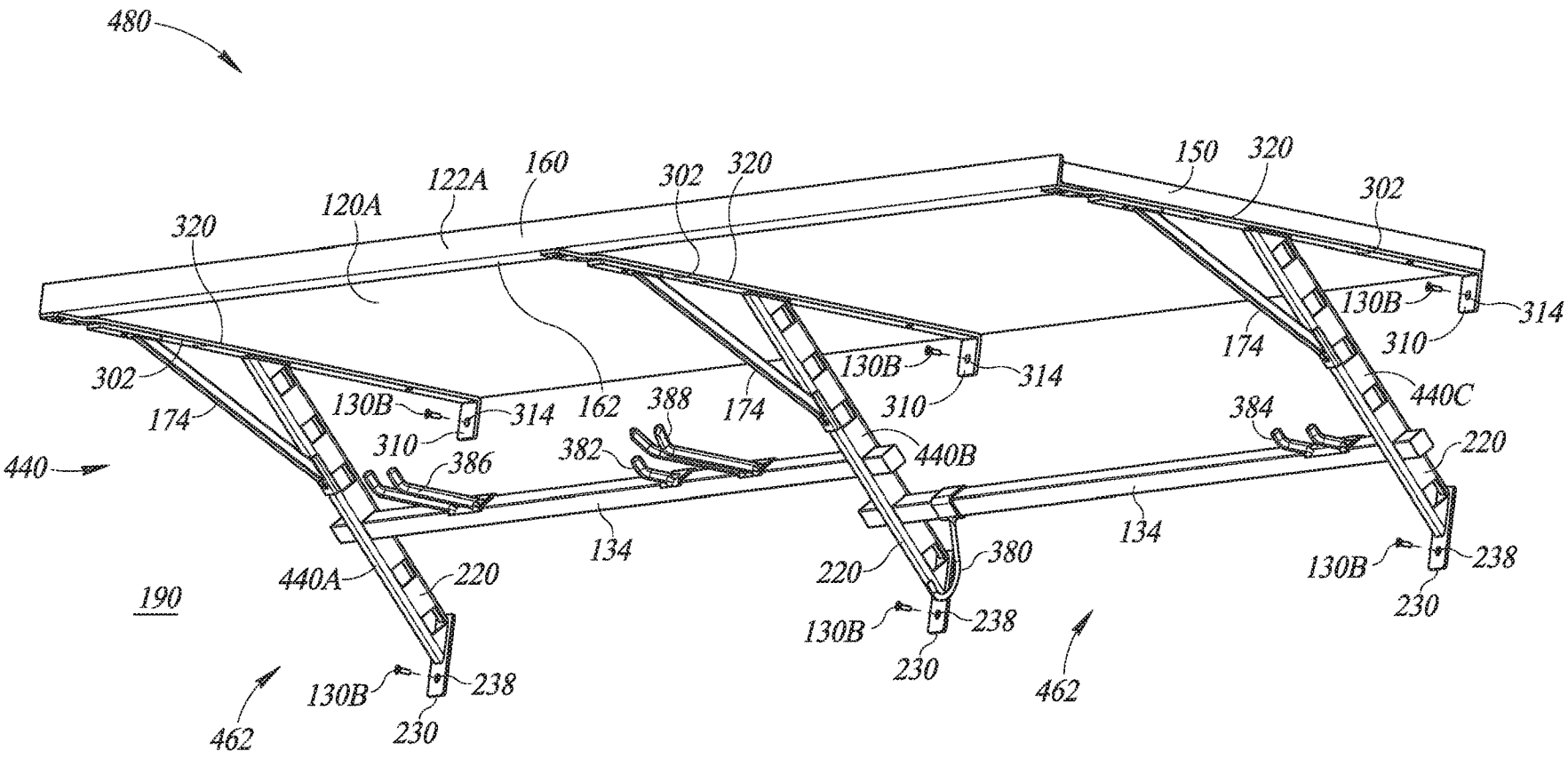
FIG. 16 is a perspective view of an underside of an extended small shelf constructed using the components of FIG. 1.
Figure 17:
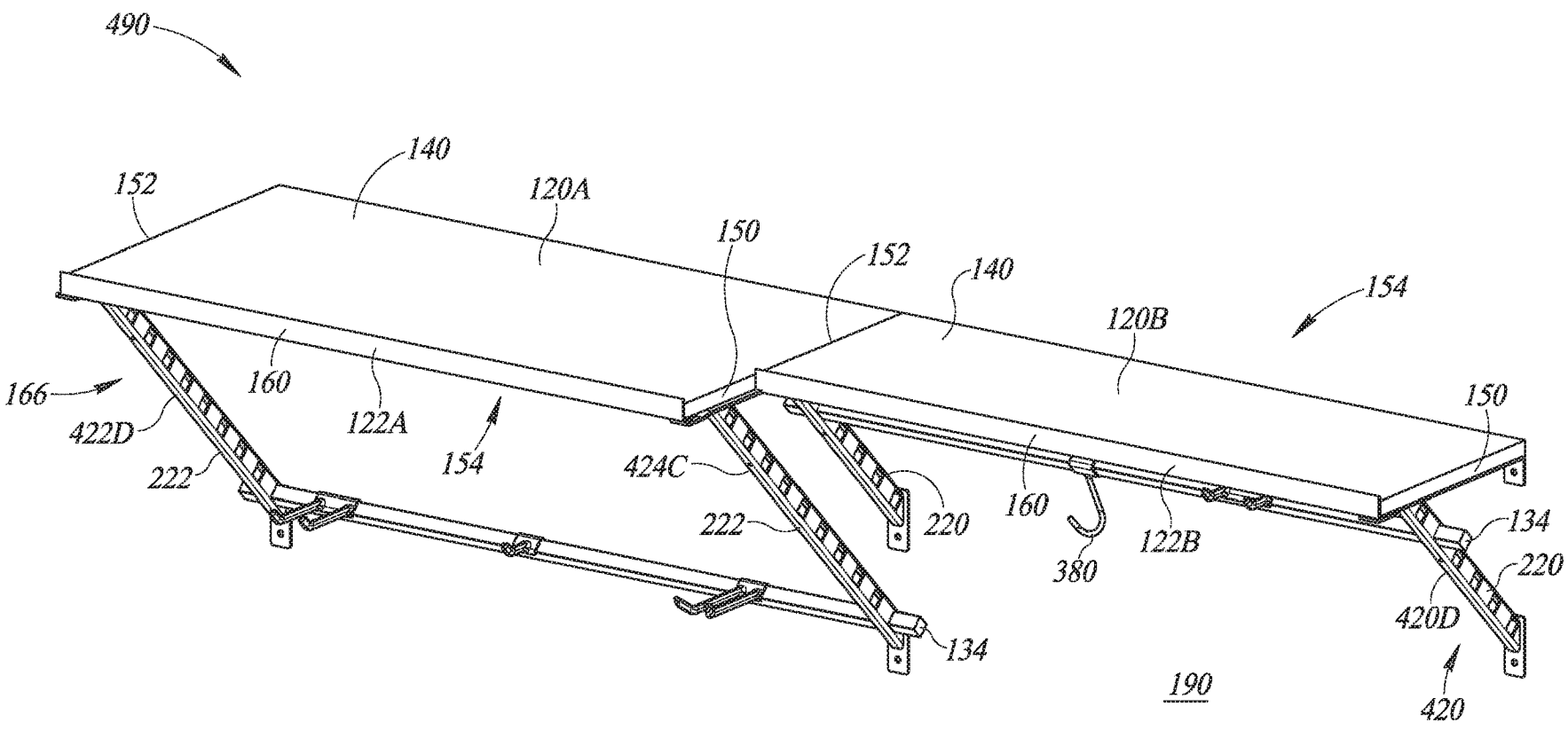
FIG. 17 is a perspective view of a top side of a combination shelf constructed using the components of FIG. 1.
Figure 18:
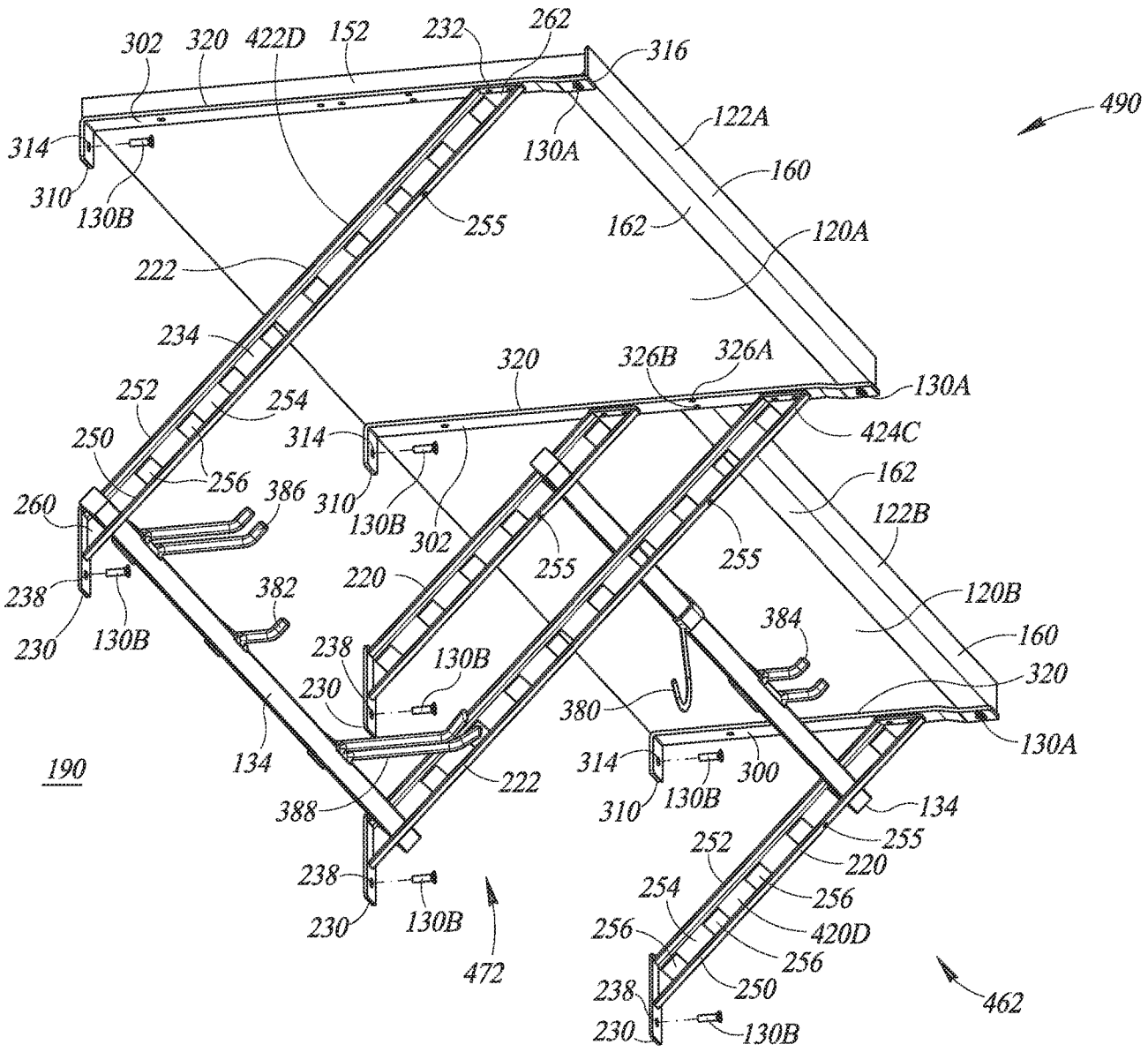
FIG. 18 is a perspective view of an underside of the combination shelf of FIG. 17.

Referring to FIG. 1, the shelf channel(s) 122 may include a first shelf channel 122A (see FIGS. 3, 9-11, and 14-20) and/or a second shelf channel 122B (see FIGS. 17 and 18). Each of the shelf channel(s) 122 has a generally L-shaped cross-sectional shape. Thus, referring to FIG. 3, each of the shelf channel(s) 122 (see FIG. 1) has a first leg 160 connected to a second leg 162. In the embodiment illustrated, the first leg 160 is substantially orthogonal to the second leg 162.

Figure 2:
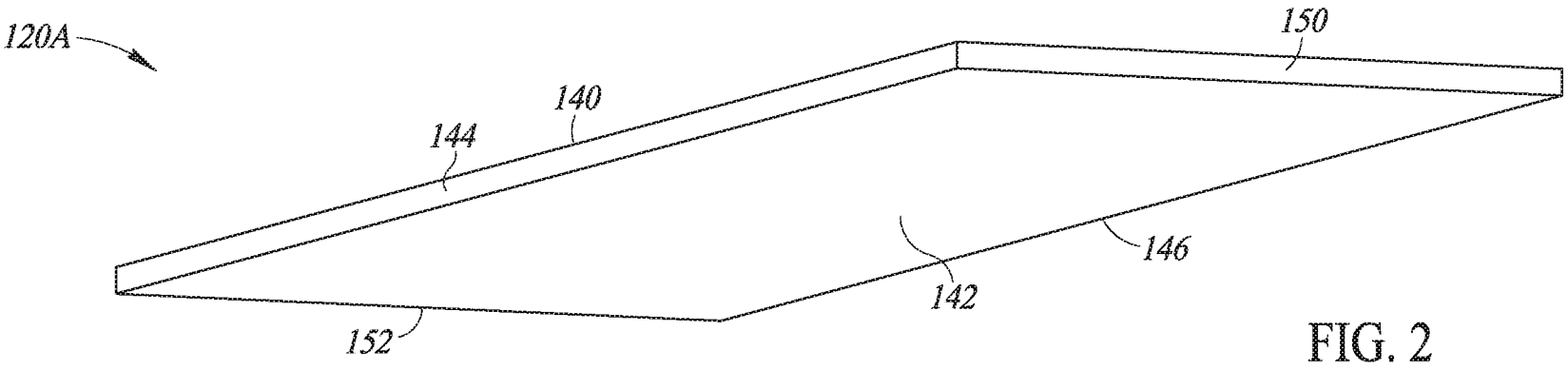
FIG. 2 is a perspective view of an underside of a deep shelf member of the system of FIG. 1.

Referring to FIG. 2, each of the shelf channel(s) 122 (see FIG. 1) is configured to be positioned at an intersection of the front edge 144 and the lower surface 142 of one of the shelf member(s) 120 (see FIG. 1). Thus, referring to FIG. 17, together, one of the shelf channel(s) 122 (see FIG. 1) and one of the shelf member(s) 120 (see FIG. 1) may be characterized as forming a shelf subassembly 154. Within the shelf subassembly 154, referring to FIG. 3, the first leg 160 abuts the front edge 144 (see FIG. 2) and the second leg 162 supports a front portion of the lower surface 142 (see FIG. 2). Thus, the first leg 160 will be described as being a vertical leg and the second leg 162 will be described as being a horizontal leg. The vertical leg 160 may have one or more through-holes (not shown) formed therein. Each of these through-holes (not shown) may be configured to receive one of the fasteners 130 (see FIG. 1), which couples the vertical leg 160 to the front edge 144 (see FIG. 2) of one of the shelf member(s) 120 (see FIG. 1). One or more spaced apart through-holes 164 may be formed in the horizontal leg 162.

By way of a non-limiting example, referring to FIG. 1, at least some of the shelf channel(s) 122 may be implemented as a metal angle constructed from steel, aluminum, and the like. By way of another non-limiting example, at least some of the shelf channel(s) 122 may be constructed from a rigid plastic or a similarly rigid material.

Shelf Support(s)

Referring to FIG. 1, at least one of the shelf support(s) 124 and at least one of the shelf base(s) 126 may be assembled together to form a brace subassembly 166 (see FIG. 17). Referring to FIG. 17, the shelf subassembly 154 is coupled to the wall 190 by one or more brace subassemblies 166 that provide vertical support to the shelf subassembly 154. Non-limiting examples of the brace subassemblies 166 that may be constructed from the components 100 (see FIG. 1) include an inverted brace assembly 400 (see FIGS. 9 and 10), a short angled brace assembly 420 (see FIGS. 11, 12, and 17), a long angled brace assembly 422 (see FIGS. 14 and 15), a rack combination brace assembly 424 (see FIG. 15), an extended short brace assembly 440 (see FIGS. 13, 16, and 19), and/or an extended long brace assembly 442 (see FIG. 22).

Figure 4:
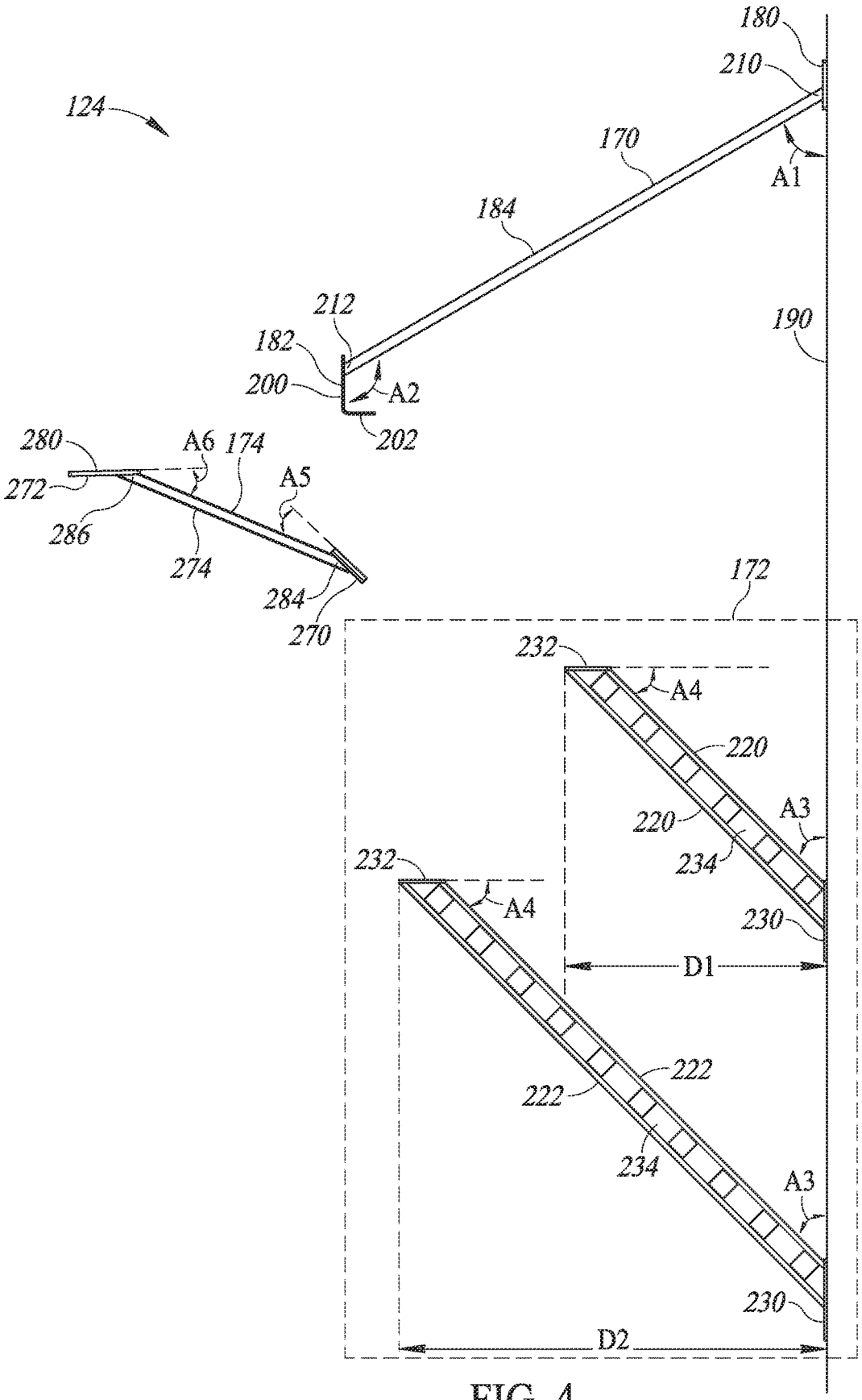
FIG. 4 is a side view of shelf support(s) of the system of FIG. 1.

Referring to FIG. 4, the shelf support(s) 124 may include one or more inverted shelf supports 170, one or more angled shelf supports 172, and/or one or more angled supports 174.

Figure 9:
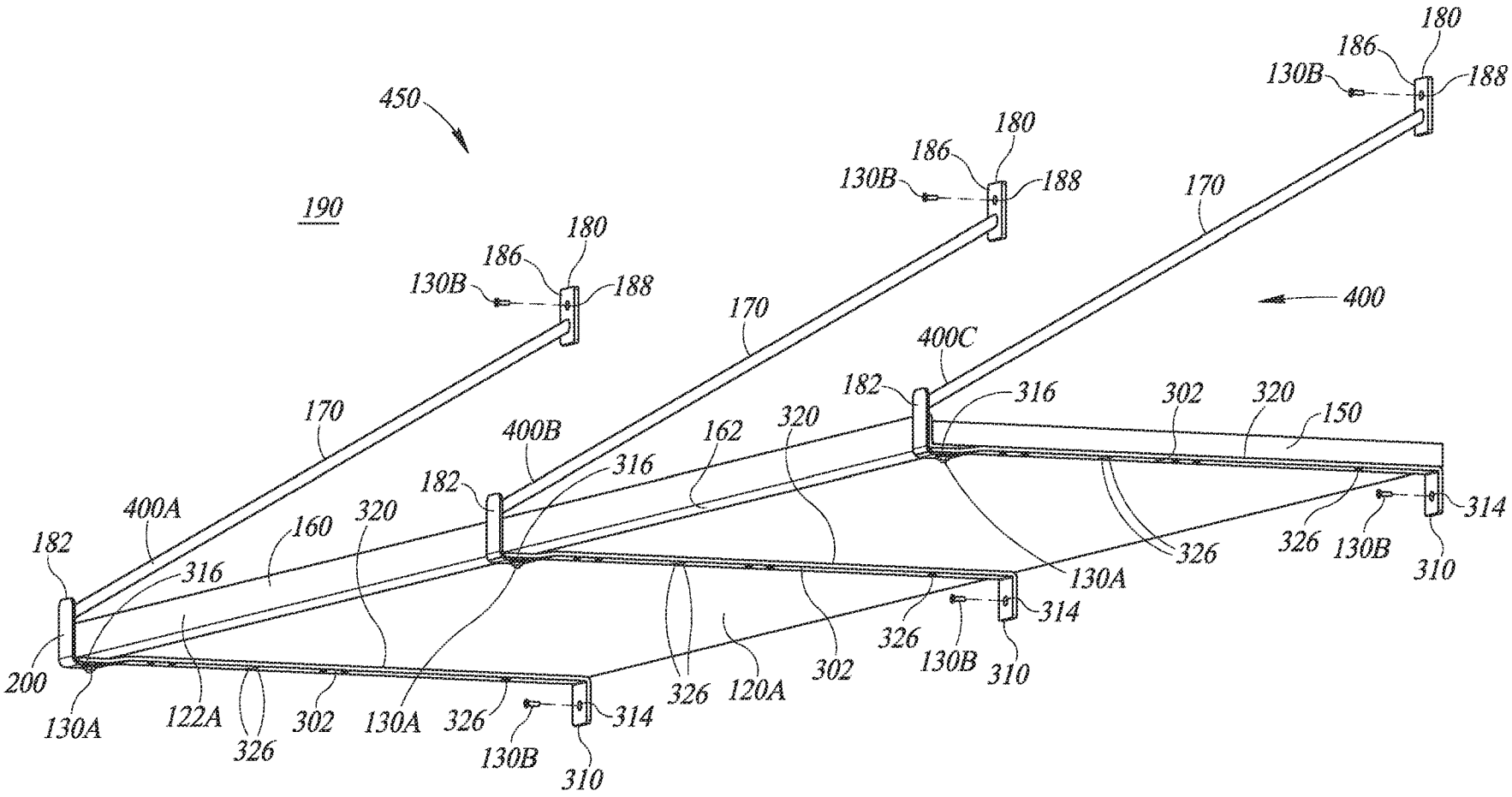
FIG. 9 is a perspective view of an underside of an inverted shelf constructed using the components of FIG. 1.

Each of the inverted shelf support(s) 170 has a wall mount bracket 180 connected to an inverted shelf bracket 182 by an elongated body member 184. Referring to FIG. 9, the wall mount bracket 180 may be implemented as a plate 186 with one or more through-holes 188 each configured to receive one of the fasteners 130E (e.g., screws), which is configured to fasten the wall mount bracket 180 to the wall 190. Referring to FIG. 4, the elongated body member 184 is attached to the wall mount bracket 180 at an inside angle "A1." By way of a non-limiting example, the angle "A1" may range from about 45 degrees to about 65 degrees.

Figure 10:
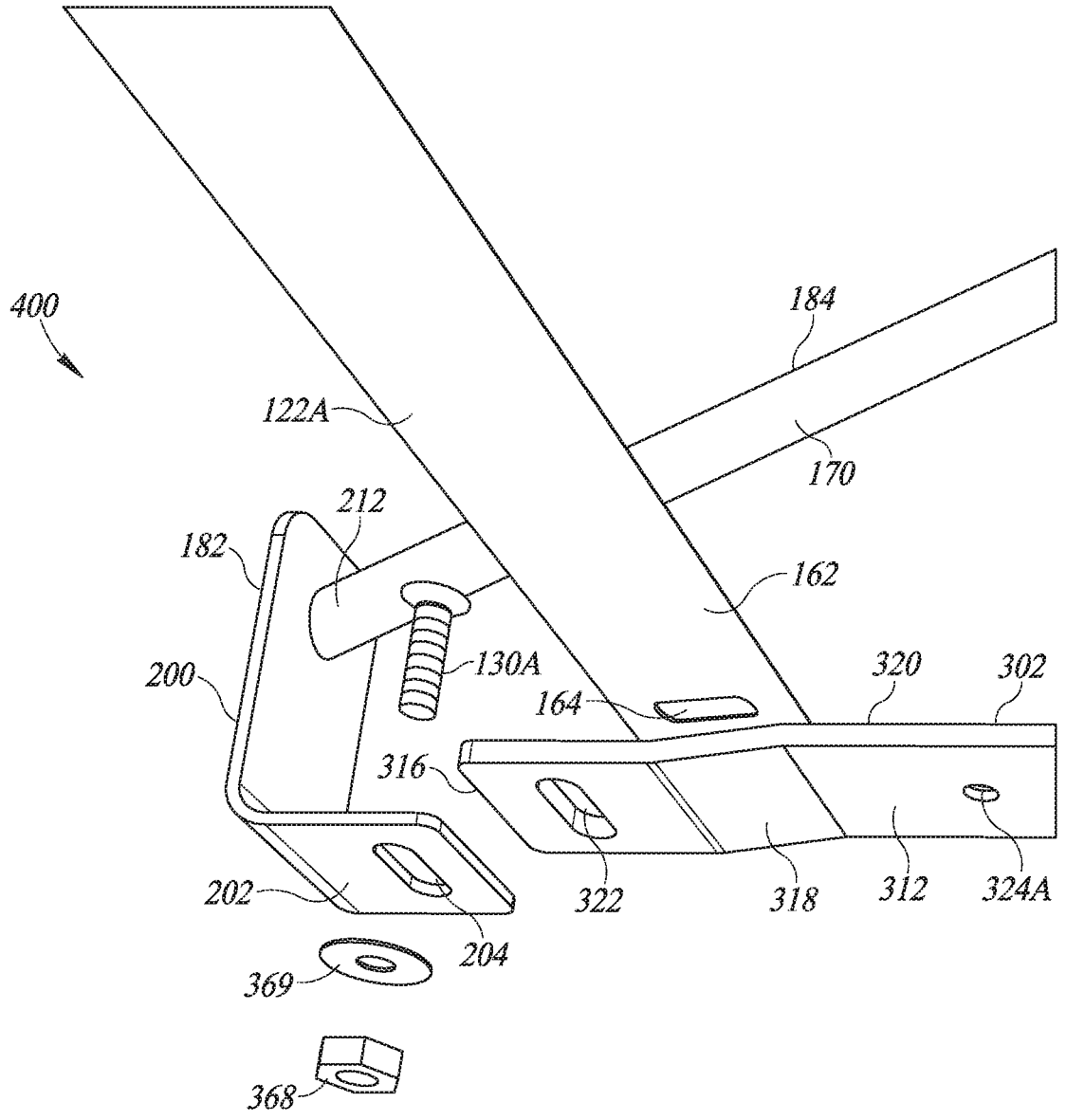
FIG. 10 is an enlarged exploded side perspective view of a portion of an inverted brace assembly constructed using the components of FIG. 1.

Referring to FIG. 10, the inverted shelf bracket 182 may be generally L-shaped and configured to be attached to a portion of the horizontal leg 162 of one of the shelf channel(s) 122 (see FIG. 1). For ease of illustration, the inverted shelf bracket 182 will be described as being attached to the horizontal leg 162 of the shelf channel 122A. Referring to FIG. 4, the inverted shelf bracket 182 has a first leg 200 attached to a second leg 202. The first leg 200 may be substantially orthogonal to the second leg 202. The elongated body member 184 is attached to the first leg 200 at an inside angle "A2." Together, the inside angles "A1" and "A2" may total 180 degrees. Referring to FIG. 10, the second leg 202 may have one or more through-holes 204 each configured to receive one of the fasteners 130A.

The elongated body member 184 may be substantially linear and have a round cross-sectional shape. By way of a non-limiting example, the elongated body member 184 may be implemented as a metal rod. Referring to FIG. 4, the elongated body member 184 is connected at its first end 210 to the wall mount bracket 180 and at its second end 212 to the first leg 200 of the inverted shelf bracket 182. The elongated body member 184 extends from the wall mount bracket 180 at the angle "A1" toward the inverted shelf bracket 182. Referring to FIG. 10, the second end 212 is connected to the first leg 200 at a sufficient distance from the second leg 202 to allow the vertical leg 160 (see FIGS. 3, 9, and 11-19) of the shelf channel 122A to be positioned against the first leg 200.

Referring to FIG. 4, the angled shelf support(s) 172 may include one or more short shelf supports 220 configured to extend outwardly from the wall 190 by a first distance "D1" and/or one or more long shelf supports 222 configured to extend outwardly from the wall 190 by a second distance "D2." The second distance "D2" is greater than the first distance "D1." By way of another non-limiting example, the first distance "D1" may range from about 14 inches to about 18 inches and the second distance "D2" may range from about 22 inches to about 26 inches. As will be described below, together, one of the short shelf supports 220 and one of the angle support(s) 174 may be substituted for one of the long shelf supports 222. As will be also described below, one of the angle support(s) 174 may be used to extend one of the long shelf support(s) 222.

Figure 11:
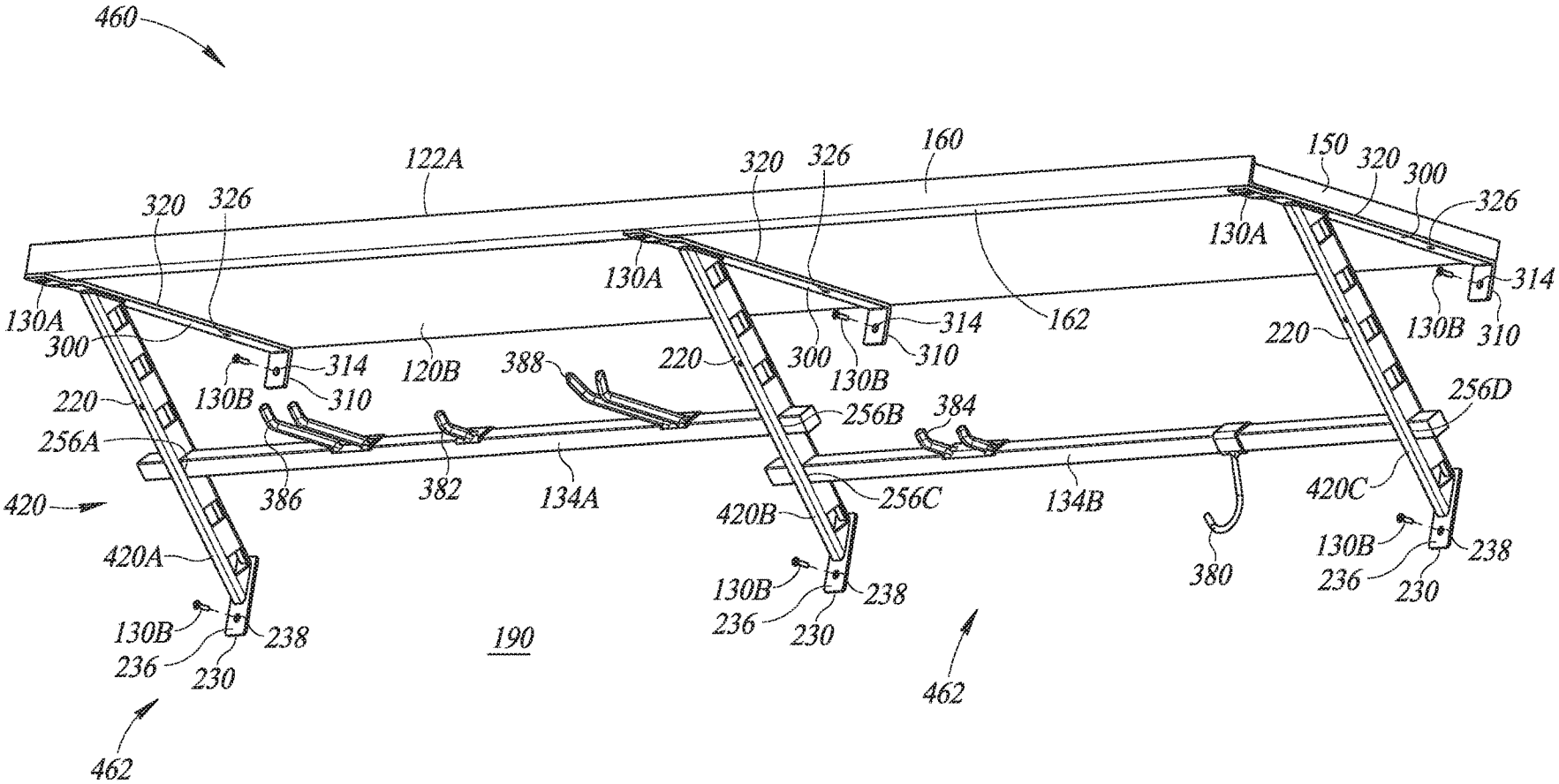
FIG. 11 is a perspective view of an underside of a small shelf constructed using the components of FIG. 1.

Each of the angled shelf support(s) 172 includes a wall mount bracket 230 connected to a shelf bracket 232 by an elongated body member 234. Referring to FIG. 11, the wall mount bracket 230 may be implemented as a plate 236 that is positionable alongside the wall 190. The plate 236 includes one or more through-holes 238 each configured to receive one of the fasteners 130B (e.g., screws), which is configured to fasten the wall mount bracket 230 to the wall 190. Referring to FIG. 4, the elongated body member 234 is attached to the plate 236 (see FIGS. 11 and 13) such that an inside angle "A3" is defined between the elongated body member 234 and the wall 190. By way of a non-limiting example, the angle "A3" may range from about 35 degrees to about 65 degrees.

Figure 12:
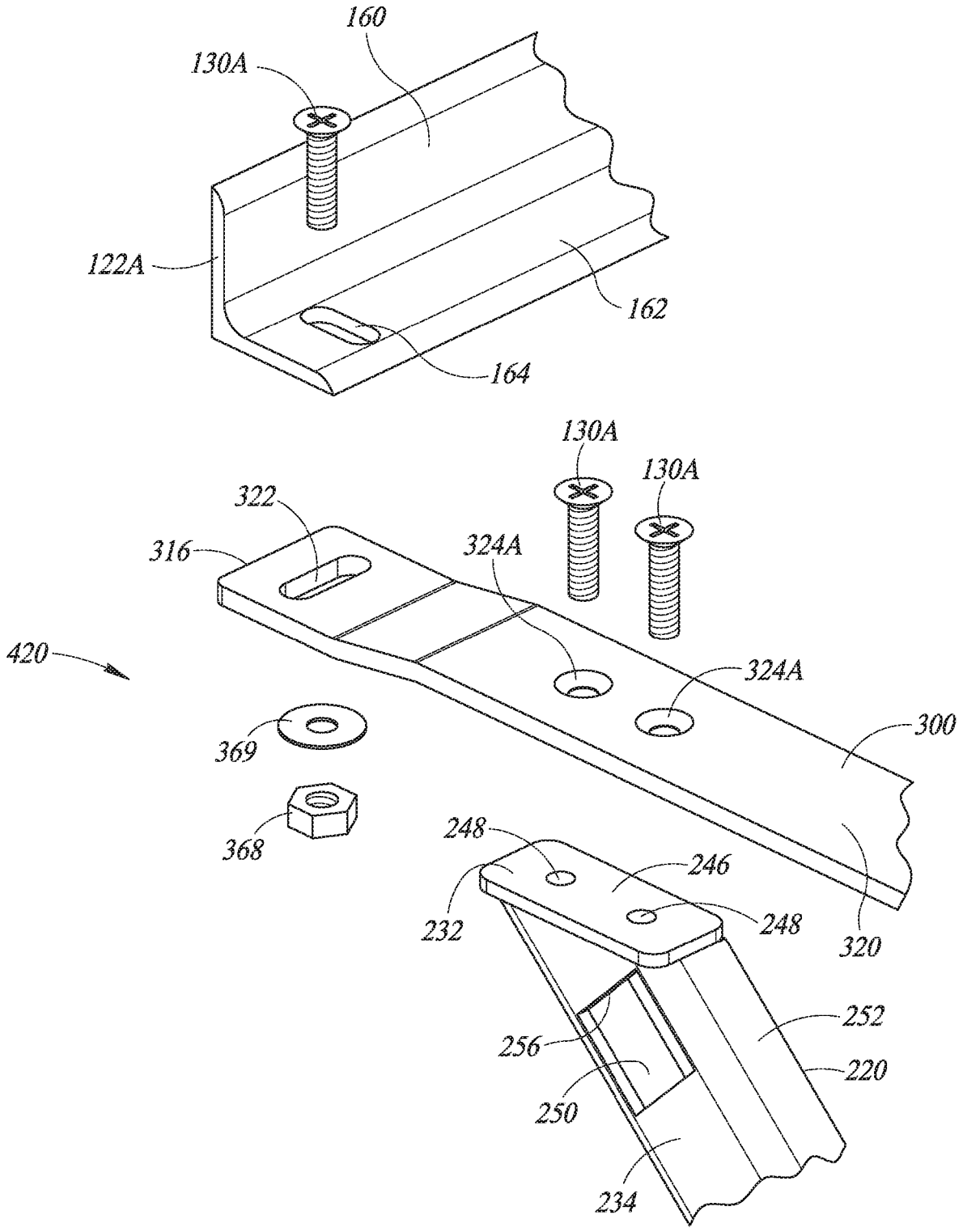
FIG. 12 is an enlarged exploded side perspective view of a portion of a short angled brace assembly constructed using the components of FIG. 1.

Referring to FIG. 12, the shelf bracket 232 may be implemented as a plate 246 with one or more through-holes 248 each configured to receive one of the fasteners 130A. Each of the through-hole(s) 248 may be threaded or tapped. The plate 246 is positionable to be substantially horizontal with respect to the wall 190 (see FIGS. 4, 9, 11, 14-21, and 31A-34). Referring to FIG. 4, the elongated body member 234 is attached to the plate 246 (see FIG. 12) at an inside angle "A4." Together, the inside angles "A3" and "A4" may total 90 degrees. Thus, the angle "A4" may range from about 25 degrees to about 55 degrees.

Referring to FIG. 18, the elongated body member 234 may be substantially linear and have a generally U-shaped cross-sectional shape with a first leg 250 connected to second leg 252 by a base portion 254. The first leg 250 may include one or more through-holes 255 each configured to receive one of the fasteners 130A (see FIGS. 1, 9, 10, 12, 13, 18, 22, 23, 30-32, and 34). The base portion 254 may have one or more through-holes 256 formed therein. In the example illustrated, each of the through-hole(s) 256 is generally rectangular or square shaped. The base portion 254 of each of the short shelf support(s) 220 may include a first number (e.g., six) of the through-hole(s) 256 and the base portion 254 of each of the long shelf support(s) 222 may include a second number (e.g., ten) of the through-hole(s) 256. The second number may be larger than the first number. The elongated body member 234 is connected at its first end 260 to the wall mount bracket 230 and at its second end 262 to the shelf bracket 232.

Figure 5:
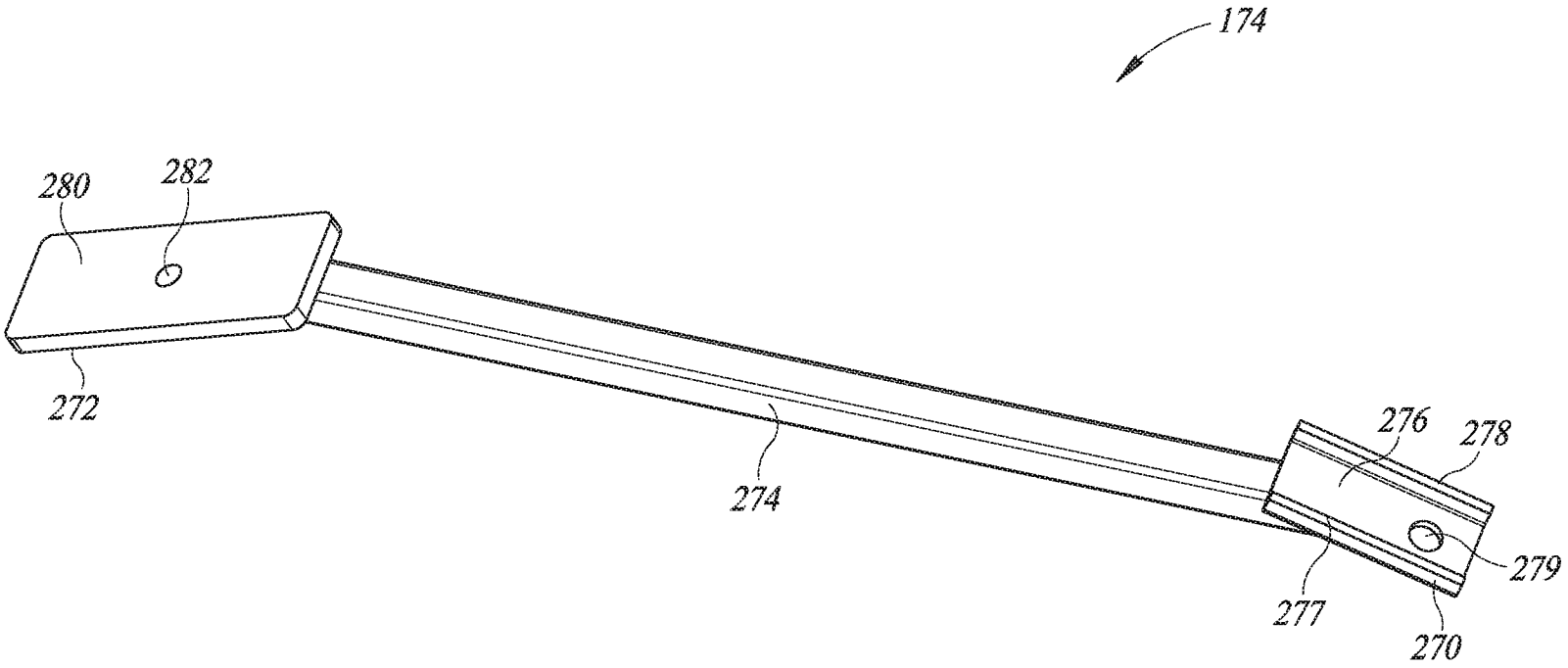
FIG. 5 is a top perspective view of an angled support of the shelf supports) of FIG. 4.
Figure 13:
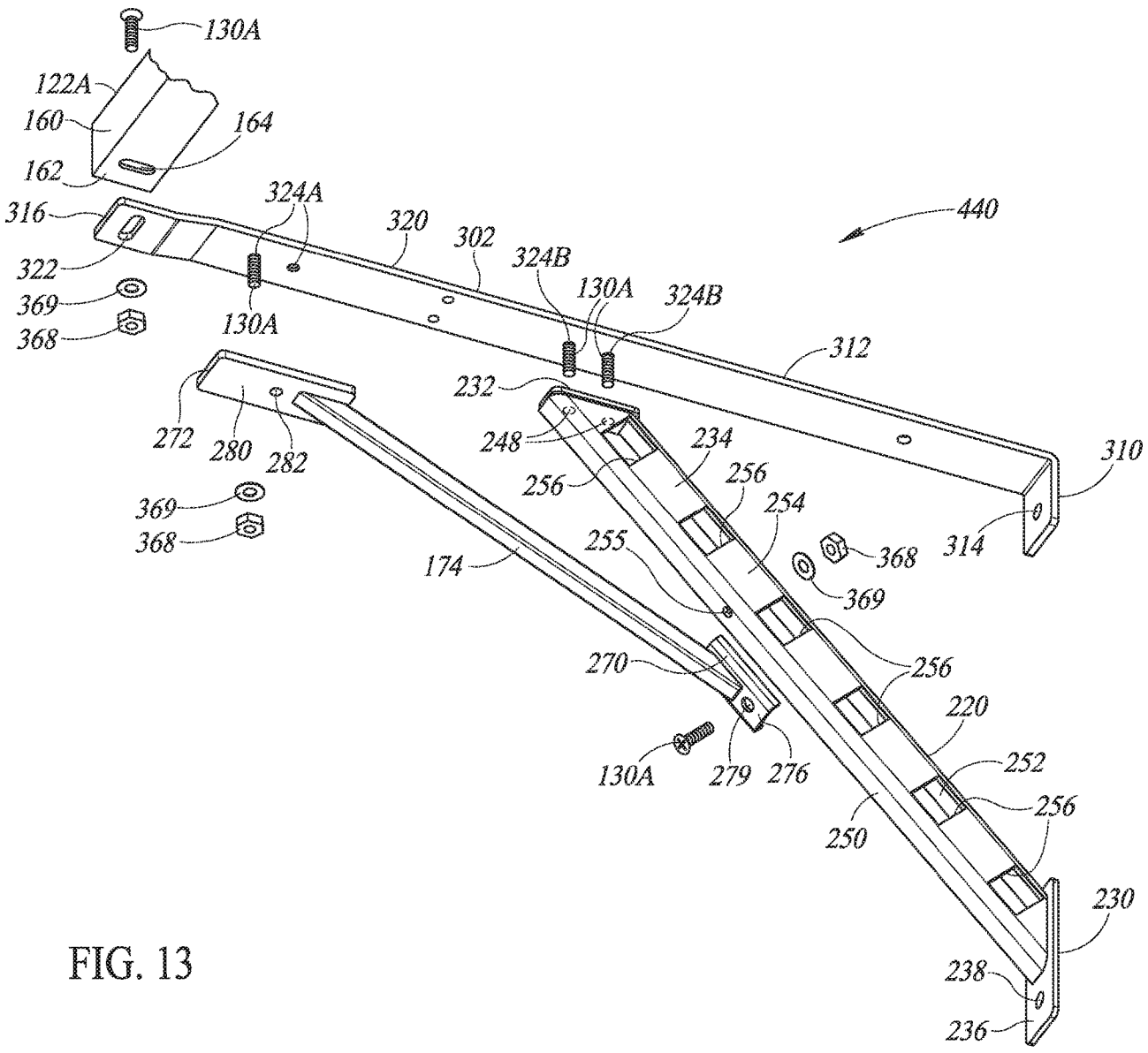
FIG. 13 is an enlarged exploded side perspective view of an extended short brace assembly constructed using the components of FIG. 1.

Referring to FIG. 5, the angle support(s) 174 may each have a support mount bracket 270 connected to a base bracket 272 by an elongated body member 274. The support mount bracket 270 may be implemented as a plate 276 flanked by outwardly extending sidewalls 277 and 278. Thus, the support mount bracket 270 may be substantially U-shaped. Referring to FIG. 4, the sidewalls 277 and 278 (see FIG. 5) are spaced apart sufficiently to receive the elongated body member 234 of one of the angled shelf support(s) 172 therebetween with the first leg 250 (see FIGS. 12, 13, and 18) positioned adjacent the plate 276 (see FIG. 5). Referring to FIG. 13, the plate 276 may include one or more through-holes 279 configured to receive one of the fasteners 130A, which is configured to fasten the support mount bracket 270 to the first leg 250 of one of the angled shelf support(s) 172 (see FIG. 4). Referring to FIG. 4, the elongated body member 274 is attached to the plate 276 (see FIG. 5) at an inside angle "A5." By way of a non-limiting example, the angle "A5" may range from about 5 degrees to about 15 degrees.

Referring to FIG. 13, the base bracket 272 may include a plate 280 with one or more through-holes 282 each configured to receive one of the fasteners 130A. Referring to FIG. 4, the plate 280 is positionable to be substantially horizontal with respect to the wall 190. The elongated body member 274 is attached to the plate 280 at an inside angle "A6." By way of a non-limiting example, the angle "A6" may range from about 5 degrees to about 15 degrees.

The elongated body member 274 may be substantially linear and have a generally square, round, or rectangular cross-sectional shape. By way of a non-limiting example, the elongated body member 274 may be implemented as a metal rod. The elongated body member 274 is connected at its first end 284 to the support mount bracket 270 and at its second end 286 to the base bracket 272.

Shelf Base(s)

Figure 6:
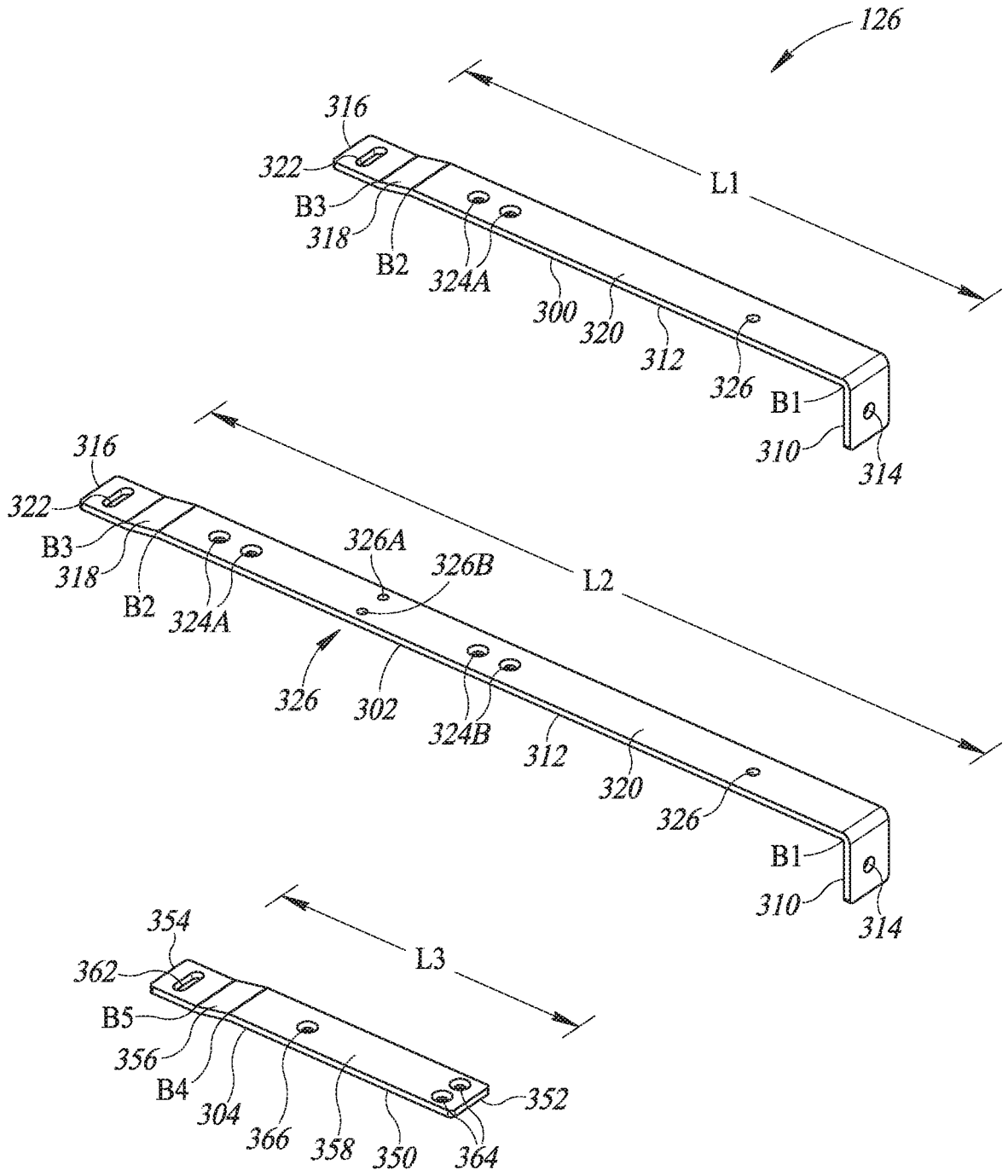
FIG. 6 is a top perspective view of shelf base(s) of the system of FIG. 1.

Referring to FIG. 6, the shelf base(s) 126 may include one or more short shelf bases 300 each having a first length "L1," one or more long shelf bases 302 each having a second length "L2," and/or the shelf base extension(s) 304 each having a third length "L3." The second length "L2" is greater than the first length "L1." By way of non-limiting examples, the first length "L1" may range from about 16 inches to about 20 inches, the second length "L2" may range from about 24 inches to about 28 inches, and the third length "L3" may range from about 9 inches to about 12 inches. As will be described below, referring to FIG. 22, one of the shelf base extension(s) 304 may be used to extend one of the long shelf base(s) 302 (e.g., by about 8 inches to about 32 inches).

Returning to FIG. 6, each of the short and long shelf bases 300 and 302 may be generally L-shaped and have a first leg 310 connected to a second leg 312. The first leg 310 may be substantially orthogonal to the second leg 312. Referring to FIG. 18, the first leg 310 may function like a wall mount bracket and is attachable to the wall 190. The first leg 310 may include one or more through-holes 314 each configured to receive one of the fasteners 130B, which is configured to fasten the first leg 310 to the wall 190.

Referring to FIG. 10, the second leg 312 has a free end portion 316 configured to be positioned against the horizontal leg 162 of one of the shelf channel(s) 122 (see FIG. 1). As mentioned above, the shelf channel 122A has been illustrated in FIG. 10. The second leg 312 may include a bent portion 318 configured to position the free end portion 316 below the horizontal leg 162 and a substantially flat support portion 320 configured to be positioned adjacent to the lower surface 142 (see FIG. 2) of one of the shelf member(s) 120 (see FIG. 1). The free end portion 316 may include one or more through-holes 322 each configured to receive one of the fasteners 130A, which is configured to fasten the free end portion 316 to the horizontal leg 162 of the shelf channel 122A. Each of the through-hole(s) 322 may be aligned with one of the through-hole(s) 164 and one of the fasteners 130A inserted therethrough to couple the free end portion 316 to the shelf channel 122A.

Referring to FIG. 12, the support portion 320 includes one or more distal through-holes 324A each configured to receive one of the fasteners 130A. Referring to FIG. 13, the support portion 320 of each of the long shelf base(s) 302 may include one or more proximal through-holes 324B each configured to receive one of the fasteners 130A.

Optionally, referring to FIG. 6, the support portion 320 may include one or more through-holes 326 each configured to receive one of the fasteners 130 (see FIG. 1), which fasten the support portion 320 to one of the shelf member(s) 120 (see FIG. 1). The through-hole(s) 326 of each of the long shelf bases 302 may include side-by-side through-holes 326A and 326B positioned in between the distal and proximal through-holes 324A and 324B. Two of the shelf member(s) 120 may be positioned edge-to-edge on top of one of the long shelf base(s) 302. One of the fasteners 130 (see FIG. 1) may be installed in the through-hole 326A and extend into a first one of the two shelf member(s) 120. A different one of the fasteners 130 may be installed in the through-hole 326B and extend into a different second one of the two shelf member(s) 120. The two fasteners 130 (see FIG. 1) installed in the through-holes 326A and 326B help maintain the first and second shelf member(s) 120 in place on top of the long shelf base 302. Thus, any number of the shelf member(s) 120 may be used to construct a continuous shelf.

By way of a non-limiting example, each of the short and long shelf bases 300 and 302 may be implemented as a bar including a first bend "B1" that defines the first and second legs 310 and 312, a second bend "B2" that offsets the free end portion 316 from the support portion 320, and a third bend "B3" that orients the free end portion 316 to be substantially parallel with the support portion 320. Together, the second and third bends "B2" and "B3" define the bent portion 318.

Referring to FIG. 6, each of the shelf base extension(s) 304 has a body portion 350 with a free first end portion 352 opposite a free second end portion 354. The free first end portion 352 is configured to be positioned between the free end portion 316 of one of the long shelf base(s) 302 and one of the shelf member(s) 120 (see FIG. 1). The free second end portion 354 is substantially identical to the free end portions 316 of the short and long shelf bases 300 and 302. Thus, referring to FIG. 10, the free second end portion 354 (see FIG. 6) is configured to be positioned under the horizontal leg 162 of one of the shelf channel(s) 122 (see FIG. 1).

Referring to FIG. 6, the body portion 350 includes a bent portion 356 and a support portion 358 that are substantially similar to the bent portions 318 and the support portions 320, respectively, of the short and long shelf bases 300 and 302. Thus, the bent portion 356 is configured to position the free second end portion 354 below one of the shelf channel(s) 122 (see FIG. 1) and the support portion 358 is configured to be positioned adjacent one of the shelf member(s) 120 (see FIG. 1). The free second end portion 354 may include one or more through-holes 362 each substantially identical to one of the through-holes 322. Referring to FIG. 12, each of the through-hole(s) 362 (see FIG. 6) is configured to receive one of the fasteners 130A, which is configured to fasten the free second end portion 354 (see FIG. 6) to the horizontal leg 162 of one of the shelf channel(s) 122 (see FIG. 1). Referring to FIG. 6, positioned near the free first end portion 352, the support portion 358 includes one or more through-holes 364 configured to be aligned with the through-hole(s) 322 of one of the long shelf base(s) 302. Each of the more through-hole(s) 364 is configured to receive one of the fasteners 130A (see FIGS. 1, 9, 10, 12, 13, 18, 22, 23, 30-32, and 34), which extends through the through-hole 364 and one of the through-hole(s) 322 to fasten the support portion 358 to one of the long shelf base(s) 302. Optionally, the support portion 358 may include one or more through-holes 366 each configured to receive one of the fasteners 130A (see FIGS. 1, 9, 10, 12, 13, 18, 22, 23, 30-32, and 34), which fastens the support portion 358 to either one of the long shelf support(s) 222 (see FIGS. 4, 14, 15, and 17-21) or one of the angle support(s) 174 (see FIGS. 4, 5, 13, 16 and 19).

By way of a non-limiting example, each of the shelf base extension(s) 304 may be implemented as a bar including a first bend "B4" that offsets the free second end portion 354 from the support portion 358, and a second bend "B5" that orients the free second end portion 354 to be substantially parallel with the support portion 358. Together, the first and second bends "B4" and "B5" define the bent portion 356.

Fasteners

Referring to FIG. 1, the fasteners 130 may each be implemented as a screw, bolt, rivet, and the like. As mentioned above, the fasteners 130 may include the fasteners 130A and 130B. Referring to FIG. 10, the fasteners 130A (e.g., bolts) are configured to assemble two or more of the components 100 (see FIG. 1) together. Referring to FIG. 12, the fasteners 130A may be configured to thread into a nut 368 or a threaded through-hole (e.g., one of the through-hole(s) 248) formed in a threaded plate (e.g., the plate 246). Optionally, the fasteners 130A may be configured to pass through a washer 369. In some embodiments, one or more of the fasteners 130A may be implemented as an adhesive or other type of bonding agent. In some embodiments, one or more of the fasteners 130A may be implemented as another type of attachment (e.g., welding).

Referring to FIG. 18, the fasteners 130B (e.g., screws) are configured to fasten the wall mount bracket(s) 180 (see FIGS. 4, 9, and 19), the wall mount bracket(s) 230, and the first legs 310 of the short and long shelf bases 300 and 302 to the wall 190.

Referring to FIG. 1, the fasteners 130A may be used to fasten one of the shelf channel(s) 122 to one or more of the shelf member(s) 120. For example, the fasteners 130A may be used to fasten the horizontal leg 162 (see FIGS. 3, 9, and 11-19) of one of the shelf channel(s) 122 to the lower surface 142 (see FIG. 2) of one of the shelf member(s) 120.

Additionally, the fasteners 130A may be used to fasten one of the shelf base(s) 126 to one or more of the shelf member(s) 120. For example, referring to FIG. 11, the fasteners 130A may be inserted into the through-hole(s) 326 and used to fasten the support portion 320 of one of the short shelf base(s) 300 to one of the shelf member(s) 120 (see FIG. 1). By way of another non-limiting example, referring to FIG. 9, the fasteners 130A may be inserted into the through-hole(s) 326 and used to fasten the support portion 320 of one of the long shelf base(s) 302 to one of the shelf member(s) 120 (see FIG. 1). By way of yet another non-limiting example, referring to FIG. 18, the fasteners 130A may be installed in the through-holes 326A and 326B of one of the long shelf base(s) 302 and used to couple the long shelf base 302 to a pair of the shelf member(s) 120 (see FIG. 1).

Optional Crossbar(s)

Figure 7:
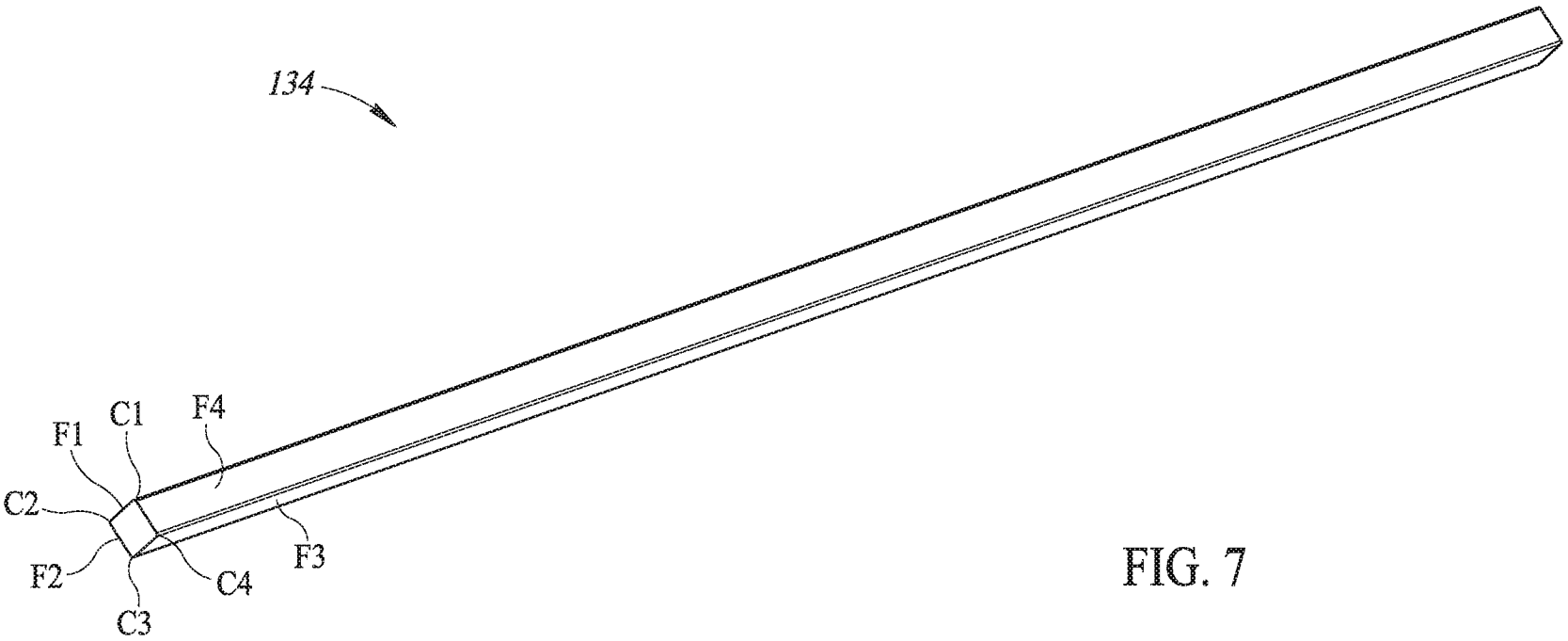
FIG. 7 is a perspective view of a crossbar of the system of FIG. 1.

Referring to FIG. 7, each of the optional crossbar(s) 134 may be substantially linear and have a rectangular or square cross-sectional shape. Thus, each of the optional crossbar(s) 134 may have corners "C1" to "C4." The corner "C1" is opposite the corner "C3," and the corner "C2" is opposite the corner "C4." The corners "C1" and "C3" may point in a substantially vertical direction with respect to the wall 190 (see FIGS. 4, 9, 11, 14-21, and 31A-34). On the other hand, the corners "C2" and "C4" may point in a substantially horizontal direction with respect to the wall 190 (see FIGS. 4, 9, 11, 14-21, and 31A-34). A first face "F1" may extend between the corners "C1" and "C2," a second face "F2" may extend between the corners "C2" and "C3," a third face "F3" may extend between the corners "C3" and "C4," and a fourth face "F4" may extend between the corners "C4" and "C1." By way of non-limiting examples, each of the optional crossbar(s) 134 may be about one inch wide by about one inch tall and have a length of about 50 inches.

Referring to FIG. 18, each of the crossbar(s) 134 is configured to be received in and extend through the through-holes 256 formed in the angled shelf support(s) 172 (see FIG. 4) to define a rack. Referring to FIG. 11, the optional crossbar(s) 134 and two of the short shelf supports 220 may be assembled into a short angled rack 462. Similarly, referring to FIG. 14, the optional crossbar(s) 134 and two of the long shelf supports 222 may be assembled into a long angled rack 472. The crossbar(s) 134 are each configured to support one or more of the optional hook(s) 136 (see FIGS. 1 and 8) and/or other items.

Referring to FIG. 18, by way of another non-limiting example, each of the crossbar(s) 134 may be implemented as a crossbar 1034A (described below and illustrated in FIGS. 28 and 34).

Optional Hook(s)

Figure 8:
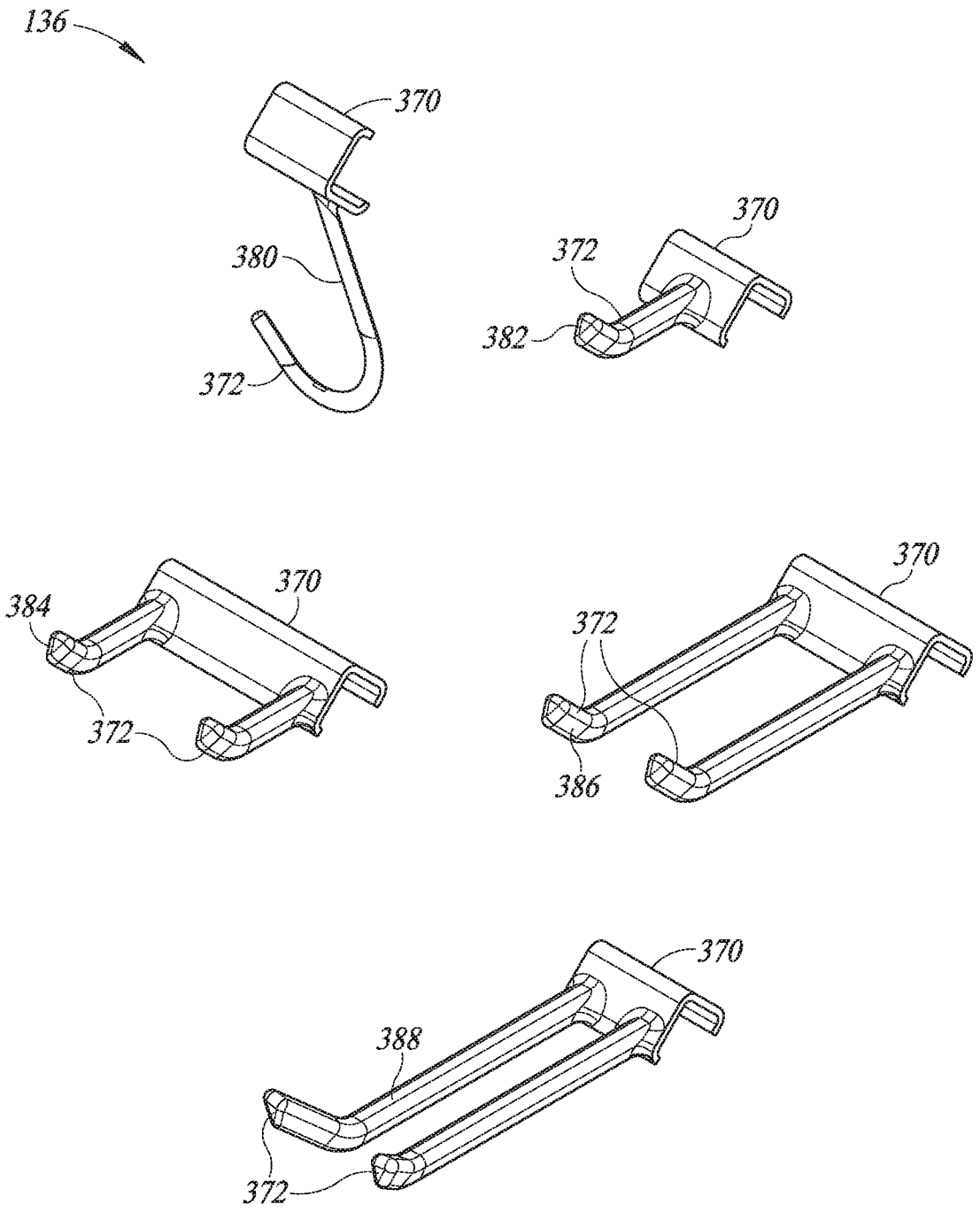
FIG. 8 is a side perspective view of hooks of the system of FIG. 1.

Referring to FIG. 8, each of the optional hook(s) 136 includes a connector 370 connected to a hook portion 372. By way of non-limiting examples, the hook(s) 136 may include one or more of the following:

1. bicycle hook(s) 380;
2. small single hook(s) 382;
3. small double hook(s) 384;
4. large double hook(s) 386; and
5. ski hook(s) 388.

Figure 14:
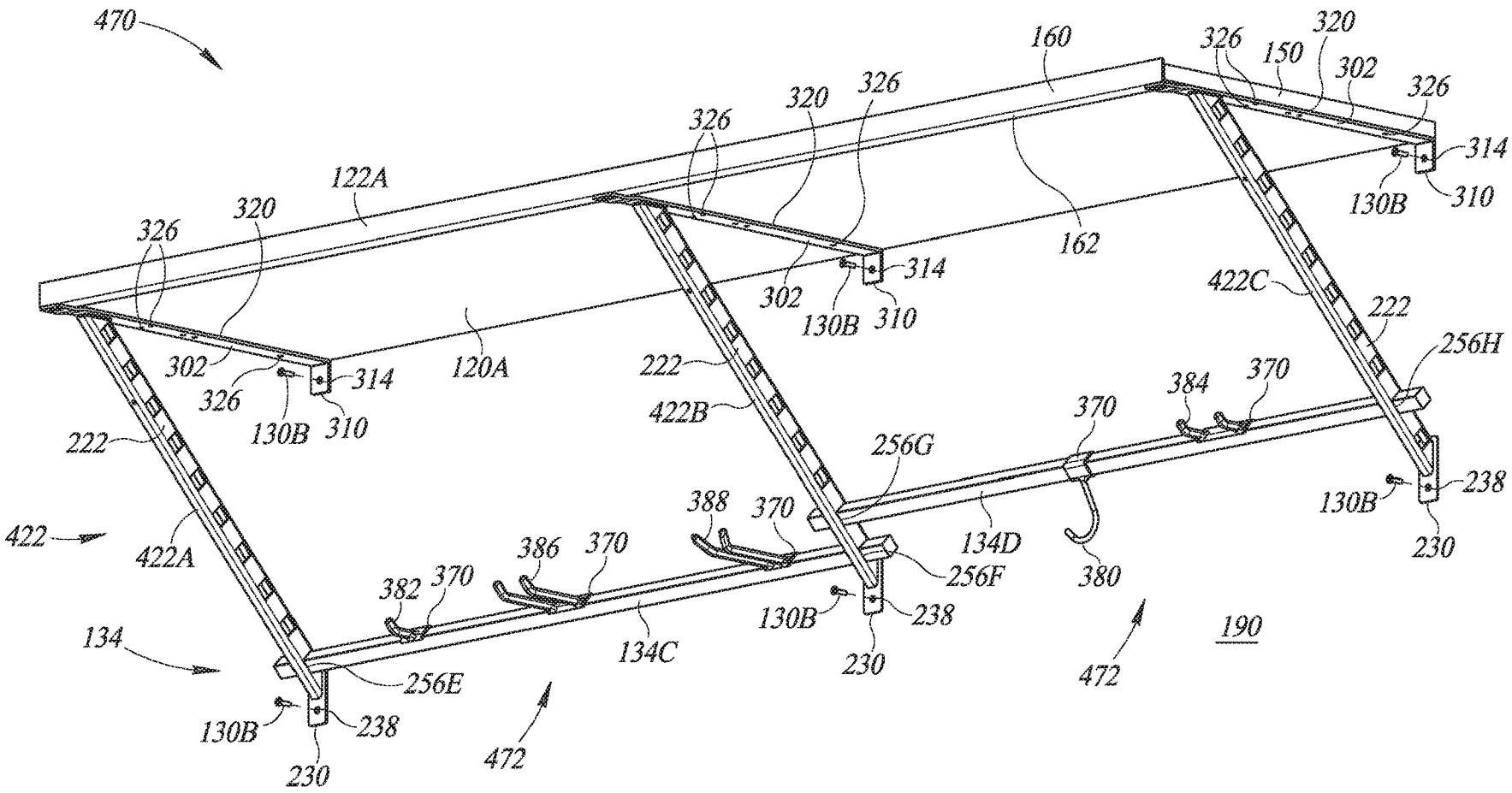
FIG. 14 is a perspective view of an underside of a first embodiment of a large shelf constructed using the components of FIG. 1.

Referring to FIG. 14, the connector 370 is configured to be removable attached to one of the crossbar(s) 134. Returning to FIG. 8, the connector 370 is configured to wrap partway around the one of the crossbar(s) 134 (see FIGS. 1, 7, 14-18, 20, and 21) and to grip a pair of opposite corners. For example, the connector 370 of one of the bicycle hook(s) 380 is oriented to grip onto the (vertically oriented) corners "C1" and "C3" (see FIG. 7). By way of another non-limiting example, the connectors 370 of the small single hook(s) 382, the small double hook(s) 384, the large double hook(s) 386, and the ski hook(s) 388 are each oriented to grip onto the (horizontally oriented) corners "C2" and "C4" (see FIG. 7).

Figure 20:
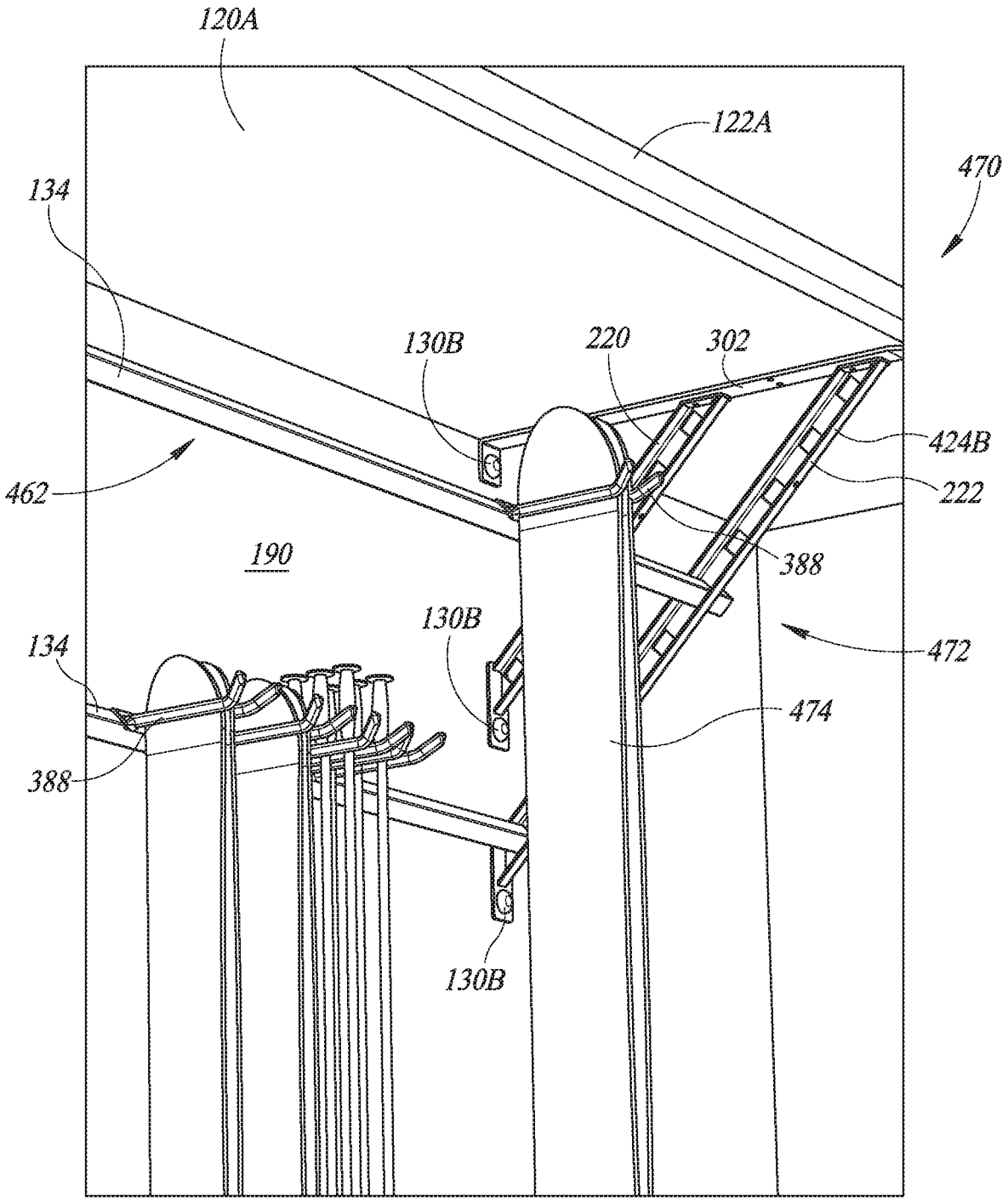
FIG. 20 is an enlarged perspective view of the second embodiment of the large shelf of FIG. 15 with a pair of skis hanging from a hook positioned on a long angled rack.

Referring to FIGS. 20 and 21, the optional hook(s) 136 (see FIGS. 1 and 8) are configured to allow long items (e.g., a pair of skis 474) to be hung on the long angled rack 472 or the short angled rack 462 near the wall 190 to avoid encroaching into walking paths (e.g., in the garage).

Brace Assemblies

As mentioned above, referring to FIG. 17, the components 100 (see FIG. 1) may be assembled into one or more the brace subassemblies 166, which may include the inverted brace assembly 400 (see FIGS. 9 and 10), the short angled brace assembly 420 (see FIGS. 11, 12, and 17), the long angled brace assembly 422 (see FIGS. 14 and 15), the rack combination brace assembly 424 (see FIG. 15), the extended short brace assembly 440 (see FIGS. 13, 16, and 19), and/or the extended long brace assembly 442 (see FIG. 22).

Referring to FIG. 10, one of the inverted shelf supports 170 and one of the long shelf bases 302 may be assembled together to form the inverted brace assembly 400. As mentioned above, the inverted brace assembly 400 may be used to support a portion of the shelf subassembly 154 (see FIG. 17). The inverted brace assembly 400 may be assembled by positioning the free end portion 316 of the long shelf base 302 on the second leg 202 of the inverted shelf bracket 182 of the inverted shelf support 170 with the through-hole(s) 204 aligned with the through-hole(s) 322.

Referring to FIG. 12, one of the short shelf support(s) 220 and one of the short shelf base(s) 300 may be assembled together to form the short angled brace assembly 420. As illustrated in FIG. 12, the short angled brace assembly 420 may be assembled by positioning the short shelf base 300 on top of the shelf bracket 232 of the short shelf support 220 with the distal through-hole(s) 324A aligned with the through-hole(s) 248 (see FIGS. 12 and 13). Then, the short shelf base 300 and the short shelf support 220 may be coupled together by inserting one of the fasteners 130A into each aligned pair of the through-holes 324A and 248. Optionally, the fastener 130A installed in each pair of aligned through-holes 324A and 248 may extend through the washer 369 and thread into the nut 368.

Referring to FIG. 14, one of the long shelf support(s) 222 and one of the long shelf base(s) 302 may be assembled together to form the long angled brace assembly 422. The long angled brace assembly 422 may be assembled by positioning the long shelf base 302 on top of the shelf bracket 232 (see FIGS. 4, 12 and 13) of the long shelf support 222 with the distal through-hole(s) 324A (see FIGS. 4, 10, 12, and 13) aligned with the through-hole(s) 248 (see FIGS. 12 and 13). Then, referring to FIG. 12, the long shelf base 302 (see FIGS. 6, 9, 10, 13-16, and 18-21) and the long shelf support 222 (see FIGS. 4, 14, 15, and 17-21) may be coupled together by inserting one of the fasteners 130A into each aligned pair of the through-holes 324A and 248. Optionally, the fastener 130A installed in each pair of aligned through-holes 324A and 248 may extend through the washer 369 and thread into the nut 368.

Figure 15:
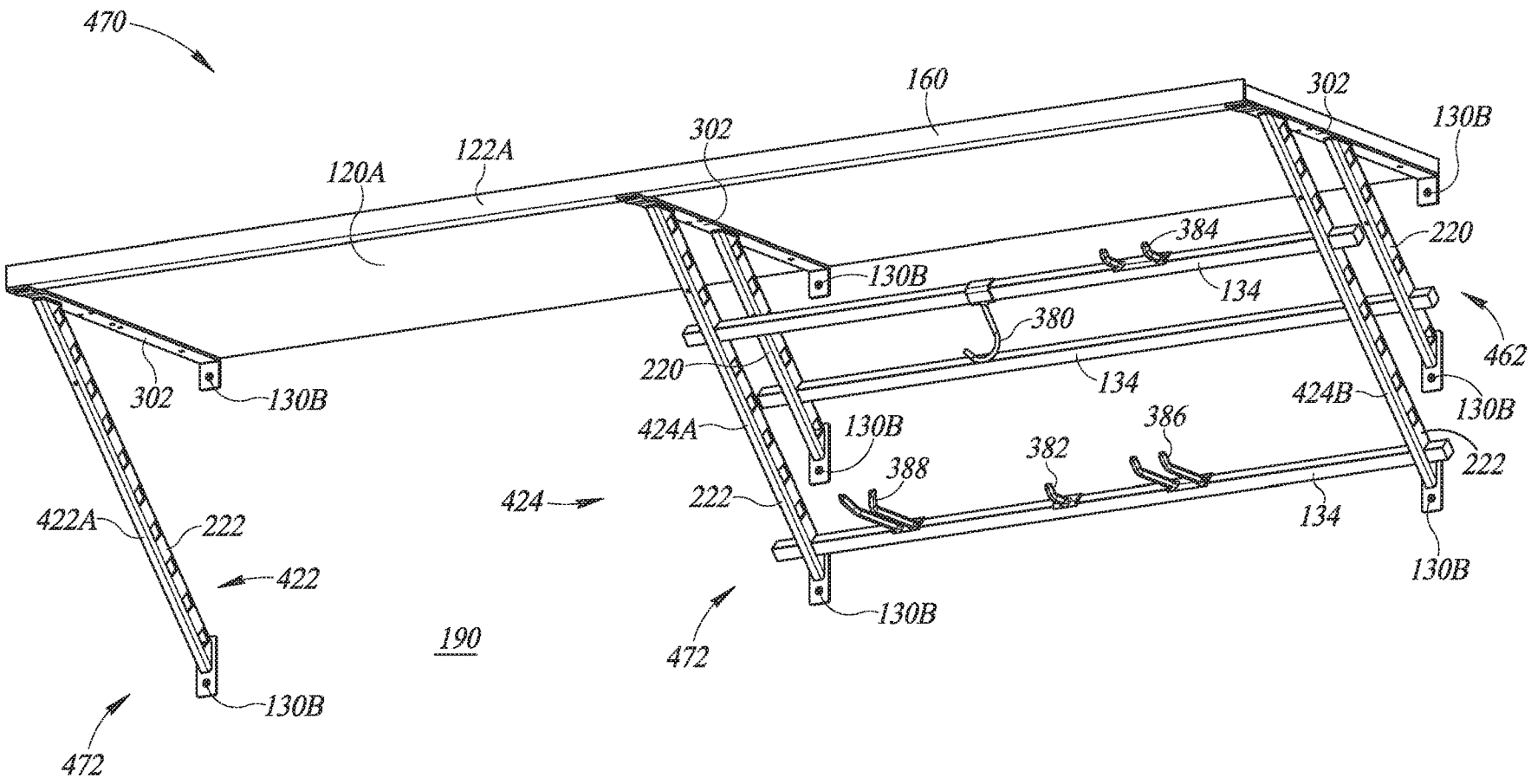
FIG. 15 is a perspective view of an underside of a second embodiment of the large shelf constructed using the components of FIG. 1.

Optionally, referring to FIG. 15, one of the short shelf support(s) 220 may be attached to the long angled brace assembly 422 (see FIGS. 14 and 15) to define the rack combination brace assembly 424. The short shelf support 220 is attached to the long angled brace assembly 422 by aligning the through-hole(s) 248 (see FIGS. 12 and 13) of the short shelf support 220 with the proximal though-hole(s) 324B (see FIGS. 6 and 13) of the long shelf base 302 of the long angled brace assembly 422. Then, the long shelf base 302 and the short shelf support 220 may be coupled together by inserting one of the fasteners 130A (see FIGS. 1, 9, 10, 12, 13, 18, 22, 23, 30-32, and 34) into each aligned pair of the through-holes 324B and 248 (see FIG. 13).

Referring to FIG. 13, one of the angle support(s) 174, one of the short shelf support(s) 220, and one of the long shelf base(s) 302 may be assembled together to form the extended short brace assembly 440. As illustrated in FIG. 13, the extended short brace assembly 440 may be assembled by positioning the long shelf base 302 on top of the shelf bracket 232 of the short shelf support 220 with the proximal through-hole(s) 324B aligned with the through-hole(s) 248. Then, the long shelf base 302 and the short shelf support 220 may be coupled together by inserting one of the fasteners 130A into each aligned pair of the through-holes 324B and 248. Optionally, the fastener 130A installed in each pair of aligned through-holes 324B and 248 may extend through the washer 369 and thread into the nut 368. Next, the angle support 174 is coupled to both the long shelf base 302 and the short shelf support 220. One of the through-hole(s) 282 of the angle support 174 is aligned with one of the distal through-hole(s) 324A of the long shelf base 302 and one of the fasteners 130A is inserted through the aligned through-holes 282 and 324A to couple the angle support 174 to the long shelf base 302. Optionally, the fastener 130A installed in the pair of aligned through-holes 282 and 324A may extend through the washer 369 and thread into the nut 368. Also, the through-hole(s) 279 of the angle support 174 is/are aligned with the through-hole(s) 255 of the short shelf support 220 and one of the fasteners 130A is inserted through each aligned pair of the through-holes 279 and 255 to couple the angle support 174 to the short shelf support 220. Optionally, the fastener 130A installed in the each pair of aligned through-holes 279 and 255 may extend through the washer 369 and thread into the nut 368.

Referring to FIG. 22, one of the angle support(s) 174, one of the long shelf support(s) 222, and one of the long shelf base(s) 302 may be assembled together to form the extended long brace assembly 442. Referring to FIG. 6, the free first end portion 352 of the shelf base extension 304 is positioned above the free end portion 316 of the long shelf base 302 with the through-hole(s) 364 aligned with the through-hole(s) 322. Then, the shelf base extension 304 and the long shelf base 302 may be coupled together by inserting one of the fasteners 130A into each aligned pair of the through-holes 364 and 322. Optionally, the fastener 130A installed in each pair of aligned through-holes 364 and 322 may extend through the washer 369 (see FIGS. 10, 12, and 13) and thread into the nut 368 (see FIGS. 10, 12, and 13).

Then, referring to FIG. 22, the long shelf base 302 is positioned on top of the shelf bracket 232 (see FIGS. 4, 12 and 13) of the long shelf support 222 with the distal through-hole(s) 324A (see FIGS. 4, 10, 12, and 13) aligned with the through-hole(s) 248 (see FIGS. 12 and 13). Next, the long shelf base 302 and the long shelf support 222 may be coupled together by inserting one of the fasteners 130A into each aligned pair of the through-holes 324A and 248. Optionally, the fastener 130A installed in each pair of aligned through-holes 324A and 248 may extend through the washer 369 (see FIGS. 10, 12, and 13) and thread into the nut 368 (see FIGS. 10, 12, and 13).

Next, the angle support 174 is coupled to both the long shelf base 302 and the long shelf support 222. One of the through-hole(s) 282 (see FIGS. 5 and 13) of the angle support 174 is aligned with one of the through-hole(s) 366 (see FIG. 6) of the shelf base extension 304 and one of the fasteners 130A is inserted through the aligned through-holes 282 and 366 to couple the angle support 174 to the long shelf base 302. Optionally, the fastener 130A installed in the pair of aligned through-holes 282 and 366 may extend through the washer 369 (see FIGS. 10, 12, and 13) and thread into the nut 368 (see FIGS. 10, 12, and 13). Also, the through-hole(s) 279 (see FIGS. 5 and 13) of the angle support 174 is/are aligned with the through-hole(s) 255 (see FIGS. 13 and 18) of the long shelf support 222 and one of the fasteners 130A is inserted through each aligned pair of the through-holes 279 and 255 to couple the angle support 174 to the long shelf support 222. Optionally, the fastener 130A installed in the each pair of aligned through-holes 279 and 255 may extend through the washer 369 (see FIGS. 10, 12, and 13) and thread into the nut 368 (see FIGS. 10, 12, and 13).

Example Shelf and/or Rack Configurations

Referring to FIG. 1, as mentioned above, the components 100 are configured to be assembled in numerous ways to create a number of different shelf and/or rack configurations. For example, referring to FIG. 11, a small shelf 460 may be constructed from the shallow shelf member 120B, the shelf channel 122A, the fasteners 130 (see FIG. 1), and at least two of the short angled brace assemblies 420. By way of another non-limiting example, referring to FIG. 22, an extended large shelf 492 may be constructed from the extra deep shelf member 1200, the shelf channel 122A, the fasteners 130 (see FIG. 1), and at least two of the extended long brace assemblies 442 (see FIG. 22).

Figure 19:
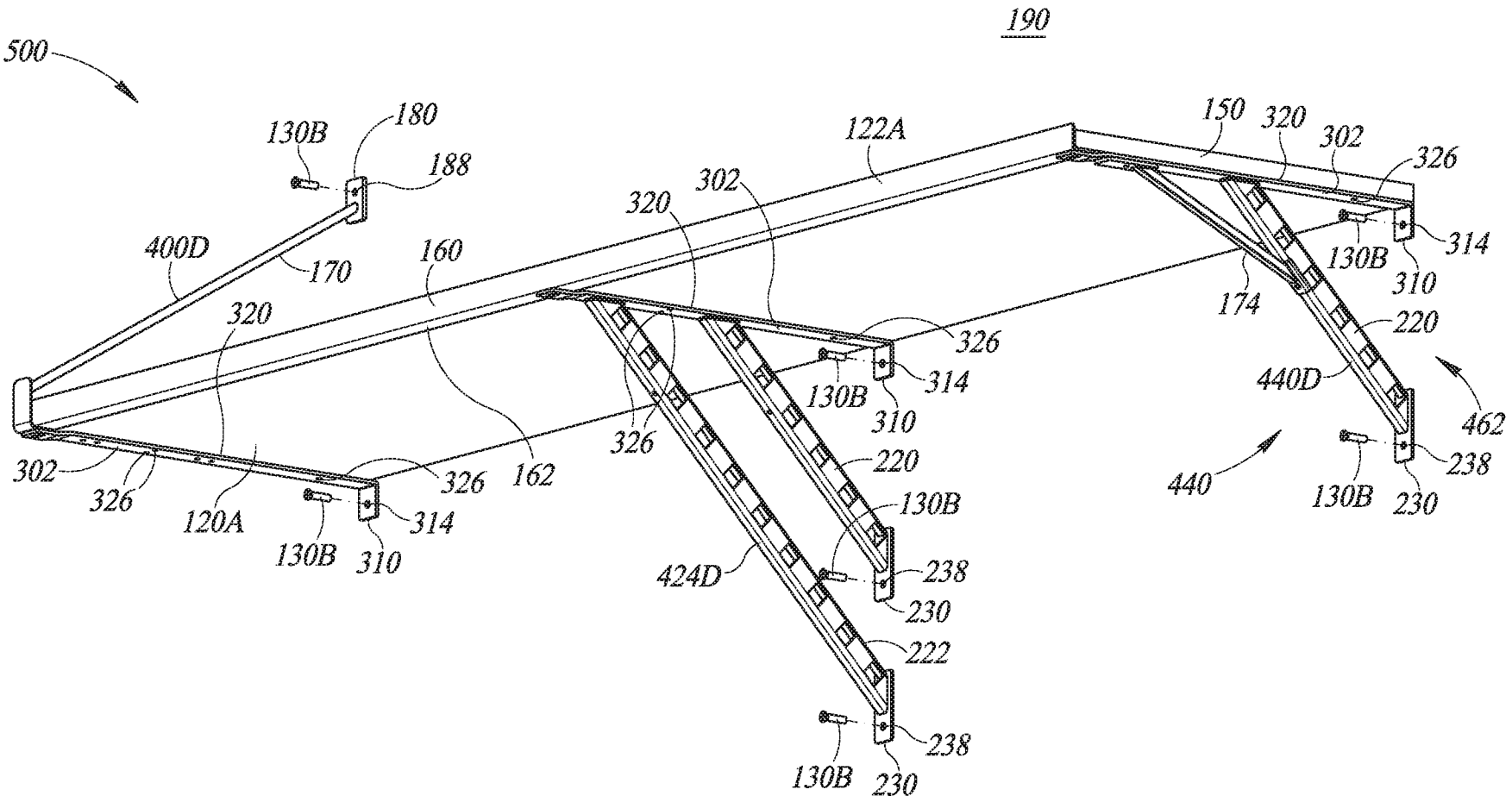
FIG. 19 is a perspective view of an underside of a multi-configuration shelf constructed using the components of FIG. 1.

By way of another non-limiting example, referring to FIG. 14, a large shelf 470 may be constructed from the deep shelf member 120A, the shelf channel 122A, the fasteners 130 (see FIG. 1), and at least two of the following brace subassemblies 166 (see FIG. 17):

1. the inverted brace assembly 400 (see FIGS. 9 and 10);
2. the long angled brace assembly 422 (see FIGS. 14 and 15);
3. the rack combination brace assembly 424 (see FIGS. 15); and
4. the extended short brace assembly 440 (see FIGS. 13, 16, and 19).

In other words, types of large shelves may be constructed using two or more of the above brace assemblies. Thus, these brace assemblies may be characterized as being interchangeable.

By way of yet another non-limiting example, referring to FIG. 17, a combination shelf 490 may be constructed from the deep and shallow shelf members 120A and 120B, the shelf channels 122A and 122B, the fasteners 130 (see FIG. 1), at least one of the short angled brace assemblies 420, and two or more of the following brace subassemblies 166:

1. the inverted brace assembly 400 (see FIGS. 9 and 10);
2. the long angled brace assembly 422 (see FIGS. 14 and 15);
3. the rack combination brace assembly 424 (see FIGS. 15); and
4. the extended short brace assembly 440 (see FIGS. 13, 16, and 19).

By way of yet another non-limiting example, referring to FIG. 17, a different combination shelf (not shown) may be constructed from the shallow and extra deep shelf members 120B and 120C (see FIG. 22), the shelf channels 122A and 122B, the fasteners 130 (see FIG. 1), at least one of the short angled brace assemblies 420, and two or more of the extended long brace assemblies 442 (see FIG. 22). Similarly, yet another combination shelf (not shown) may be constructed from the deep and extra deep shelf members 120A and 120C (see FIG. 22), the shelf channels 122A and 122B, the fasteners 130 (see FIG. 1), two or more of the extended long brace assemblies 442 (see FIG. 22), and at least one of the following brace subassemblies 166:

1. the inverted brace assembly 400 (see FIGS. 9 and 10);
2. the long angled brace assembly 422 (see FIGS. 14 and 15);
3. the rack combination brace assembly 424 (see FIGS. 15); and
4. the extended short brace assembly 440 (see FIGS. 13, 16, and 19).

Thus, the system 110 (see FIG. 1) may be characterized as being versatile and providing shelving options. For example, referring to FIG. 17, any of the combination shelves mentioned above (e.g., the combination shelf 490) may be configured to include transitions or changes in size and/or shape configured to accommodate available space on the wall 190. Further, referring to FIG. 1, the components 100 may be assembled in a manner that avoids obstacles. To make the most of the available space (e.g., in a garage), the components 100 may be assembled into numerous shelf and/or rack configurations. The components 100 can be assembled on site into multiple different shelf and/or rack configurations that are not achievable with prior art triangularly shaped shelf braces. The following are non-limiting examples of shelves that may be constructed using the components 100.

Inverted Shelf

FIG. 9 illustrates an inverted shelf 450 mounted on the wall 190 (e.g., of a garage). The inverted shelf 450 may be characterized as being a type of large shelf because the inverted shelf 450 includes the deep shelf member 120A. Additionally, the inverted shelf 450 includes the shelf channel 122A, the fasteners 130 (see FIG. 1), and two or more inverted brace assemblies 400. In the embodiment illustrated, the inverted shelf 450 includes the inverted brace assemblies 400A-400C.

The inverted brace assembly 400C is positioned near the right side edge 150 of the deep shelf member 120A and the inverted brace assembly 400A is positioned near the left side edge 152 (see FIG. 2) of the deep shelf member 120A. The inverted brace assembly 400B may be positioned midway in between the inverted brace assemblies 400A and 400C.

In the embodiment illustrated, the inverted brace assemblies 400A-400C each includes the inverted shelf support 170 and the long shelf base 302.

The inverted shelf 450 may be assembled by connecting the inverted brace assemblies 400A-400C to the shelf channel 122A. Referring to FIG. 10, for each of the inverted brace assemblies 400A-400C (see FIG. 9), the long shelf base 302 is positioned on the second leg 202 of the inverted shelf bracket 182 of the inverted shelf support 170 with the through-hole(s) 322 aligned with the through-hole(s) 204. Then, for each of the inverted brace assemblies 400A-400C (see FIG. 9), the shelf channel 122A is positioned above the long shelf base 302 with at least one of the through-hole(s) 164 aligned with the through-hole(s) 322. Next, one of the fasteners 130A is installed in each aligned trio of the through-holes 164, 322, and 204. In the embodiment illustrated, the fastener 130A installed in the trio of aligned through-holes 164, 322, and 204 may extend through the washer 369 and thread into the nut 368. Next, returning to FIG. 9, the wall mount brackets 180 of the inverted shelf supports 170 are affixed to the wall 190 by inserting the fasteners 130B through the through-holes 188. The first legs 310 of the long shelf bases 302 are affixed to the wall 190 by inserting the fasteners 130B through the through-holes 314. Finally, the deep shelf member 120A is positioned on top of the support portions 320 of the long shelf bases 302 with its front edge 144 (see FIG. 1) being positioned on top of the horizontal leg 162 of the shelf channel 122A alongside or abutting the vertical leg 160 of the shelf channel 122A. Optionally, the fasteners 130 (see FIG. 1) may be inserted into the through-holes 326 of the long shelf bases 302 and used to affix the long shelf bases 302 to the deep shelf member 120A.

As shown in FIG. 9, each of the inverted shelf brackets 182 may be characterized as being wrapped around the shelf channel 122A and the free end portion 316 of one of the long shelf bases 302. The unique wrap around design allows the deep shelf member 120A to be placed on the long shelf bases 302 without the need to notch the deep shelf member 120A to accommodate support braces. By way of a non-limiting example, the inverted shelf 450 may be installed above a fixed obstruction, such as a door, window, or cabinet.

Optionally, if desired, one of the angled shelf supports 172 (see FIG. 4) may be installed (e.g., on wall studs) under the deep shelf member 120A and in between the inverted brace assemblies 400A-400C. For example, one or more of the following brace assemblies may be installed in between adjacent ones of the inverted brace assemblies 400A-400C:

1. the long angled brace assembly 422 (see FIGS. 14 and 15),
2. the rack combination brace assembly 424 (see FIG. 15), and
3. the extended short brace assembly 440 (see FIGS. 13, 16, and 19).

Optionally, the inverted brace assemblies 400A-400C may be made long enough to support the extra deep shelf member 120C (see FIG. 22). In such embodiments, one or more of the extended long brace assemblies 442 (see FIG. 22) may be installed (e.g., on wall studs) under the extra deep shelf member 120C (see FIG. 22) and in between the inverted brace assemblies 400A-400C.

Referring to FIG. 14, if two or more long angled brace assemblies 422 (and/or the extended long brace assemblies 442 illustrated in FIG. 22) are installed in between adjacent ones of the inverted brace assemblies 400A-400C (see FIG. 9), a pair of the long shelf supports 222 supporting the crossbar(s) 134 may define the long angled rack 472. Referring to FIG. 15, if two or more rack combination brace assemblies 424 are installed in between adjacent ones of the inverted brace assemblies 400A-4000 (see FIG. 9), a pair of the short shelf supports 220 supporting the crossbar(s) 134 may define the short angled rack 462 and a pair of the long shelf supports 222 supporting the crossbar(s) 134 may define the long angled rack 472. Referring to FIG. 16, if two or more extended short brace assemblies 440 are installed in between adjacent ones of the inverted brace assemblies 400A-400C (see FIG. 9), a pair of the short shelf supports 220 supporting the crossbar(s) 134 may define the short angled rack 462. Optionally, the angle supports 174 (see FIGS. 4, 5, 13, 16 and 19) may be omitted from the extended short brace assemblies 440.

Small Shelf

FIG. 11 illustrates the small shelf 460 mounted on the wall 190 (e.g., of a garage). The small shelf 460 may be used in rooms (e.g., of garages) having low ceilings and in areas not large enough for the large shelf 470 (see FIGS. 14 and 15). The small shelf 460 includes the shallow shelf member 120B, the shelf channel 122A, the fasteners 130 (see FIG. 1), and two or more short angled brace assemblies 420. In the embodiment illustrated, the small shelf 460 includes the short angled brace assemblies 420A-420C.

The short angled brace assembly 420C is positioned near the right side edge 150 of the shallow shelf member 1268 and the short angled brace assembly 420A is positioned near the left side edge 152 (see FIG. 2) of the shallow shelf member 120B. The short angled brace assembly 420B may be positioned midway in between the short angled brace assemblies 420A and 420C.

In the embodiment illustrated, each of the short angled brace assemblies 420A-420C includes one of the short shelf support(s) 220 and one of the short shelf base(s) 300. The small shelf 460 may be assembled by connecting the three short angled brace assemblies 420A-420C to the shelf channel 122A. Referring to FIG. 12, for each of the short angled brace assemblies 420A-420C (see FIG. 11), the shelf channel 122A is positioned on the free end portion 316 of the short shelf base 300 with the through-hole(s) 164 aligned with the through-hole(s) 322. Next, one of the fasteners 130A is installed in each aligned pair of the through-holes 164 and 322. The fastener 130A installed in each pair of aligned through-holes 164 and 322 may extend through the washer 369 and thread into the nut 368.

Then, returning to FIG. 11, the wall mount brackets 230 of the short shelf supports 220 of the short angled brace assemblies 420A-420C are affixed to the wall 190 by inserting the fasteners 130E through the through-holes 238. The first legs 310 of the short shelf bases 300 of the short angled brace assemblies 420A-420C are affixed to the wall 190 by inserting the fasteners 130B through the through-holes 314. Finally, the shallow shelf member 120B is positioned on top of the support portions 320 of the short shelf bases 300 with its front edge 144 (see FIG. 2) being positioned on top of the horizontal leg 162 of the shelf channel 122A alongside or abutting the vertical leg 160 of the shelf channel 122A. Optionally, the fasteners 130 (see FIG. 1) may be inserted into the through-holes 326 and used to affix the short shelf bases 300 to the shallow shelf member 120B.

The small shelf 460 illustrated in FIG. 11 includes two of the short angled racks 462. A first of the short angled rack 462 is defined by the short shelf supports 220 of the short angled brace assemblies 420A and 420B and one or more of the crossbar(s) 134 (see FIGS. 1, 7, 14-18, 20, and 21). A second of the short angled rack 462 is defined by the short shelf supports 220 of the short angled brace assemblies 420B and 420S and one or more of the crossbar(s) 134 (see FIGS. 1, 7, 14-18, 20, and 21). Each of crossbar(s) 134 is installed in one of the through-hole(s) 256 of a first one of the short shelf supports 220 and one of the through-hole(s) 256 of a different second one of the short shelf supports 220. For example, the short angled brace assemblies 420A and 420B include the through-holes 256A and 256B, respectively, and the short angled brace assemblies 420B and 420C include the through-holes 256C and 256D, respectively. The crossbar 134A is positioned in through-holes 256A and 256B and extends in between the short shelf supports 220 of the short angled brace assemblies 420A and 420B. The thought-holes 256A and 256B may be aligned with one another such that the crossbar 134A is substantially level. In the embodiment illustrated, one of the large double hook(s) 386, one of the small single hook(s) 382, and one of the ski hook(s) 388 have been mounted on the crossbar 134A. The crossbar 134B is positioned in through-holes 256C and 256D and extends in between the short shelf supports 220 of the short angled brace assemblies 420B and 420C. The thought-holes 256C and 256D may be aligned with one another such that the crossbar 134B is substantially level. In the embodiment illustrated, one of the bicycle hook(s) 380, and one of the small double hook(s) 384 have been mounted on the crossbar 134B.

While the short angled racks 462 have been illustrated as including only the crossbars 134A and 134B, the short angled racks 462 may include up to the first number (e.g., six) of different crossbars. Additionally, any number of the hook(s) 136 may be hung from the short angled racks 462.

Large Shelves

FIG. 14 illustrates the large shelf 470 mounted on the wall 190 (e.g., of a garage). The large shelf 470 may be configured to have a large capacity and to provide rack versatility. The large shelf 470 includes the deep shelf member 120A, the shelf channel 122A, the fasteners 130 (see FIG. 1), and one or more of the long angled brace assemblies 422. In the embodiment illustrated, the large shelf 470 includes the long angled brace assemblies 422A-422C.

The long angled brace assembly 422C is positioned near the right side edge 150 of the deep shelf member 120A and the long angled brace assembly 422A is positioned near the left side edge 152 (see FIG. 2) of the deep shelf member 120A. The long angled brace assembly 422B may be positioned midway in between the long angled brace assemblies 422A and 422C. In the embodiment illustrated, each of the long angled brace assemblies 422A-422C includes the long shelf support 222 and the long shelf base 302.

The large shelf 470 may be assembled by connecting the three long angled brace assemblies 422A-422C to the shelf channel 122A. Referring to FIG. 13, for each of the long angled brace assemblies 422A-422C, the shelf channel 122A is positioned on the free end portions 316 of the long shelf base 302 with at least one of the through-hole(s) 164 aligned with the through-hole(s) 322. Next, one of the fasteners 130A is installed in each aligned pair of the through-holes 164 and 322. The fastener 130A installed in each pair of aligned through-holes 164 and 322 may extend through the washer 369 and thread into the nut 368. Then, returning to FIG. 14, the wall mount brackets 230 of the long shelf supports 222 of the long angled brace assemblies 422A-422C are affixed to the wall 190 by inserting the fasteners 130B through the through-holes 238. The first legs 310 of the long shelf bases 302 of the long angled brace assemblies 422A-422C are affixed to the wall 190 by inserting the fasteners 130B through the through-holes 314. Finally, the deep shelf member 120A is positioned on top of the support portions 320 of the long shelf bases 302 with its front edge 144 (see FIG. 2) being positioned on top of the horizontal leg 162 of the shelf channel 122A alongside or abutting the vertical leg 160 of the shelf channel 122A. Optionally, the fasteners 130 (see FIG. 1) may be inserted into the through-holes 326 and used to affix the long shelf bases 302 to the deep shelf member 120A.

The large shelf 470 illustrated in FIG. 14 includes two of the long angled racks 472. A first of the long angled racks 472 is defined by the long shelf supports 222 of the long angled brace assemblies 422A and 422B and one or more of the crossbar(s) 134 (see FIGS. 1, 7, 14-18, 20, and 21). A second of the long angled racks 472 is defined by the long shelf supports 222 of the long angled brace assemblies 422B and 422C and one or more of the crossbar(s) 134 (see FIGS. 1, 7, 14-18, 20, and 21). Each of crossbar(s) 134 is installed in one of the through-hole(s) 256 of a first one of the long shelf supports 222 and one of the through-hole(s) 256 of a different second one of the long shelf supports 222. For example, the long angled brace assemblies 422A and 422B include the through-holes 256E and 256F, respectively, and the long angled brace assemblies 422B and 422C include the through-holes 256G and 256H, respectively. The crossbar 134C is positioned in through-holes 256E and 256F and extends in between the long shelf supports 222 of the long angled brace assemblies 422A and 422B. The thought-holes 256E and 256F may be aligned with one another such that the crossbar 134C is substantially level. In the embodiment illustrated, one of the large double hook(s) 386, one of the small single hook(s) 382, and one of the ski hook(s) 388 have been mounted on the crossbar 134S. The crossbar 134D is positioned in through-holes 256G and 256H and extends in between the long shelf supports 222 of the long angled brace assemblies 422B and 422C. The thought-holes 256G and 256H may be aligned with one another such that the crossbar 134D is substantially level. In the embodiment illustrated, one of the bicycle hook(s) 380, and one of the small double hook(s) 384 have been mounted on the crossbar 134D.

While the long angled racks 472 have been illustrated as including only the crossbars 1340 and 134D, the long angled racks 472 illustrated may include up to the second number (e.g., ten) of different crossbars. Additionally, any number of the hook(s) 136 may be hung from the long angled racks 472.

FIG. 15 illustrates an embodiment of the large shelf 470 in which two or more of the long angled brace assemblies 422 (e.g., the long angled brace assemblies 422B and 422C illustrated in FIG. 14) have been replaced with the rack combination brace assemblies 424. In the embodiment illustrated, the long angled brace assemblies 422B and 422C (see FIG. 14) have been replaced with the rack combination brace assemblies 424A and 424B, respectively. Thus, the large shelf 470 illustrated in FIG. 15 includes the long angled rack 472 defined by the long shelf supports 222 of the long angled brace assembly 422A and the rack combination brace assemblies 424A and 424B as well as the short angled rack 462 defined by the short shelf supports 220 positioned behind the long angled rack 472. One or more of the crossbar(s) 134 is installed in and extends in between the short shelf supports 220. Thus, the short angled rack 462 of the large shelf 470 illustrated in FIG. 15 may be substantially identical to one of the short angled racks 462 of the small shelf 460 (see FIG. 11). Additionally, one or more of the crossbar(s) 134 is installed in and extends in between the long shelf supports 222 of the long angled brace assemblies 422B and 422C. Optionally, one or more of the hook(s) 136 may be attached to the crossbar(s) 134. Thus, when two or more of the rack combination brace assemblies 424 are used, the resulting shelf may include both the short and long angled racks 462 and 472, which may provide additional hanging options.

As shown in FIGS. 20 and 21, the short shelf supports 220 combined with the long shelf supports 222 enable items to be stored closer to the wall 190 and provide additional hanging options. This is particularly useful for storing longer items, such as skis, yard tools, home use tools, etc. For example, FIG. 21 illustrates how the skis 474 may be hung closer to the wall 190 if the skis 474 are hung from the short angled rack 462 instead of the long angled rack 472 (as illustrated in FIG. 20).

Extended Small Shelf

FIG. 16 illustrates an extended small shelf 480 mounted on the wall 190 (e.g., of a garage). The extended small shelf 480 may be characterized as being a type of large shelf because the extended small shelf 480 includes the deep shelf member 120A. The extended small shelf 480 also includes the shelf channel 122A, the fasteners 130 (see FIG. 1), and one or more of the extended short brace assemblies 440. In the embodiment illustrated, the extended small shelf 480 includes the extended short brace assemblies 440A-440C.

The extended short brace assembly 440C is positioned near the right side edge 150 of the deep shelf member 120A and the extended short brace assembly 440A is positioned near the left side edge 152 (see FIG. 2) of the deep shelf member 120A. The extended short brace assembly 440B may be positioned midway in between the extended short brace assemblies 440A and 440C. In the embodiment illustrated, each of the extended short brace assemblies 440A-440C includes the short shelf support 220, the long shelf base 302, and the angle support 174.

The extended small shelf 480 may be assembled by connecting the three extended short brace assemblies 440A-440C to the shelf channel 122A. As illustrated in FIG. 13, for each of the extended short brace assemblies 440A-440C (see FIG. 16), the shelf channel 122A is positioned on the free end portions 316 of the long shelf base 302 with at least one of the through-hole(s) 164 aligned with the through-hole(s) 322. Next, one of the fasteners 130A is installed in each aligned pair of the through-holes 164 and 322. The fastener 130A installed in each pair of aligned through-holes 164 and 322 may extend through the washer 369 and thread into the nut 368. Then, referring to FIG. 16 the wall mount brackets 230 of the long shelf supports 222 of the extended short brace assemblies 440A-440C are affixed to the wall 190 by inserting the fasteners 130B through the through-holes 238 and into the wall 190. The first legs 310 of the long shelf bases 302 of the extended short brace assemblies 440A-440C are affixed to the wall 190 by inserting the fasteners 130B through the through-holes 314 and into the wall 190. Finally, the deep shelf member 120A is positioned on top of the support portions 320 of the long shelf bases 302 with its front edge 144 (see FIG. 2) being positioned on top of the horizontal leg 162 of the shelf channel 122A alongside or abutting the vertical leg 160 of the shelf channel 122A. Optionally, the fasteners 130 (see FIG. 1) may be inserted into the through-holes 326 (see FIGS. 6, 9, 14, and 19) and used to affix the long shelf bases 302 to the deep shelf member 120A.

The extended small shelf 480 provides more shelf capacity by allowing the deep shelf member 120A (e.g., having the depth of about 24 inches), instead of the shallow shelf member 120B (e.g., having the depth of about 16 inches), to be used with the short shelf supports 220. Referring to FIG. 15, this allows the extended small shelf 480 (see FIG. 16) to have the same shelf size as the large shelf 470 without having to use the long angled brace assemblies 422 (or the rack combination brace assemblies 424), which can be intrusive in a smaller space (e.g., a small garage).

The extended small shelf 480 illustrated in FIG. 16 includes two of the short angled racks 462. A first of the short angled racks 462 is defined by the short shelf supports 220 of the extended short brace assemblies 440A and 440B and one or more of the crossbar(s) 134. A second of the short angled racks 462 is defined by the short shelf supports 220 of the extended short brace assemblies 440B and 440C and one or more of the crossbar(s) 134. Optionally, one or more of the hook(s) 136 may be attached to the crossbar(s) 134. The short angled racks 462 of the extended small shelf 480 may be substantially identical to the short angled racks 462 of the small shelf 460 (see FIG. 11).

Extended Large Shelf

FIG. 22 illustrates the extended large shelf 492 mounted on the wall 190 (e.g., of a garage). The extended large shelf 492 includes the extra deep shelf member 120C, the shelf channel 122A, the fasteners 130 (see FIG. 1), and one or more of the extended long brace assemblies 442. In the embodiment illustrated, the extended large shelf 492 includes the extended long brace assemblies 442A-442C.

The extended long brace assembly 442C is positioned near the right side edge 150 of the extra deep shelf member 120C and the extended long brace assembly 442A is positioned near the left side edge 152 (see FIG. 2) of the extra deep shelf member 120C. The extended long brace assembly 442B may be positioned midway in between the extended long brace assemblies 442A and 442C. In the embodiment illustrated, each of the extended long brace assemblies 442A-442C includes the long shelf support 222, the long shelf base 302, the shelf base extension 304, and the angle support 174.

The extended large shelf 492 may be assembled by connecting the three extended long brace assemblies 442A-442C to the shelf channel 122A. For each of the extended long brace assemblies 442A-442C, the shelf channel 122A is positioned on the free end portions 316 of the long shelf base 302 with at least one of the through-hole(s) 164 (see FIGS. 3, 10, 12, and 13) aligned with the through-hole(s) 322 (see FIGS. 6, 10, 12, and 13). Next, one of the fasteners 130A is installed in each aligned pair of the through-holes 164 and 322. The fastener 130A installed in each pair of aligned through-holes 164 and 322 may extend through the washer 369 (see FIGS. 10, 12, and 13) and thread into the nut 368 (see FIGS. 10, 12, and 13).

Then, the wall mount brackets 230 of the long shelf supports 222 of the extended short brace assemblies 440A-4400 are affixed to the wall 190 by inserting the fasteners 130B through the through-holes 238 and into the wall 190. The first legs 310 of the long shelf bases 302 of the extended short brace assemblies 440A-4400 are affixed to the wall 190 by inserting the fasteners 130B through the through-holes 314 and into the wall 190.

Finally, the extra deep shelf member 1200 is positioned on top of the support portions 320 of the long shelf bases 302 with its front edge 144 (see FIG. 2) being positioned on top of the horizontal leg 162 of the shelf channel 122A alongside or abutting the vertical leg 160 of the shelf channel 122A. Optionally, the fasteners 130 (see FIG. 1) may be inserted into the through-holes 326 (see FIGS. 6, 9, 14, and 19) and used to affix the long shelf bases 302 to the extra deep shelf member 120C.

The extended large shelf 492 may provide increased shelf capacity because the extra deep shelf member 120C (e.g., having the depth of about 32 inches) is deeper than both the deep shelf member 120A (e.g., having the depth of about 24 inches) and the shallow shelf member 120B (e.g., having the depth of about 16 inches).

The extended large shelf 492 may include two of the long angled racks 472 that are substantially identical to the long angled racks 472 of the large shelf 470 illustrated in FIG. 14. Referring to FIG. 22, a first of the long angled racks 472 is defined by the long shelf supports 222 of the extended long brace assemblies 442A and 442B and one or more of the crossbar(s) 134. A second of the long angled racks 472 is defined by the long shelf supports 222 of the extended long brace assemblies 442B and 4420 and one or more of the crossbar(s) 134. Optionally, one or more of the hook(s) 136 (see FIGS. 1 and 8) may be attached to the crossbar(s) 134.

Combination Shelf

FIGS. 17 and 18 illustrate the combination shelf 490 mounted on the wall 190 (e.g., of a garage). The combination shelf 490 includes the deep shelf member 120A, the shallow shelf member 120B, the shelf channels 122A and 122B, the fasteners 130 (see FIG. 1), the short angled brace assembly 420D, the long angled brace assembly 422D, and the rack combination brace assembly 424C. Optionally, the rack combination brace assembly 424C may be replaced with the long angled brace assembly 422 (see FIGS. 14 and 15), the inverted brace assembly 400 (see FIGS. 9 and 10), or the extended short brace assembly, 440 (see FIGS. 13, 16, and 19). Additionally, the long angled brace assembly 422D may be replaced with the rack combination brace assembly 424 (see FIG. 15), the inverted brace assembly 400 (see FIGS. 9 and 10), or the extended short brace assembly 440 (see FIGS. 13, 16, and 19).

As mentioned above, referring to FIG. 17, a different combination shelf (not shown) may be constructed from the shallow and extra deep shelf members 120E and 120C (see FIG. 22), the shelf channels 122A and 122B, the fasteners 130 (see FIG. 1), at least one of the short angled brace assemblies 420, and two or more of the extended long brace assemblies 442 (see FIG. 22). Similarly, yet another combination shelf (not shown) may be constructed from the deep and extra deep shelf members 120A and 120C (see FIG. 22), the shelf channels 122A and 122B, the fasteners 130 (see FIG. 1), two or more of the extended long brace assemblies 442 (see FIG. 22), and at least one of the following brace subassemblies 166;

1. the inverted brace assembly 400 (see FIGS. 9 and 10);
2. the long angled brace assembly 422 (see FIGS. 14 and 15);
3. the rack combination brace assembly 424 (see FIGS. 15); and
4. the extended short brace assembly 440 (see FIGS. 13, 16, and 19).

Referring to FIG. 17, in the embodiment illustrated, the short angled brace assembly 420D is positioned near the right side edge 150 of the shallow shelf member 120B and the long angled brace assembly 422D is positioned near the left side edge 152 of the deep shelf member 120A. The rack combination brace assembly 424C may be positioned at the junction of the deep and shallow shelf members 120A and 120B.

Referring to FIG. 18, the combination shelf 490 includes the short angled rack 462 defined by one or more of the crossbar(s) 134 and the short shelf supports 220 of the short angled brace assembly 420D and the rack combination brace assembly 424C. The short angled rack 462 of the combination shelf 490 may be substantially identical to one of the short angled racks 462 of the small shelf 460 (see FIG. 11). Optionally, one or more of the hook(s) 136 may be mounted on the crossbar(s) 134. In the embodiment illustrated, one of the bicycle hook(s) 380 and one of the small double hook(s) 384 have been mounted on the crossbar 134 extending between the short shelf supports 220.

The combination shelf 490 includes the long angled rack 472 defined by one or more of the crossbar(s) 134 and the long shelf supports 222 of the long angled brace assembly 422D and the rack combination brace assembly 424C. The long angled rack 472 of the combination shelf 490 may be substantially identical to one of the long angled racks 472 of the large shelf 470 (see FIGS. 14 and 15). Optionally, one or more of the hook(s) 136 may be attached to the crossbar(s) 134. In the embodiment illustrated, one of the large double hook(s) 386, one of the small single hook(s) 382, and one of the ski hook(s) 388 have been mounted on the crossbar 134 extending between the long shelf supports 222.

Referring to FIG. 18, in the embodiment illustrated, the long angled brace assembly 422D includes the long shelf support 222 and the long shelf base 302. In the embodiment illustrated, the rack combination brace assembly 424C includes the long shelf support 222, the short shelf support 220, and the long shelf base 302. Referring to FIG. 18, the combination shelf 490 may be assembled by connecting both the long angled brace assembly 422D and the rack combination brace assembly 424C to the shelf channel 122A and connecting both the short angled brace assembly 420D and the rack combination brace assembly 424C to the shelf channel 122B.

As illustrated in FIG. 13, the long angled brace assembly 422D (see FIGS. 17 and 18) is attached to the shelf channel 122A by positioning the shelf channel 122A on the free end portions 316 of the long shelf base 302 of the long angled brace assembly 422D (see FIGS. 17 and 18) with at least one of the through-hole(s) 164 aligned with the through-hole(s) 322. Next, one of the fasteners 130A is installed in each aligned pair of the through-holes 164 and 322. The fastener 130A installed in each pair of aligned through-holes 164 and 322 may extend through the washer 369 and thread into the nut 368. The rack combination brace assembly 424C (see FIGS. 17 and 18) is attached to the shelf channel 122A in a similar manner.

Referring to FIG. 18, the rack combination brace assembly 424C is connected to the shelf channel 122B by positioning the shelf channel 122B on the support portion 320 of the long shelf base 302 of the rack combination brace assembly 424C with at least one of the through-hole(s) 164 (see FIGS. 3, 10, 12, and 13) aligned with one of the through-holes 326A and 326B. In the embodiment illustrated, one of the through-hole(s) 164 (see FIGS. 3, 10, 12, and 13) of the shelf channel 122B is aligned with the through-hole 326B of the long shelf base 302 of the rack combination brace assembly 424C. Next, one of the fasteners 130A (see FIGS. 1, 9, 10, 12, 13, 18, 22, 23, 30-32, and 34) is installed in the aligned pair of the through-holes 164 and 326B.

Referring to FIG. 12, the short angled brace assembly 420D (see FIGS. 17 and 18) is connected to the shelf channel 122B (see FIGS. 17 and 18) by positioning the shelf channel 122B on the free end portions 316 of the short shelf base 300 of the short angled brace assembly 420D with at least one of the through-hole(s) 164 aligned with the through-hole(s) 322. Next, one of the fasteners 130A is installed in each aligned pair of the through-holes 164 and 322. The fastener 130A installed in each pair of aligned through-holes 164 and 322 may extend through the washer 369 and thread into the nut 368.

Then, referring to FIG. 18, the combination shelf 490 is mounted on the wall 190. The wall mount brackets 230 of the long shelf supports 222 of the long angled brace assembly 422D and the rack combination brace assembly 424C are affixed to the wall 190 by inserting the fasteners 130B through the through-holes 238. The wall mount bracket 230 of the short shelf supports 220 of the short angled brace assembly 420D and the rack combination brace assembly 424C are affixed to the wall 190 by inserting the fasteners 130E through the through-holes 238. The first legs 310 of the long shelf bases 302 of the long angled brace assembly 422D and the rack combination brace assembly 424C are affixed to the wall 190 by inserting the fasteners 130B through the through-holes 314 of the long shelf bases 302. Similarly, the first leg 310 of the short shelf base 300 of the short angled brace assembly 420D is affixed to the wall 190 by inserting one of the fasteners 130B through each of the through-hole(s) 314 of the short shelf base 300.

Finally, the deep shelf member 120A is positioned on top of the support portions 320 of the long shelf bases 302 with its front edge 144 (see FIG. 2) being positioned on top of the horizontal leg 162 of the shelf channel 122A alongside or abutting the vertical leg 160 of the shelf channel 122A. Optionally, the fasteners 130 (see FIG. 1) may be inserted into the through-holes 326 (see FIGS. 6, 9, 14, and 19) of the long shelf bases 302 and used to affix the long shelf bases 302 to the deep shelf member 120A. Additionally, the shallow shelf member 120B is positioned on top of the support portions 320 of the short shelf base 300 and the long shelf base 302 of the rack combination brace assembly 424C. The front edge 144 (see FIG. 2) of the shallow shelf member 120B is positioned on top of the horizontal leg 162 of the shelf channel 122B alongside or abutting the vertical leg 160 of the shelf channel 122B. Optionally, the fasteners 130 (see FIG. 1) may be inserted into the through-holes 326

(see FIGS. 6, 11, and 19) of the short shelf base 300 and used to affix the short shelf base 300 to the shallow shelf member 120B.

Optionally, a drill or similar tool may be used to drill holes in the deep or shallow shelf members 120A and 120B. For example, holes may be drilled into the deep shelf member 120A through the through-holes 326 (see FIGS. 6, 11 and 19) of the long shelf base 302 of the long angled brace assembly 422D. Similarly, holes may be drilled into the shallow shelf member 120B through the through-holes 326 (see FIGS. 6, 11, and 19) of the short shelf base 300 of the short angled brace assembly 420D. These holes may be drilled at slight opposing angles so they pull the deep and shallow shelf members 120A and 120B tightly together. Next, holes may be drilled into the deep and/or shallow shelf members 120A and 120B through the through-holes 326 (see FIGS. 6, 11, and 19) of the long shelf base 302 of the rack combination brace assembly 424C. Then, the fasteners 130A may be inserted through the through-holes 326 (see FIGS. 6, 11, and 19) into the holes drilled therethrough and tightened.

Multi-Configuration Shelf

FIG. 19 illustrates a multi-configuration shelf 500 mounted on the wall 190 (e.g., of a garage). The multi-configuration shelf 500 may be characterized as being a type of large shelf because the multi-configuration shelf 500 includes the deep shelf member 120A. The multi-configuration shelf 500 also includes the shelf channel 122A, the fasteners 130 (see FIG. 1), the inverted brace assembly 400D, the rack combination brace assembly 424D, and the extended short brace assembly 440D. Alternatively, the rack combination brace assembly 424D may be replaced with an extended short brace assembly like the extended short brace assembly 440D. By way of another non-limiting example, the extended short brace assembly 440D may be replaced with a rack combination brace assembly like the rack combination brace assembly 424D.

In the embodiment illustrated, the extended short brace assembly 440D is positioned near the right side edge 150 of the deep shelf member 120A and the inverted brace assembly 400D is positioned near the left side edge 152 (see FIG. 2) of the deep shelf member 120A. The rack combination brace assembly 424D may be positioned midway in between the inverted brace assembly 400D and the extended short brace assembly 440D.

The inverted brace assembly 400D includes the inverted shelf support 170 and the long shelf base 302. The rack combination brace assembly 424D includes the short shelf support 220, the long shelf support 222, and the long shelf base 302. The extended short brace assembly 440D includes the short shelf support 220, the long shelf base 302, and the angle support 174.

The multi-configuration shelf 500 may be assembled by connecting the inverted brace assembly 400D, the rack combination brace assembly 424D, and the extended short brace assembly 440D to the shelf channel 122A in manners substantially identical to those described above. Then, the multi-configuration shelf 500 is mounted on the wall 190. The wall mount bracket 230 of the long shelf support 222 of the rack combination brace assembly 424D is affixed to the wall 190 by inserting one of the fastener(s) 130B through each of the through-hole(s) 238 of the wall mount bracket 230 and into the wall 190. The wall mount brackets 230 of the short shelf supports 220 of the extended short brace assembly 440D and the rack combination brace assembly 424D are affixed to the wall 190 by inserting one of the fastener(s) 130B through each of the through-holes 238 of these wall mount brackets 230 and into the wall 190. The wall mount brackets 180 of the inverted brace assembly 400D are affixed to the wall 190 by inserting one of the fastener(s) 130B through each of the through-hole(s) 188 and into the wall 190. The first legs 310 of the long shelf bases 302 are affixed to the wall 190 by inserting the fasteners 130E through the through-holes 314 of these first legs 310 and into the wall 190.

Finally, the deep shelf member 120A is positioned on top of the support portions 320 of the long shelf bases 302 with its front edge 144 (see FIG. 2) being positioned on top of the horizontal leg 162 of the shelf channel 122A alongside or abutting the vertical leg 160 of the shelf channel 122A. Optionally, the fasteners 130 (see FIG. 1) may be inserted into the through-holes 326 and used to affix the long shelf bases 302 to the deep shelf member 120A.

The multi-configuration shelf 500 illustrated in FIG. 19 includes the short angled rack 462 defined by one or more of the crossbar(s) 134 (not shown but illustrated in FIGS. 1, 7, 14-18, 20, and 21) and the short shelf supports 220 of the rack combination brace assembly 424D and the extended short brace assembly 440D. The short angled rack 462 of the multi-configuration shelf 500 may be substantially identical to one of the short angled racks 462 of the small shelf 460 (see FIG. 11). Optionally, one or more of the hook(s) 136 (see FIGS. 1 and 8) may be attached to the crossbar(s) 134 (see FIGS. 1, 7, 14-18, 20, and 21) of the short angled rack 462.

Referring to FIG. 1, as the above example shelves illustrate, there are many different ways in which to combine the components 100 to achieve a desired shelf configuration. Additionally, the shelves may be configured and installed to accommodate size and height restrictions present in different locations (e.g., different garages). Also, because the shelf support(s) 124 are separate components from the shelf base(s) 126, the shelf support(s) 124 and the shelf base(s) 126 can be assembled in a number of different ways. Additionally, less packaging is required for shipping the components 100 than is required for conventional single piece triangularly shaped braces.

Alternate Embodiment

Figure 23:
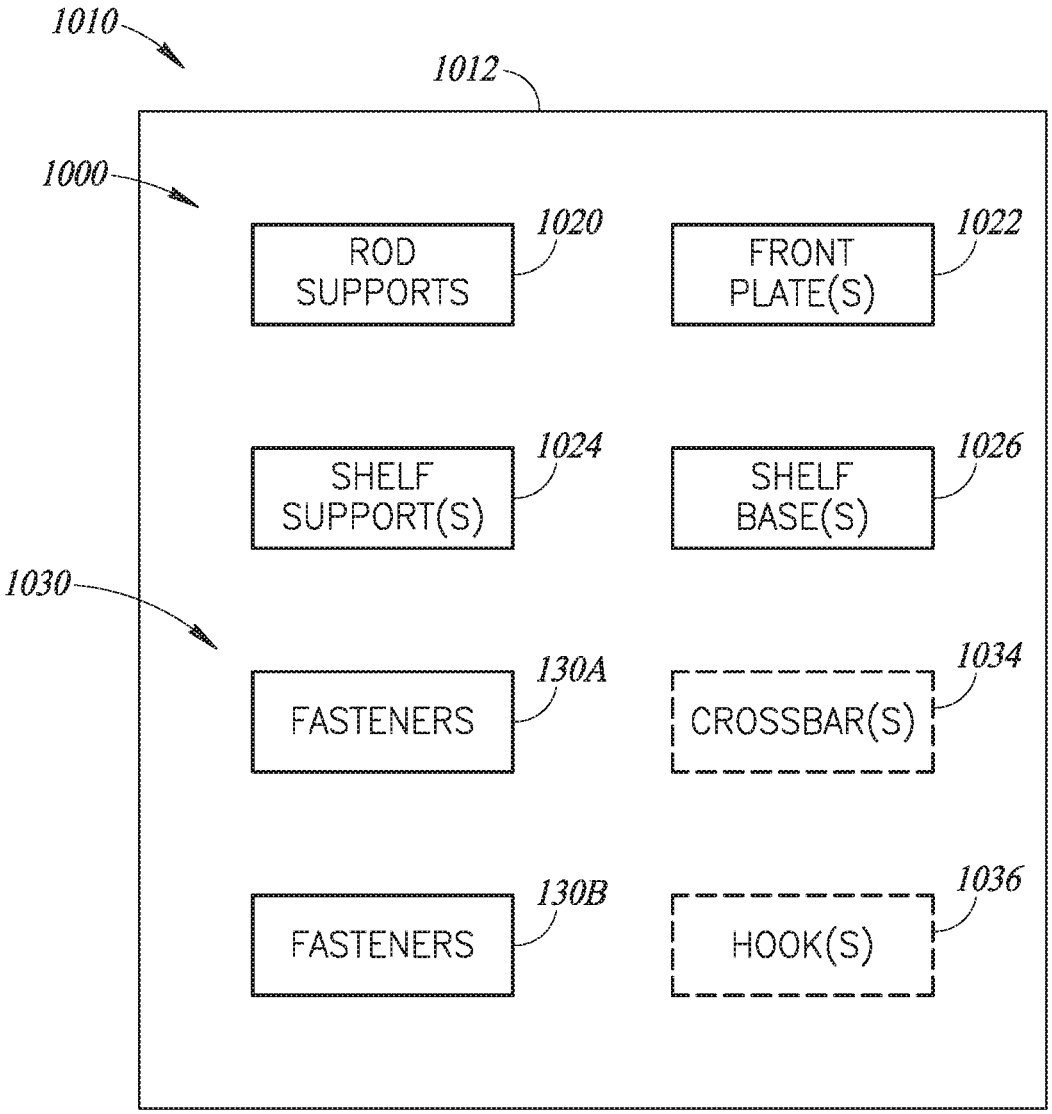
FIG. 23 is a block diagram illustrating components of a second embodiment of a wall hanging shelf and rack storage system.

FIG. 23 illustrates exemplary modular components 1000 of an alternate embodiment of a wall hanging shelf and rack storage system 1010. Optionally, the components 1000 may be included in a kit 1012. The components 1000 of the kit 1012 may be packaged and sold together. The components 1000 may include one or more of the following:

1. a plurality of rod supports 1020;
2. one or more front bars or plates 1022;
3. one or more shelf supports 1024;
4. one or more shelf bases 1026;
5. fasteners 1030 (which include the fasteners 130A and 130B);
6. one or more optional crossbars 1034;
7. one or more optional hooks 1036 (e.g., one or more of the hook(s) 136 illustrated in FIGS. 1 and 8);

As will be described below, the components 1000 are configured to be assembled in numerous ways to produce a number of different shelf and/or rack configurations. The shelves constructed from the components 1000 are mountable on and fully supported by the vertical support surface or wall 190 (see FIGS. 4, 9, 11, 14-21, and 31A-34).

The components 1000 may be lighter in weight than the components 100 (see FIG. 1). Thus, the kit 1012 may be lifted and carried by people with less strain than the kit 112 (see FIG. 1). For example, the rod supports 1020 are lighter than the shelf member(s) 120 (see FIG. 1) and reduce both the size and weight of the kit 1012 compared to the kit 112 (see FIG. 1). Additionally, the components 1000 require fewer of the fasteners 130A, which makes them easier to assemble.

Rod Supports

Figure 24:
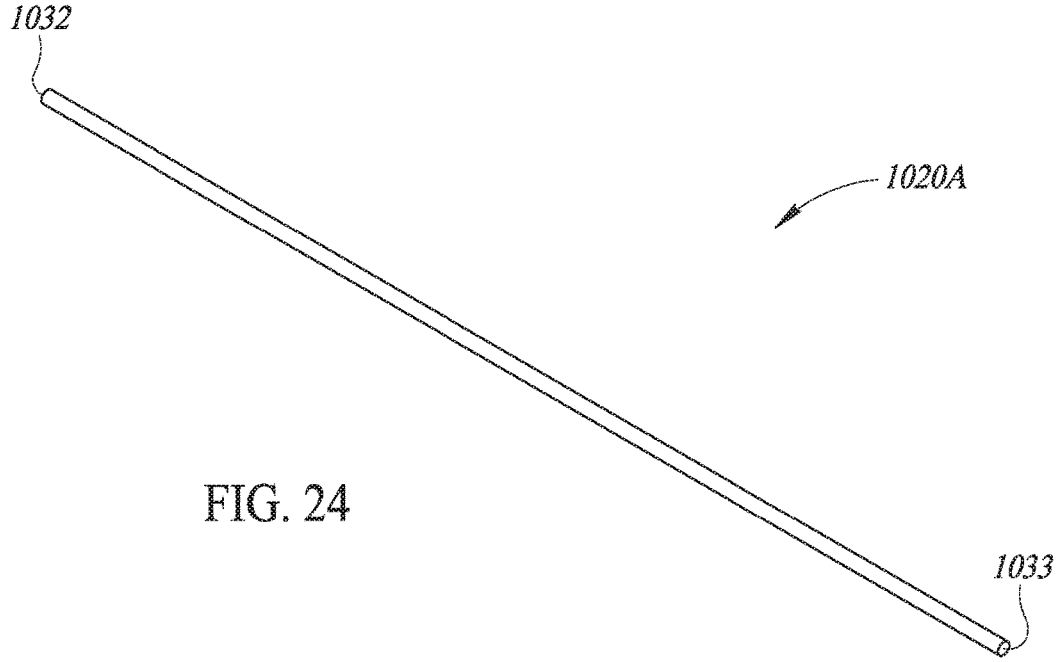
FIG. 24 is a perspective view of a rod support of the system of FIG. 23.

Referring to FIG. 24, the rod supports 1020 (see FIG. 23) include a number of rod supports each like a rod support 1020A. In the embodiment illustrated, the rod support 1020A is implemented as an elongated rod with a generally circular cross-sectional shape (e.g., having a diameter of about ⅜ inches). However, alternate cross-sectional shapes may be used. The rod support 1020A has a first end portion 1032 opposite a second end portion 1033. By way of a non-limiting example, the rod support 1020A may have a length of about 38 inches. By way of another non-limiting example, the rod support 1020A may be constructed from fiberglass and the like.

Front Plate(s)

Figure 25:
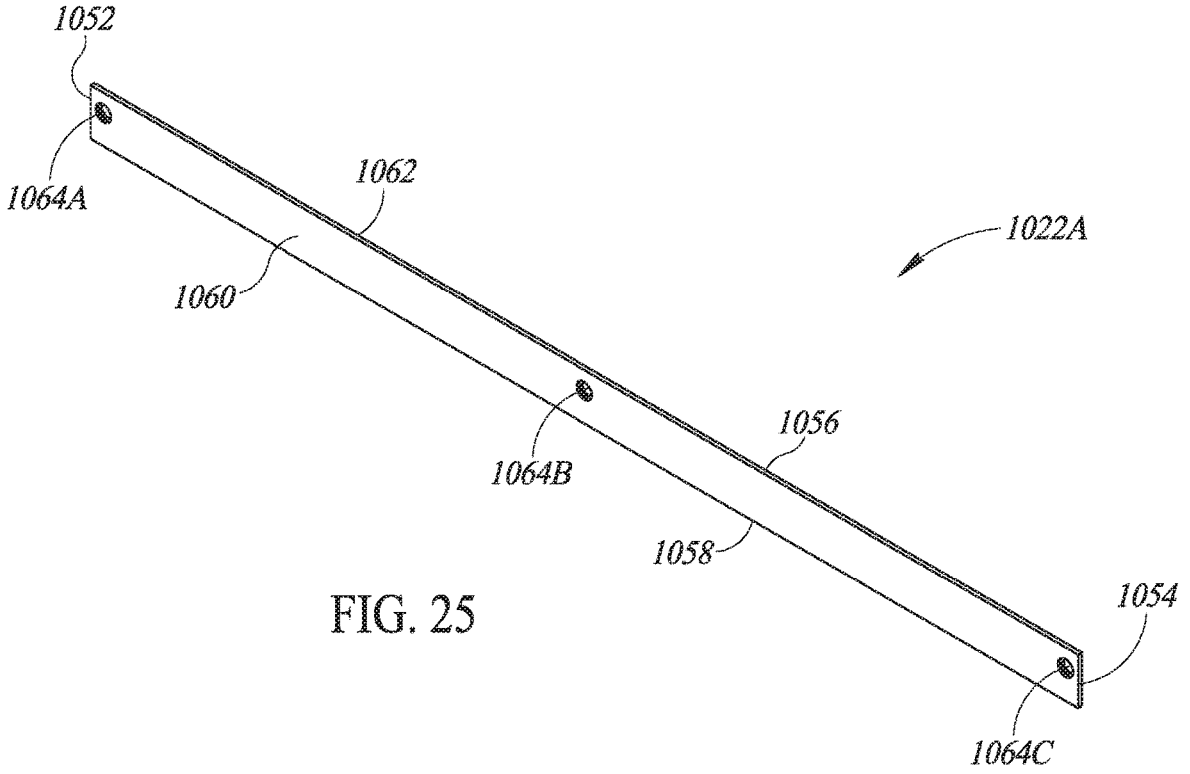
FIG. 25 is a perspective view of a front-facing portion of a front plate of the system of FIG. 23.

Referring to FIG. 25, the front plate(s) 1022 (see FIG. 23) include one or more front plates each like a front plate 1022A. The front plate 1022A is planar and has a generally rectangular outer shape. By way of a non-limiting example, the front plate 1022A may have a length of about 32 inches, a height of about 1½ inches, and a thickness of about ⅛ inches. The front plate 1022A has a first end 1052 opposite a second end 1054. Longitudinally extending first and second edges 1056 and 1058 extend between the first and second ends 1052 and 1054. The first edge 1056 is opposite the second edge 1058. The front plate 1022A has a front facing surface 1060 opposite a rear facing surface 1062.

Figure 31A:
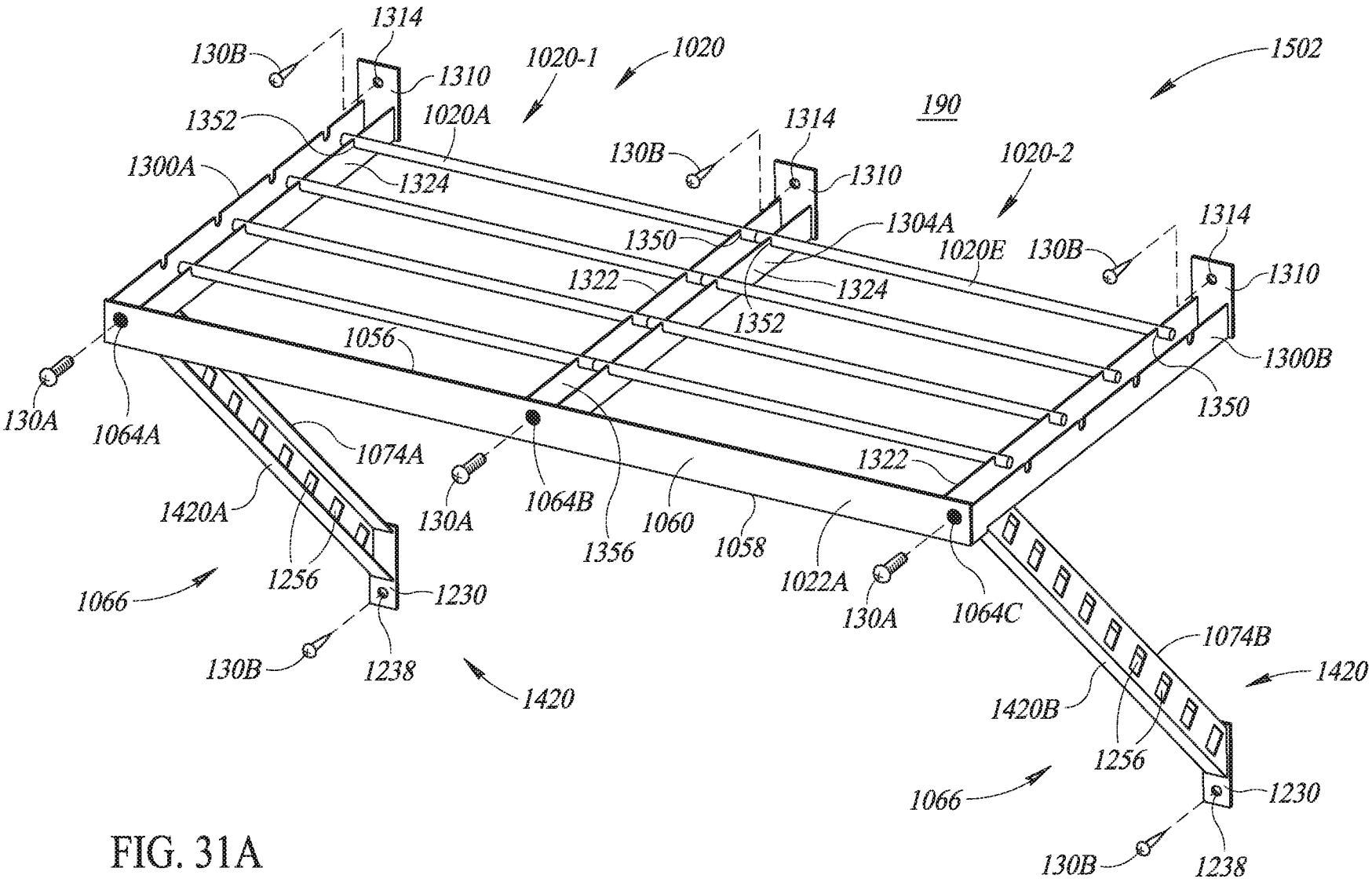
FIG. 31A is a perspective view of a top side of a short shelf constructed using the components of FIG. 23.

Referring to FIG. 31A, the front plate 1022A includes through-holes 1064A-1064C each configured to receive one of the fasteners 130A, which may each be implemented as a tapered bolt. Referring to FIG. 25, the through-hole 1064A is positioned near (e.g., its center is approximately ⅝ inches from) the first end 1052, the through-hole 1064C is positioned near (e.g., its center is approximately ⅝ inches from) the second end 1054, and the through-hole 1064B is positioned midway in between the through-holes 1064A and 1064C. Referring to FIG. 31A, the through-holes 1064A-1064C may be recessed so that the fasteners 130A, when tightened, are even with the front facing surface 1060 of the front plate 1022A. Referring to FIG. 25, the through-holes 1064A-1064C are arranged along a substantially horizontal line that may be positioned closer to the first edge 1056 than the second edge 1058.

By way of a non-limiting example, the front plate 1022A may be constructed from steel, aluminum, and the like. By way of another non-limiting example, the front plate 1022A may be constructed from a rigid plastic or a similarly rigid material.

Shelf Support(s)

Figure 26:
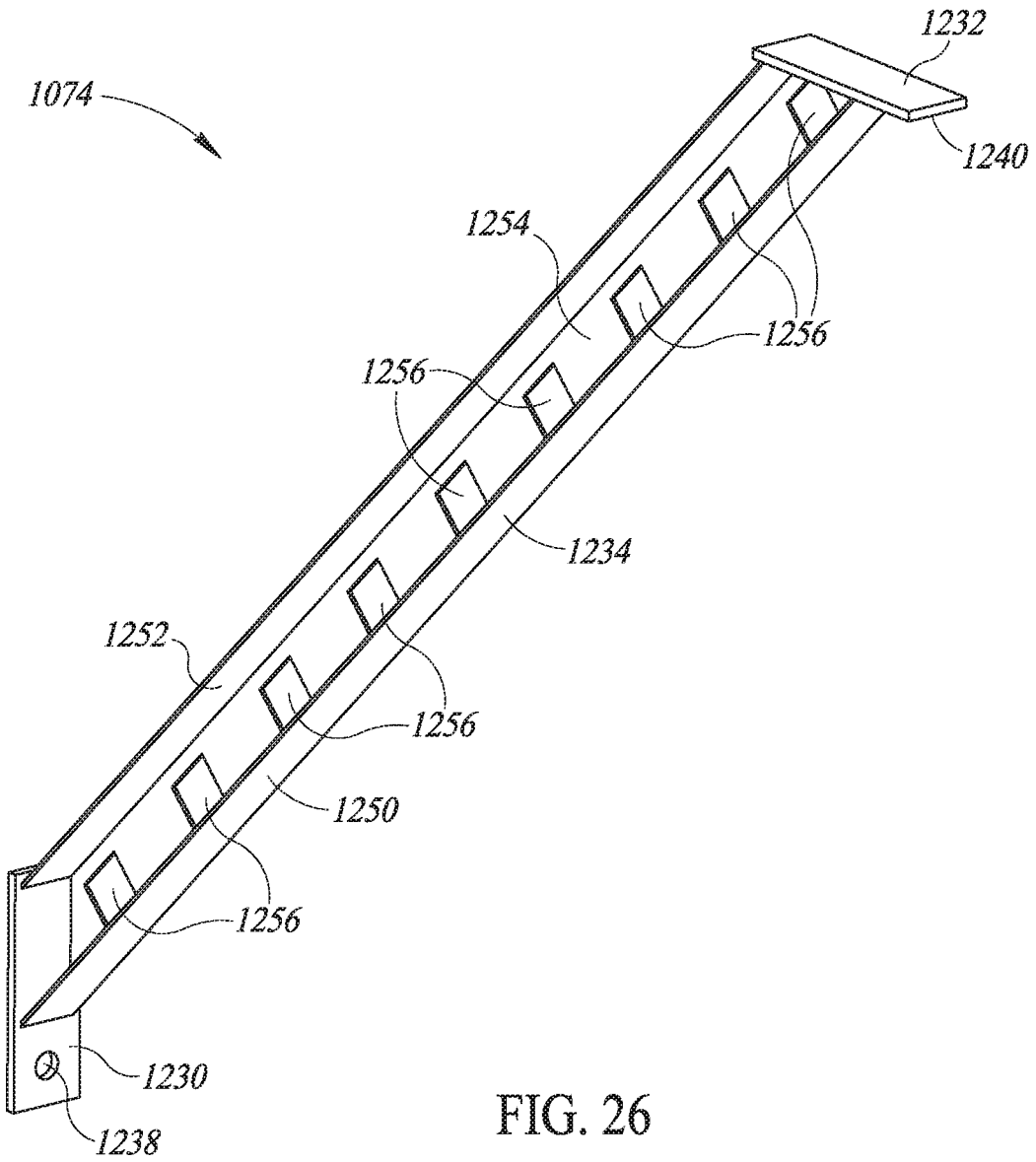
FIG. 26 is a perspective view of a side portion of an angled support of the system of FIG. 23.

Referring to FIG. 23, the shelf support(s) 1024 may include one or more inverted shelf supports 170 (see FIGS. 4, 9, 10, 19, and 30) and/or one or more angled supports 1074 (see FIG. 26). In this embodiment, referring to FIG. 4, the second leg 202 of each of the inverted shelf support(s) 170 extends about one inch from the first leg 200.

Referring to FIG. 26, each of the angled support(s) 1074 is substantially similar to the long shelf support 222 (see FIGS. 4, 14, 15, and 17-22). Thus, the angled support(s) 1074 are configured to extend outwardly from the wall 190 (see FIGS. 4, 9, 11, 14-21, and 31A-34) by the second distance "D2" (see FIG. 4), which may range from about 22 inches to about 26 inches. Further, each of the angled support(s) 1074 includes a wall mount bracket 1230 connected to a shelf support member 1232 by an elongated body member 1234. The wall mount bracket 1230 is orthogonal with respect to the shelf support member 1232 and the elongated body member 1234 is connected to the wall mount bracket 1230 and the shelf support member 1232 at an angle (e.g., about 25 degrees to about 55 degrees). By way of a non-limiting example, the elongated body member 1234 may be connected to the wall mount bracket 1230 at approximately a 45 degree angle and to the shelf support member 1232 at approximately a 45 degree angle. The wall mount bracket 1230 is substantially identical to the wall mount bracket 230 (see FIGS. 4, 11, 13, 14, 16, 18, 19, and 22). Thus, the wall mount bracket 1230 includes through-hole(s) 1238 each configured to receive one of the fasteners 130E (see FIGS. 1, 9, 11, 14-16, 18-23, and 31A-33), which may be implemented as 5/16 inches×3 inches lag screws and are configured to fasten the wall mount bracket 1230 to the wall 190 (see FIGS. 4, 9, 11, 14-21, and 31A-34). The shelf support member 1232 differs from the shelf bracket 232 (see FIGS. 4, 12, 13, and 18) in that the shelf support member 1232 may lack through-holes. The shelf support member 1232 has a forwardly extending portion 1240 that extends forwardly beyond the elongated body member 1234. In the embodiment illustrated, the forwardly extending portion 1240 extends about one inch beyond the elongated body member 1234. The elongated body member 1234 is substantially similar to the elongated body member 234 (see FIGS. 4, 12, 13, and 18) but the elongated body member 1234 may omit the through-hole(s) 255 (see FIGS. 13 and 18).

The elongated body member 1234 may be substantially linear and have a generally U-shaped cross-sectional shape with a first leg 1250 connected to second leg 1252 by a base portion 1254. The base portion 1254 may have one or more through-holes 1256 formed therein. In the example illustrated, each of the through-hole(s) 1256 is generally rectangular or square shaped. The base portion 1254 of each of the angled support(s) 1074 may include a number (e.g., nine) of the through-hole(s) 1256.

By way of a non-limiting example, the angled support(s) 1074 may be constructed from steel, aluminum, and the like. By way of another non-limiting example, the angled support(s) 1074 may be constructed from a rigid plastic or a similarly rigid material.

Shelf Base(s)

Referring to FIG. 23, the shelf base(s) 1026 may include one or more short shelf bases 1300 (see FIG. 27A) each having the first length "L1" (see FIG. 6), one or more short center bases 1304 (see FIG. 27B) each having the first length "L1," one or more long shelf bases 1302 (see FIGS. 27C and 27D) each having a second length "L2" (see FIG. 6), and/or the one or more long center bases 1306 (see FIG. 27E) each having the second length "L2." As mentioned above, the first length "L1" may range from about 16 inches to about 20 inches and the second length "L2" may range from about 24 inches to about 28 inches.

Referring to FIGS. 27A-27E, each of the bases 1300-1306 may be generally L-shaped and have a first leg 1310 connected to a second leg 1312. The first leg 1310 may be substantially orthogonal to the second leg 1312. The first leg 1310 functions like a wall mount bracket and is attachable to the wall 190 (see FIGS. 4, 9, 11, 14-21, and 31A-34). In the embodiment illustrated, each of the bases 1300-1306 is configured to extend substantially orthogonally away from to the wall 190. The first leg 1310 may include one or more through-holes 1314 each configured to receive one of the fasteners 130B (see FIGS. 1, 9, 11, 14-16, 18-23, and 31A-33), which may be implemented as a 5/16 inches×3 inches lag screw and is configured to fasten the first leg 1310 to the wall 190.

The second leg 1312 has a curved support portion 1320 attached at one end to the first leg 1310. Spaced apart first and second sidewalls 1322 and 1324 extend upwardly from the curved support portion 1320 and outwardly away from the first leg 1310. The first sidewall 1322 has a plurality of upwardly opening slots 1350 formed therein. Similarly, the second sidewall 1324 has a plurality of upwardly opening slots 1352 formed therein. The slots 1350 are aligned with the slots 1352, respectively, across a channel 1356 defined between the first sidewall 1322, the second sidewall 1324, and the curved support portion 1320. Thus, an aligned pair of the slots 1350 and 1352 may function as a single slot.

Referring to FIGS. 27A-27C and 27E, the rod supports 1020 (see FIG. 23) are configured to "snap" into the slots 1350 and 1352. For example, referring to FIG. 31A, the first end portion 1032 (see FIG. 24) of the rod support 1020A may be snapped into one of the upwardly opening slots 1352 of the second sidewall 1324 of a short shelf base 1300A and the second end portion 1033 (see FIG. 24) of the rod support 1020A may be snapped into one of the upwardly opening slots 1350 of the first sidewall 1322 of a short center base 1304A. At the same time, the first end portion 1032 (see FIG. 24) of a rod support 1020E may be snapped into the upwardly opening slots 1352 of the second sidewall 1324 of the short center base 1304A and the second end portion 1033 (see FIG. 24) of the rod support 1020E may be snapped into the upwardly opening slots 1350 of the first sidewall 1322 of a short shelf base 1300B. As shown in FIG. 31A, the rod supports 1020A and 1020E are aligned and the second end portion 1033 (see FIG. 24) of the rod support 1020A is adjacent the first end portion 1032 (see FIG. 24) of the rod support 1020E in the channel 1356 of the short center base 1304A. Thus, the first and second sidewalls 1322 and 1324 are adequately spaced apart for the second and first end portions 1032 and 1033 (see FIG. 24), respectively, of two different rod supports 1020 to be inserted together into an aligned pair of the slots 1350 and 1352, so that a shelf may extend continuously along any desired length.

The slots 1350 and 1352 provide snug fits for the rod supports 1020 and keep the rod supports 1020 from moving. The rod supports 1020 extend parallel with respect to the wall 190 (see FIGS. 4, 9, 11, 14-21, and 31A-34). The slots 1350 and 1352 are spaced apart such that the rod supports 1020 are positioned thereby to hold commonly sized boxes, containers, and other items. In addition, the user may reach upwardly from below the rod supports 1020 and in between adjacent ones of the rod supports 1020 and move one or more items resting on the rod supports 1020.

The curved support portion 1320 curves upwardly from each of the first and second sidewalls 1322 and 1324 and into the channel 1356 toward a point midway between the first and second sidewalls 1322 and 1324. Together, the first and second sidewalls 1322 and 1324 and the curved support portion 1320 have a generally W-shaped cross-sectional shape. The first and second sidewalls 1322 and 1324 terminate at a free end portion 1316 configured to be positioned against the rear facing surface 1062 (see FIG. 25) of one of the front plate(s) 1022 (see FIG. 23). The first and second sidewalls 1322 and 1324 extend between the first leg 1310 and the free end portion 1316. The first leg 1310 extends upwardly beyond the first and second sidewalls 1322 and 1324. The free end portion 1316 may extend upwardly from the curved support portion 1320 and terminate at a location that is even with the top of the first and second sidewalls 1322 and 1324.

Through-holes 1318A-1318C are formed in the free end portion 1316. The through holes 1318A-1318C are each configured to receive one of the fasteners 130A (see FIGS. 1, 9-13, 18, 22, 23, 30-32, and 34), which fastens one of the front plate(s) 1022 (see FIG. 23) to the free end portion 1316. For example, referring to FIG. 31A, the front plate 1022A may be fastened to the free end portions 1316 (see FIGS. 27A and 27B) of the bases 1300A, 1304A, and 1300B. The front plate 1022A may be fastened to the free end portions 1316 in one of two different orientations: (1) the first edge 1056 is facing upwardly, or (2) the first edge 1056 is facing downwardly. As mentioned above, the through-holes 1064A-1064C are positioned nearer the first edge 1056. Thus, in the first orientation in which the first edge 1056 is facing upwardly, the first edge 1056 is level with or slightly below the highest points of the rod supports 1020 (e.g., rod supports 1020-1 and 1020-2). In this orientation, the through-holes 1064A-1064C may be fastened to the through-holes 1318A of three of the shelf base(s) 1026 (see FIG. 23), the through-holes 1318B of three of the shelf base(s) 1026, or the through-holes 13180 of the three of the shelf base(s) 1026.

Figure 33:
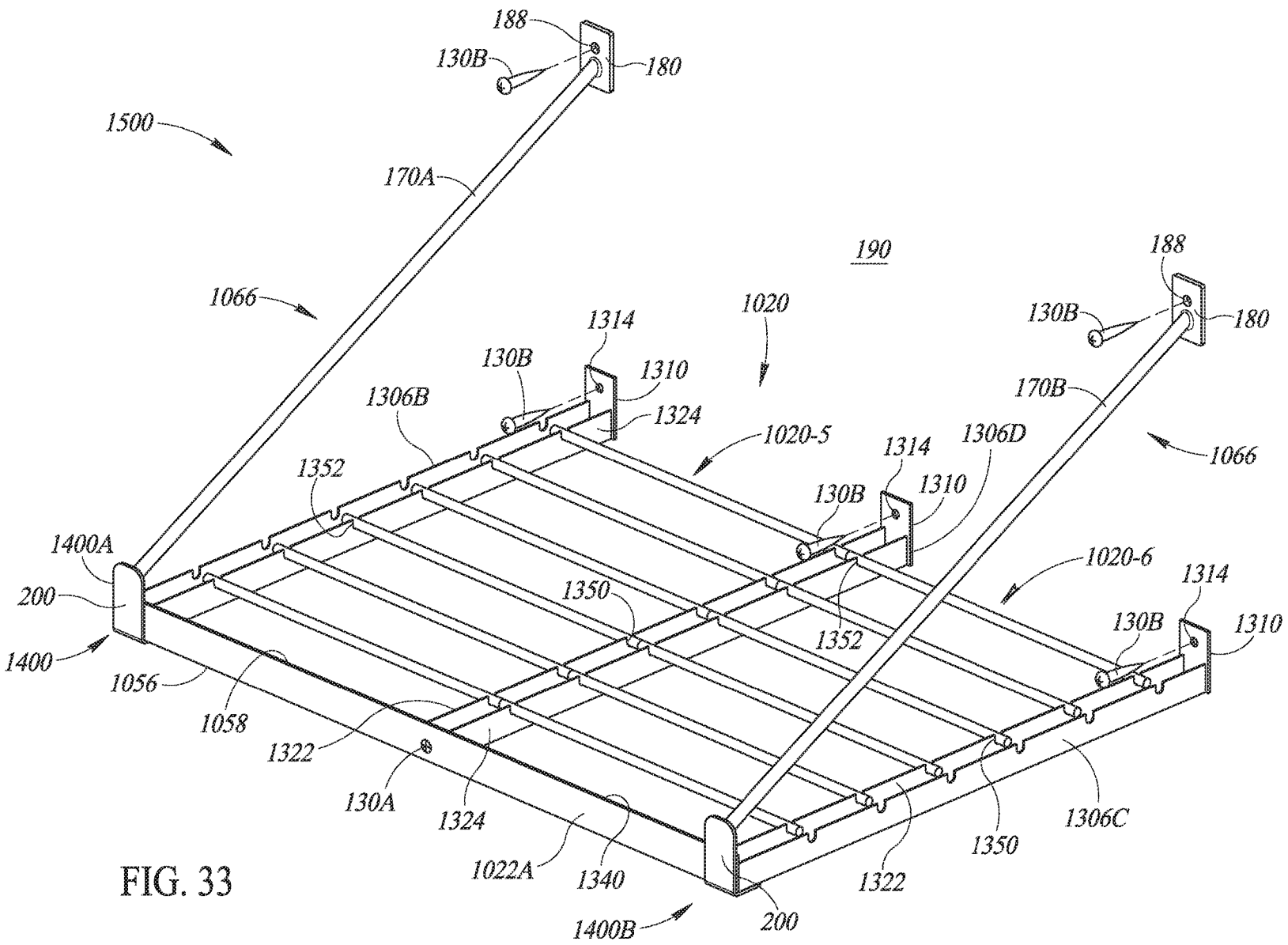
FIG. 33 is a perspective view of a top side of an inverted shelf constructed using the components of FIG. 23.

On the other hand, referring to FIG. 33, in the second orientation in which the first edge 1056 is facing downwardly, the second edge 1058 is above the highest points of the rod supports 1020 (e.g., rod supports 1020-5 and 1020-6) and defines a lip 1340 along the front edge of the shelf (e.g., an inverted shelf 1500). In this orientation, the through-holes 1064C-1064A (see FIGS. 25 and 31A) may be fastened to the through-holes 1318A of three of the shelf base(s) 1026 (see FIG. 23), the through-holes 1318B of three of the shelf base(s) 1026, or the through-holes 1318C of three of the shelf base(s) 1026. The lip 1340 may help prevent items placed on the rod supports 1020 from moving forwardly. Thus, the lip 1340 helps secure the items and prevents them from rolling or sliding off the front of the shelf (e.g., the invented shelf 1500).

Referring to FIGS. 27A-27C and 27E, the front plate 1022A (see FIGS. 25 and 30-34) may be fastened to the free end portions 1316 of any of the bases 1300, 1302, 1304, and 1306 in either the first or second orientation.

Figure 27A:
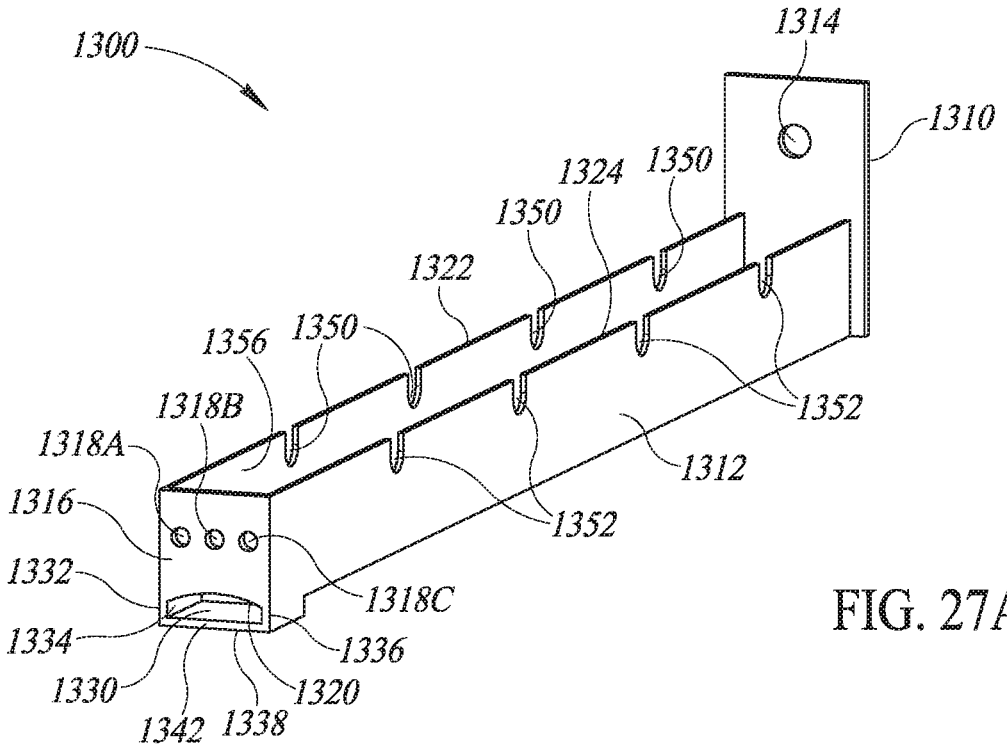
FIG. 27A is a perspective view of a front portion of a short shelf base of the system of FIG. 23.
Figure 27B:
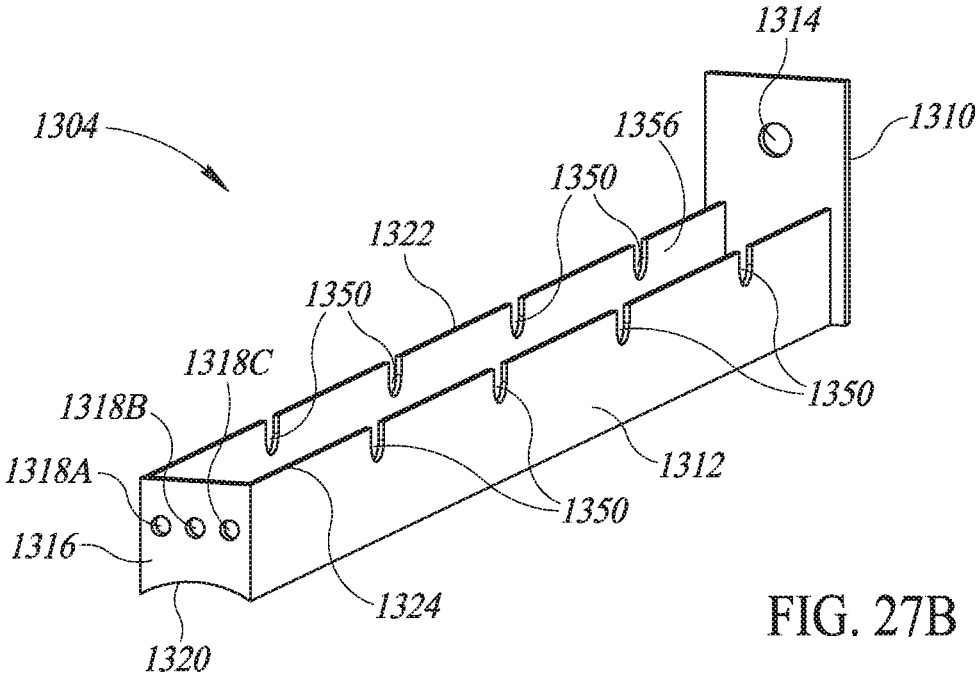
FIG. 27B is a perspective view of a front portion of a short center base of the system of FIG. 23.
Figure 27C:
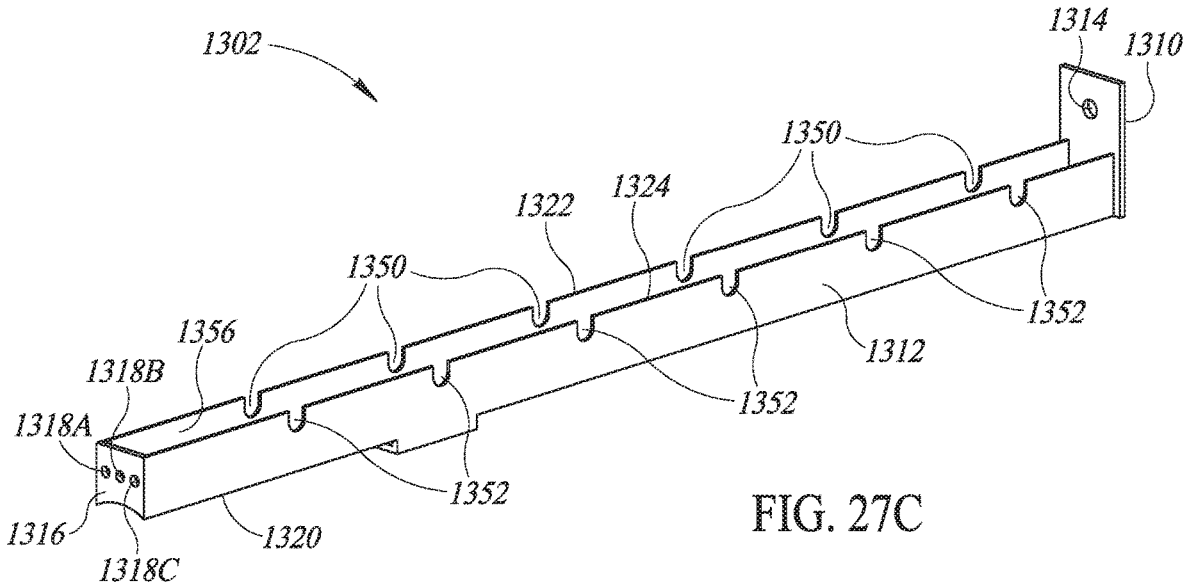
FIG. 27C is a perspective view of a front portion of a long shelf base of the system of FIG. 23.

Referring to FIG. 27A, the short shelf base 1300 differs from the short center base 1304 (see FIG. 27B) in one respect. The short shelf base 1300 includes a through-slot 1330 positioned under and extending along the curved support portion 1320. In the embodiment illustrated, the through-slot 1330 is defined by a generally U-shaped sleeve or member 1332 attached to the curved support portion 1320. The member 1332 may have first and second legs 1334 and 1336 that extend upwardly from a base portion 1338. The first and second legs 1334 and 1336 may be aligned with the first and second sidewalls 1322 and 1324, respectively. In the embodiment illustrated, the member 1332 may also be positioned such that its front most surface 1342 is aligned with the free end portion 1316. The through-slot 1330 is configured to receive the forwardly extending portion 1240 of one of the angled support(s) 1074. Thus, referring to FIG. 23, one of the shelf support(s) 1024 may "slide into" one of the shelf bases(s) 1026 and none of the fasteners 130A are needed to connect the shelf support and the shelf base together.

Figure 27D:
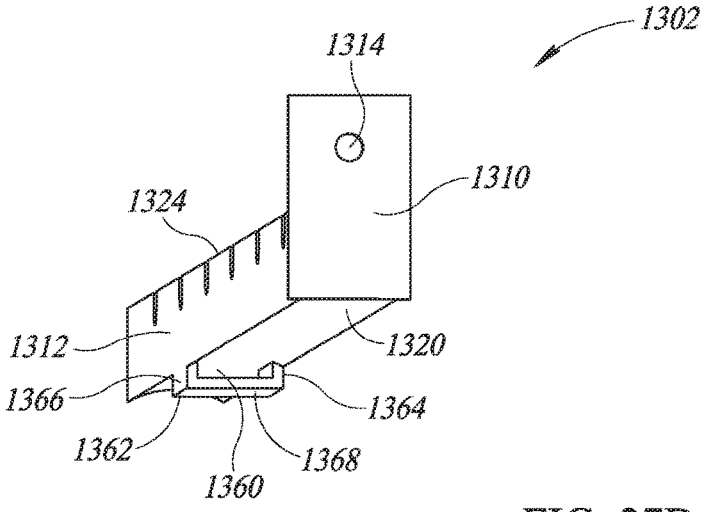
FIG. 27D is a perspective view of a rear portion of a long shelf base of the system of FIG. 23.
Figure 27E:
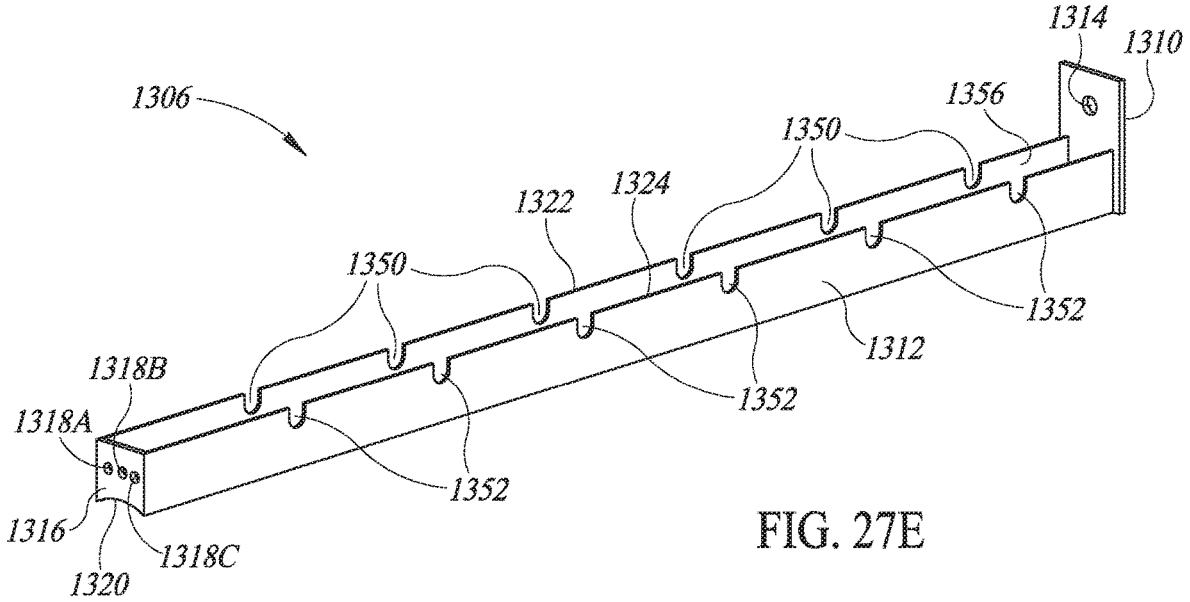
FIG. 27E is a perspective view of a front portion of a long center base of the system of FIG. 23.

Referring to FIG. 27D, the long shelf base 1302 differs from the long center base 1306 (see FIG. 27E) in two respects. First, referring to FIG. 30, the curved support portion 1320 of the long center base 1306 includes a through-hole 1344 that may be omitted from the long shelf base 1302 (see FIGS. 27C and 27D). The through-hole 1344 is spaced apart (e.g., about ¾ inches) from the free end portion 1316. Second, referring to FIG. 27D, the long shelf base 1302 includes a through-slot 1360 positioned under and extending along the curved support portion 1320. In the embodiment illustrated, the through-slot 1360 is defined by a generally U-shaped sleeve or member 1362 attached to the curved support portion 1320 at a location between the first leg 1310 and the free end portion 1316. The member 1362 may have first and second legs 1364 and 1366 that extend upwardly from a base portion 1368. The first and second legs 1364 and 1366 may be aligned with the first and second sidewalls 1322 and 1324, respectively. The through-slot 1360 is configured to receive the forwardly extending portion 1240 of one of the angled support(s) 1074.

By way of a non-limiting example, referring to FIG. 23, the shelf base(s) 1026 may be constructed from steel, aluminum, and the like. By way of another non-limiting example, the shelf base(s) 1026 may be constructed from a rigid plastic or a similarly rigid material.

Optional Crossbar(s)

Figure 28:
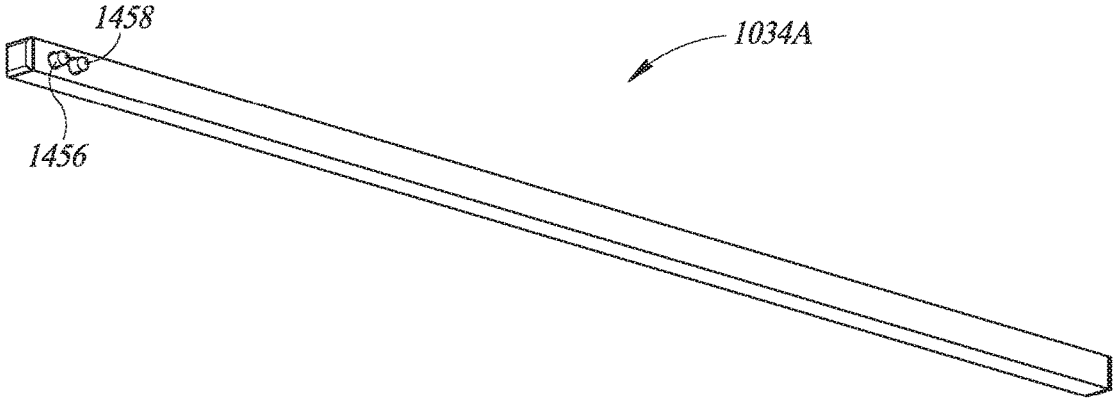
FIG. 28 is a perspective view of a crossbar of the system of FIG. 23.

Referring to FIG. 28, the optional crossbar(s) 1034 (see FIG. 23) include one or more crossbars each like a crossbar 1034A. By way of non-limiting examples, the crossbar 1034A may be about 0.75 inches wide by about 0.75 inches tall and have a length of about 36 inches. Referring to FIG. 28, each of the optional crossbar(s) 1034 (see FIG. 23) may be substantially similar to the optional crossbar(s) 134 (see FIGS. 1, 7, 15-18, and 20-22). Each of the optional crossbar(s) 1034 (see FIG. 23) may include laterally extending first and second spaced apart retractable pins 1456 and 1458. Referring to FIG. 34, each of the crossbar(s) 1034 (see FIG. 23) is configured to be received in and extend through the through-holes 1256 formed in a pair of the angled support(s) 1074 (e.g., angled supports 1074B and 1074E) to define an angled rack 1462.

Figure 34:
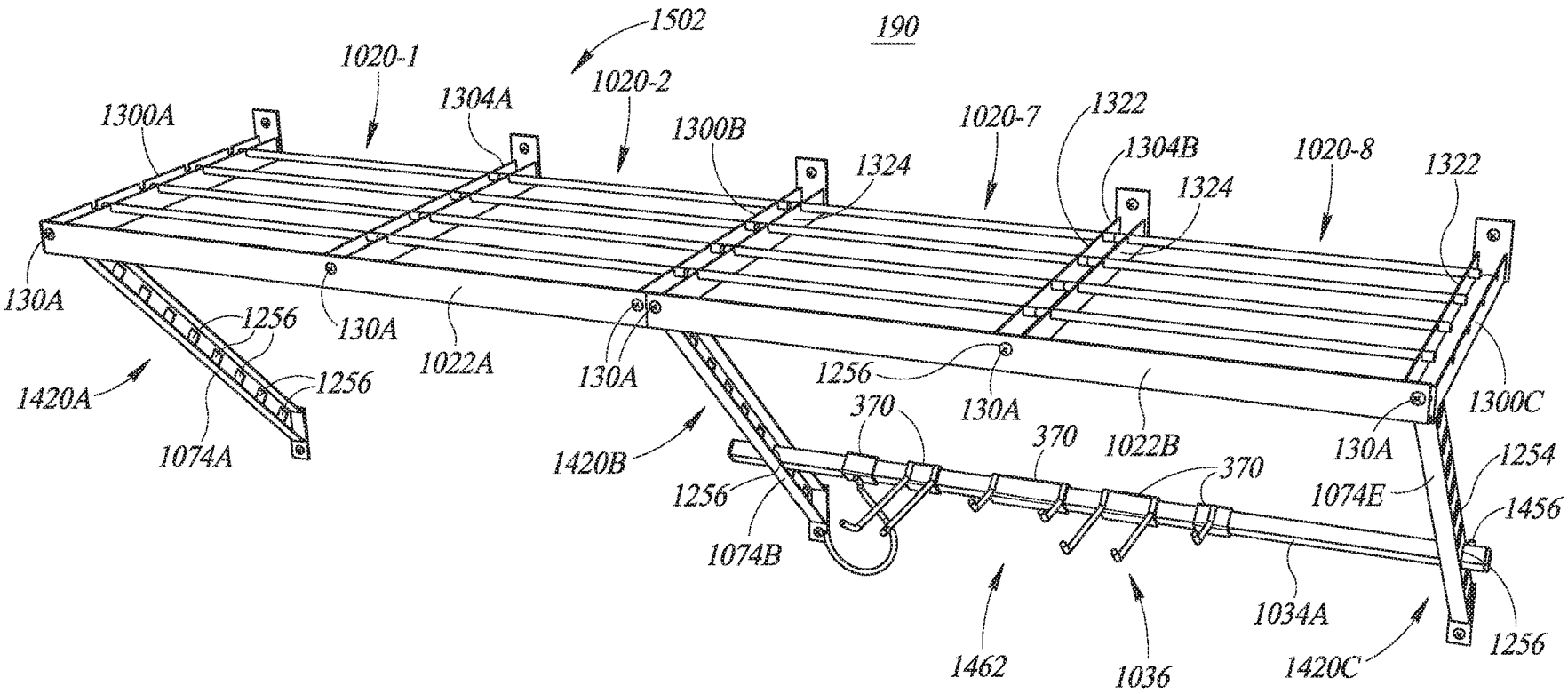
FIG. 34 is a perspective view of a top side of the short shelf of FIG. 31A lengthened by additional components of FIG. 23.

For example, FIG. 34 illustrates the crossbar 1034A supported by the angled supports 1074B and 1072E. The crossbar 1034A is slid through an aligned pair of the through-holes 1256 of the angled supports 1072B and 1072E until the retractable pin 1458 (see FIG. 28) reaches one of the aligned through-holes. In the embodiment illustrated, the retractable pin 1458 (see FIG. 28) reaches one of the through-holes 1256 of the angled supports 1074E. The connector 370 of each of one or more of the optional hook(s) 1036 illustrated in FIG. 29 may be slid onto the crossbar 1034A before both ends of the crossbar 1034A are received inside the aligned through-holes 1256 of the angled supports 1072B and 1072E. Alternatively or additionally, the connector 370 of each of one or more of the hook(s) 136 (see FIGS. 1 and 8) may be positioned on the crossbar 1034A before or after both ends of the crossbar 1034A have been received inside the aligned through-holes 1256 of the angled supports 1072B and 1072E. Next, referring to FIG. 34, the retractable pin 1458 is depressed and passed through the through-hole while the retractable pin 1456 remains outside the through-hole. Then, the retractable pin 1458 is released and the base portion 1254 of the angled support 1072E is trapped between the retractable pins 1456 and 1458 (see FIG. 28). The crossbar 1034A may be removed from the angled supports 1072B and 1072E by depressing either of the retractable pins 1456 and 1458 and pulling the crossbar 1034A free of the aligned through-holes 1256. In other words, the retractable pins 1456 and 1458 trap the base portion 1254 of the angled support 1072E therebetween and help maintain the crossbar 1034A in place. The crossbar(s) 1034 (see FIG. 23) are each configured to support at least one of the optional hook(s) 1036 illustrated in FIG. 29, at least one of the optional hook(s) 136 (see FIGS. 1 and 8), and/or at least one other item.

By way of a non-limiting example, referring to FIG. 23, the crossbar(s) 1034 may be constructed from steel, aluminum, and the like. By way of another non-limiting example, the crossbar(s) 1034 may be constructed from a rigid plastic or a similarly rigid material.

Optional Hook(s)

Figure 29:
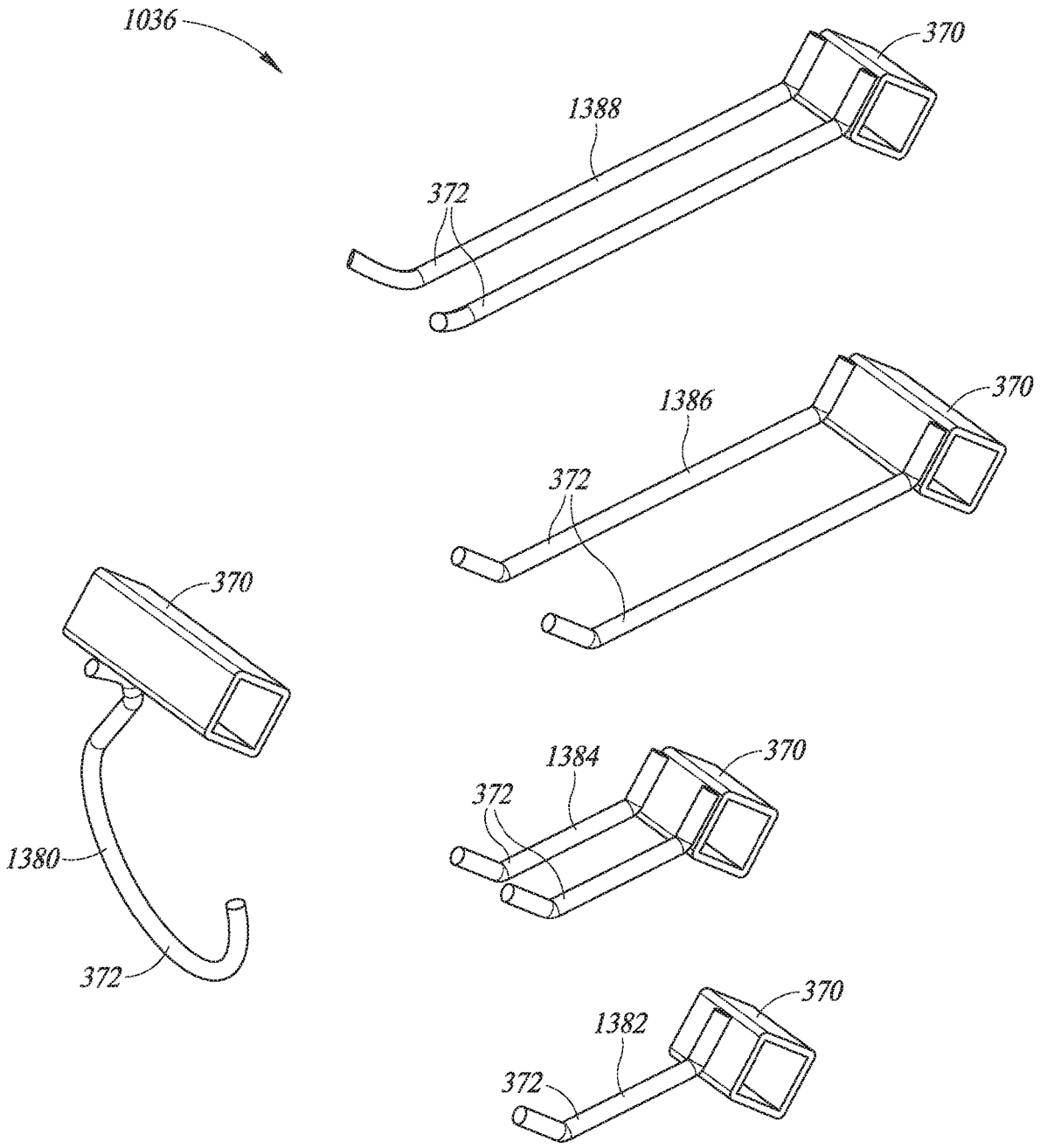
FIG. 29 is a side perspective view of hooks of the system of FIG. 23.

Referring to FIG. 29, the hook(s) 1036 may include one or more of the following:

1. bicycle hook(s) 1380;
2. small single hook(s) 1382;
3. small double hook(s) 1384;
4. large double hook(s) 1386; and
5. ski hook(s) 1388.

Alternatively or additionally, the hook(s) 1036 may include one or more of the hook(s) 136 (see FIGS. 1 and 8). Like the optional hook(s) 136 illustrated in FIG. 8, the optional hook(s) 1036 illustrated in FIG. 29 each includes the connector 370 connected to the hook portion 372. Referring to FIG. 34, the connector 370 is configured to be removably attached to one of the crossbar(s) 1034 (e.g., the crossbar 1034A). In the embodiment illustrated in FIG. 29, the connector 370 has a closed shape with an inside cross-sectional shape that corresponds to an outside cross-sectional shape of the crossbar 1034A (see FIGS. 28 and 34). As shown in FIG. 28, the crossbar 1034A has a square or diamond shaped outside cross-sectional shape. Thus, in the embodiment illustrated in FIG. 29, the connector 370 has a square or diamond shaped inside cross-sectional shape configured to receive the crossbar 1034A (see FIGS. 28 and 34). For example, the connector 370 is configured to be slid onto one of the ends of one of the crossbar 1034A (see FIGS. 28 and 34).

Brace Assemblies

Referring to FIG. 23, at least one of the shelf support(s) 1024 and at least one of the shelf base(s) 1026 may be assembled together to form a brace subassembly 1066 (see FIG. 31A-33). Non-limiting examples of the brace subassemblies 1066 that may be constructed from the components 1000 include a short angled brace assembly 1420 (see FIGS. 31A and 31B), a long angled brace assembly 1422 (see FIG. 32), and/or an inverted brace assembly 1400 (see FIGS. 30 and 33). Two or more short angled brace assemblies 1420 (see FIGS. 31A and 31B) may be used to construct a short shelf 1502 (see FIGS. 31A, 31B, and 34). Two or more long angled brace assemblies 1422 (see FIG. 32) may be used to construct a long shelf 1504 (see FIG. 32). Optionally, one or more inverted brace assembly 1400 (see FIGS. 30 and 33) may be used to construct a portion of the long shelf 1504 (see FIG. 32). Two or more inverted brace assemblies 1400 (see FIGS. 30 and 33) may be used to construct the inverted shelf 1500 (see FIG. 33).

Figure 31B:
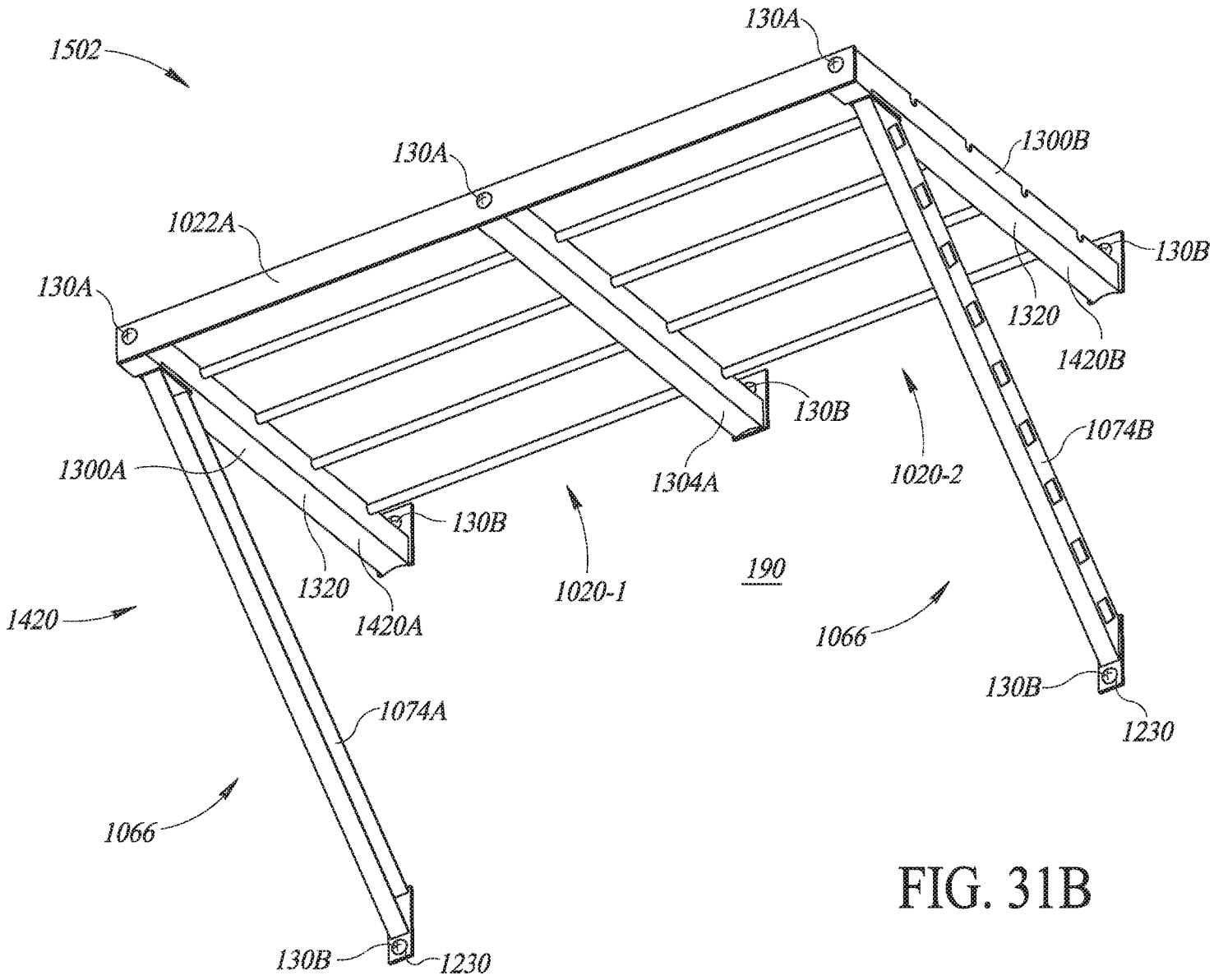
FIG. 31B is a perspective view of an underside of the short shelf of FIG. 31A.

Referring to FIG. 31B, one of the angled support(s) 1074 (e.g. angled support 1074A) and one of the short shelf bases 1300 (e.g., the short shelf base 1300A) may be assembled together to form the short angled brace assembly 1420. The short angled brace assembly 1420 may be used to support a portion of the small shelf 1502 (see FIGS. 31A and 31B). The short angled brace assembly 1420 may be assembled by inserting the forwardly extending portion 1240 (see FIG. 26) of the angled support 1074A into the rearward-facing opening of the through-slot 1330 (see FIG. 27A) of the short shelf base 1300A. Referring to FIG. 31A, the short shelf 1502 may be constructed from the short angled brace assemblies 1420A and 1420B with the short center base 1304A positioned midway between the short angled brace assemblies 1420A and 1420B. The short center base 1304A may provide added support and strength to the short shelf 1502.

Figure 32:
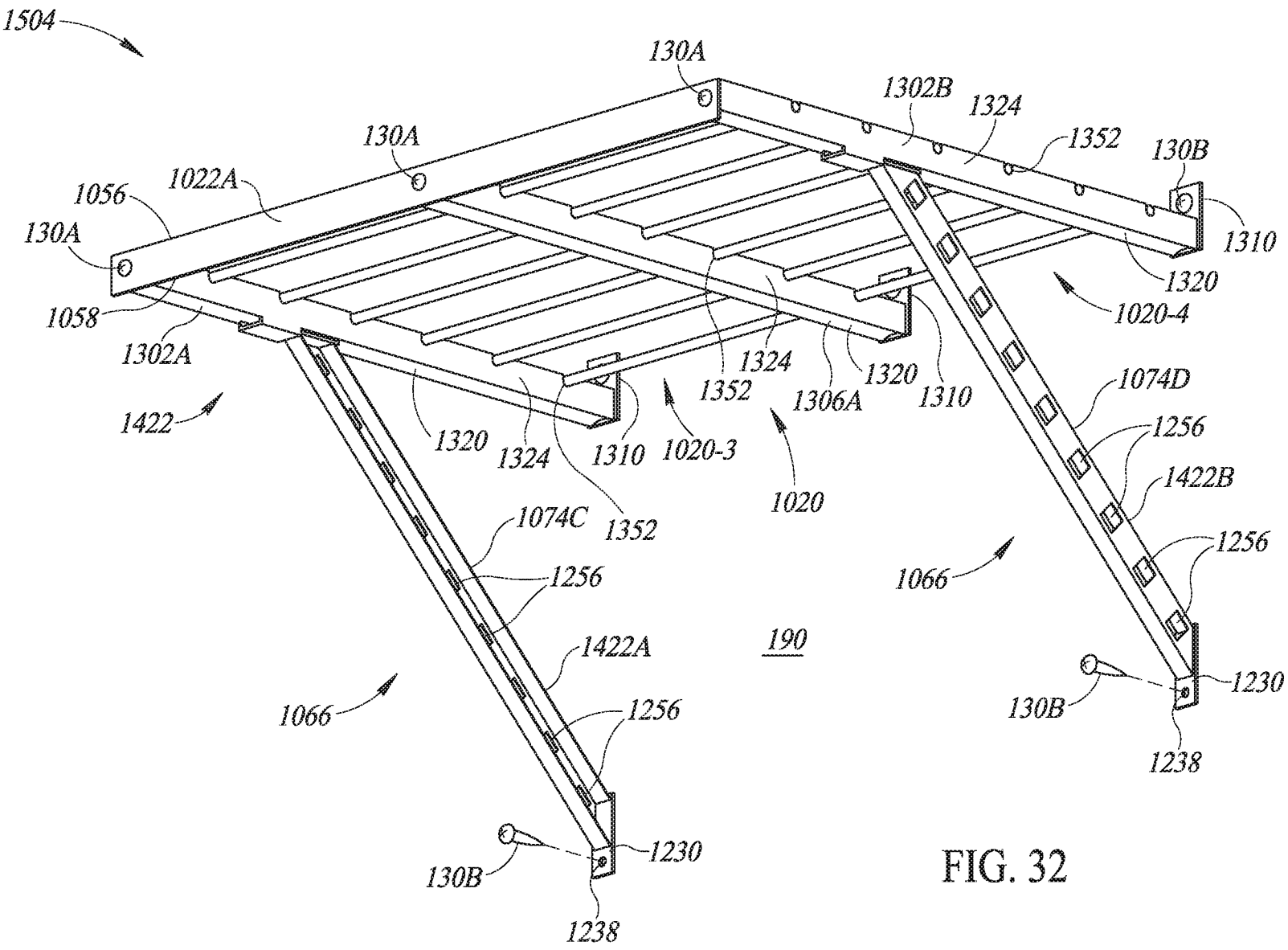
FIG. 32 is a perspective view of an underside side of a long shelf constructed using the components of FIG. 23.

Referring to FIG. 32, one of the angled support(s) 1074 (e.g. angled support 1074C) and one of the long shelf bases 1302 (e.g., long shelf base 1302A) may be assembled together to form the long angled brace assembly 1422. The long angled brace assembly 1422 may be used to support a portion of the large shelf 1504. The long angled brace assembly 1422 may be assembled by inserting the forwardly extending portion 1240 (see FIG. 26) of the angled support 1074C into the rearward-facing opening of the through-slot 1360 (see FIG. 27D) of the long shelf base 1302A. The long shelf 1504 may be constructed from the long angled brace assemblies 1422A and 1422B with the long center base 1306A positioned midway between the long angled brace assemblies 1422A and 1422B. The long center base 1306A may provide added support and strength to the long shelf 1504.

Figure 30:
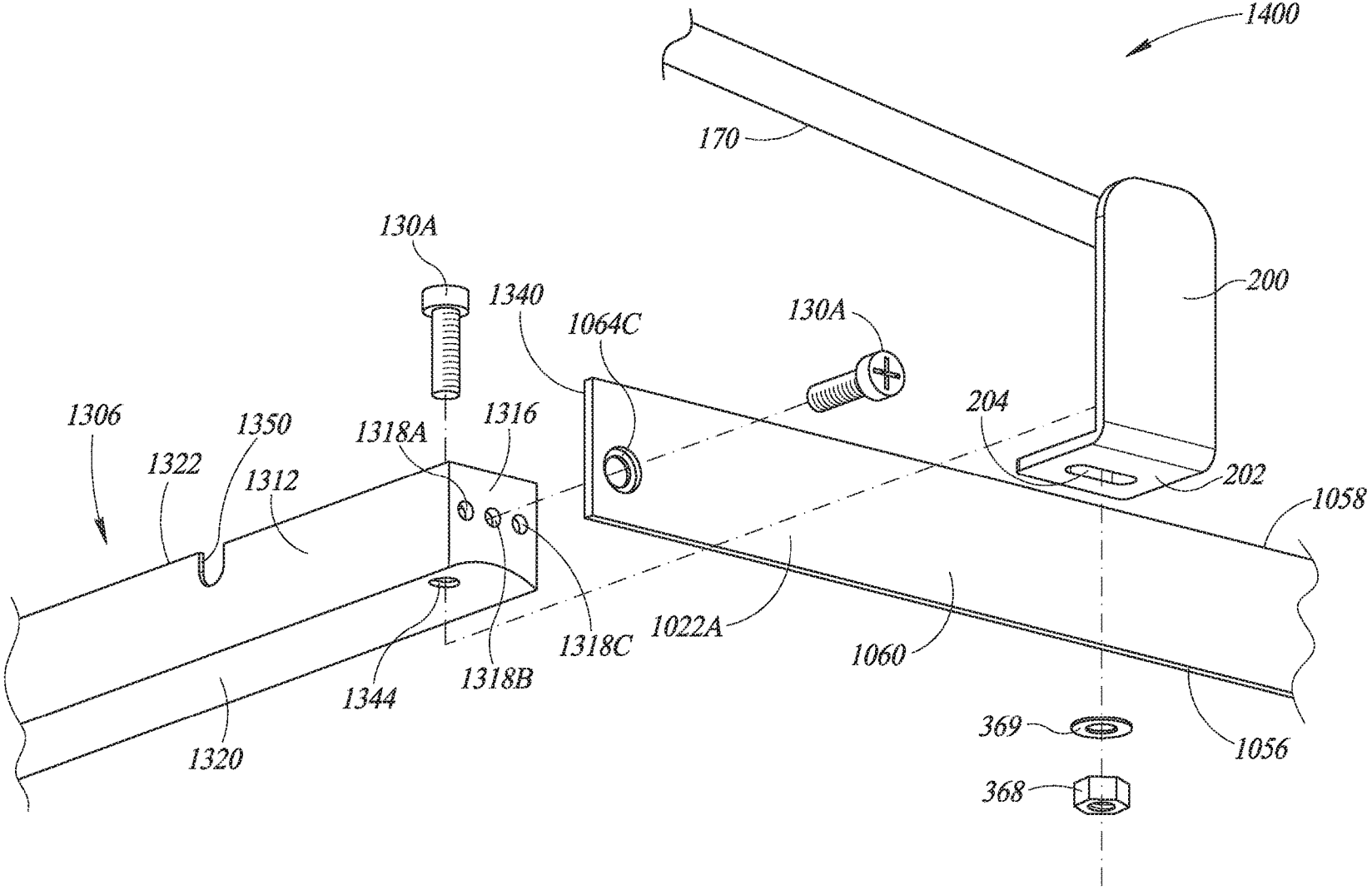
FIG. 30 is an enlarged exploded side perspective view of a portion of an inverted brace assembly constructed using the components of FIG. 23.

Referring to FIG. 33, one of the inverted shelf support(s) 170 (e.g. inverted shelf support 170A) and one of the long center bases 1306 (e.g., long center base 1306B) may be assembled together to form the inverted brace assembly 1400. The inverted brace assembly 1400 may be used to support a portion of the inverted shelf 1500 or a portion of the long shelf 1504 (see FIG. 32). Referring to FIG. 30, the inverted brace assembly 1400 may be assembled by positioning the second leg 202 of the inverted shelf support 170 under the long center base 1306 and against the curved support portion 1320 of the long center base 1306. The through-hole 204 is aligned with the through-hole 1344 and one of the fasteners 130A is used to couple the inverted shelf support 170 to the long center base 1306. The front plate 1022A may be installed on the free end portion 1316 of the long center base 1306 before the inverted brace assembly 1400 is assembled. Referring to FIG. 33, the inverted shelf 1500 may be constructed from the inverted brace assemblies 1400A and 1400B with the long center base 1306D positioned midway between the inverted brace assemblies 1400A and 1400B. The long center base 1306D may provide added support and strength to the inverted shelf 1500.

Small Shelf

FIGS. 31A and 31B illustrate the small shelf 1502 mounted on the wall 190 (e.g., of a garage). The small shelf 1502 includes one or more front plates 1022 (see FIG. 23), the fasteners 1030 (see FIG. 23), two or more short angled brace assemblies 1420, one or more short center bases 1304 (see FIG. 27B), and the rod supports 1020. In the embodiment illustrated, the rod supports 1020 include rod supports 1020-1 and 1020-2. The rod supports 1020-1 and 1020-2 each include four rod supports.

In the embodiment illustrated, the small shelf 1502 includes the short angled brace assemblies 1420A and 1420B. The short angled brace assembly 1420A includes the angled support 1074A and the short shelf base 1300A. The short angled brace assembly 1420B includes the angled support 1074B and the short shelf base 1300B. The short center base 1304A is positioned between the short angled brace assemblies 1420A and 1420B. The front plate 1022A is positioned adjacent the free end portions 1316 (see FIGS. 27A and 27B) of the bases 1300A, 1304A, and 1300B. The front plate 1022A is attached to the free end portions 1316 (see FIGS. 27A and 27B) of the bases 1300A, 1304A, and 1300B by the fasteners 130A (e.g., tapered bolts). Referring to FIG. 31A, as mentioned above, the front plate 1022A may be fastened to the bases 1300A, 1304A, and 1300E in either the first orientation, in which the first edge 1056 faces upwardly, or the second orientation in which the first edge 1056 faces downwardly. In FIGS. 31A and 31B the front plate 1022A has been attached in the first orientation.

Referring to FIG. 31A, the wall mount brackets 1230 of the angled supports 1074A and 1074B are attached to the wall 190 by the fasteners 130B, which are inserted into the through-holes 1238 of the wall mount brackets 1230. Similarly, the first legs 1310 of the short shelf base 1300A and 1304E are attached to the wall 190 by the fasteners 130B, which are inserted into the through-holes 1314 of the first legs 1310 of the short shelf base 1300A and 1300B. And, the first leg 1310 of the short center base 1304A is attached to the wall 190 by one of the fasteners 130B, which is inserted into the through-hole 1314 of the first leg 1310 of the short center base 1304A.

The first end portions 1032 (see FIG. 24) of the rod supports 1020-1 are snapped into the upwardly opening slots 1352 of the second sidewall 1324 of the short shelf base 1300A and the second end portions 1033 (see FIG. 24) of the rod supports 1020-1 are snapped into the upwardly opening slots 1350 of the first sidewall 1322 of the short center base 1304A. The first end portions 1032 (see FIG. 24) of the rod supports 1020-2 are snapped into the upwardly opening slots 1352 of the second sidewall 1324 of the short center base 1304A and the second end portions 1033 (see FIG. 24) of the rod supports 1020-2 are snapped into the upwardly opening slots 1350 of the first sidewall 1322 of the short shelf base 1300B.

Optionally, if desired, one or more of the optional crossbar(s) 1034 (see FIG. 23) may be inserted into the through-hole(s) 1256 of the angled supports 1074A and 1074B to construct the short angled rack 1462 (see FIG. 34).

Large Shelf

FIG. 32 illustrates the large shelf 1504 mounted on the wall 190 (e.g., of a garage). The large shelf 1504 includes one or more front plates 1022 (see FIG. 23), the fasteners 1030 (see FIG. 23), two or more long angled brace assemblies 1422, one or more long center bases 1306 (see FIG. 27E), and the rod supports 1020. In the embodiment illustrated, the rod supports 1020 include rod supports 1020-3 and 1020-4. The rod supports 1020-3 and 1020-4 each include six rod supports.

In the embodiment illustrated, the large shelf 1504 includes the long angled brace assemblies 1422A and 1422B. The long angled brace assembly 1422A includes the angled support 1074C and the long shelf base 1302A. The long angled brace assembly 1422B includes the angled support 1074D and the long shelf base 1302B. The long center base 1306A is positioned between the long angled brace assemblies 1422A and 1422B. The front plate 1022A is positioned adjacent the free end portions 1316 (see FIGS. 27C and 27E) of the bases 1302A, 1306A, and 1302B. The front plate 1022A is attached to the free end portions 1316 (see FIGS. 27C and 27E) of the bases 1302A, 1306A, and 1302B by the fasteners 130A. As mentioned above, the front plate 1022A may be fastened to the bases 1302A, 1306A, and 1302B in either the first orientation, in which the first edge 1056 faces upwardly, or the second orientation in which the first edge 1056 faces downwardly. In FIG. 32, the front plate 1022A has been attached in the first orientation.

The wall mount brackets 1230 of the angled supports 1074C and 1074D are attached to the wall 190 by the fasteners 130B, which are inserted into the through-holes 1238 of the wall mount brackets 1230. Similarly, the first legs 1310 of the long shelf base 1302A and 1302B are attached to the wall 190 by the fasteners 130B, which are inserted into the through-holes 1314 (see FIGS. 27C and 27D) of the first legs 1310. And, the first leg 1310 of the long center base 1306A is attached to the wall 190 by one of the fasteners 130B, which is inserted into the through-hole 1314 (see FIG. 27E) of the first leg 1310 of the long center base 1306A.

The first end portions 1032 (see FIG. 24) of the rod supports 1020-3 are snapped into the upwardly opening slots 1352 of the second sidewall 1324 of the long shelf base 1302A and the second end portions 1033 (see FIG. 24) of the rod supports 1020-3 are snapped into the upwardly opening slots 1350 (see FIG. 27E) of the first sidewall 1322 (see FIG. 27E) of the long center base 1306A. The first end portions 1032 (see FIG. 24) of the rod supports 1020-4 are snapped into the upwardly opening slots 1352 of the second sidewall 1324 of the long center base 1306A and the second end portions 1033 (see FIG. 24) of the rod supports 1020-4 are snapped into the upwardly opening slots 1350 (see FIG. 27C) of the first sidewall 1322 (see FIG. 27C) of the long shelf base 1302B.

Optionally, if desired, one or more of the optional crossbar(s) 1034 (see FIG. 23) may be inserted into the through-hole(s) 1256 of the angled supports 1074C and 1074D to construct the short angled rack 1462 (see FIG. 34).

Inverted Shelf

FIG. 33 illustrates the inverted shelf 1500 mounted on the wall 190 (e.g., of a garage). The inverted shelf 1500 includes one or more front plates 1022 (see FIG. 23), the fasteners 1030 (see FIG. 23), two or more inverted brace assemblies 1400, one or more long center bases 1306 (see FIG. 27E), and the rod supports 1020. In the embodiment illustrated, the rod supports 1020 include rod supports 1020-5 and 1020-6. The rod supports 1020-5 and 1020-6 each include six rod supports.

In the embodiment illustrated, the inverted shelf 1500 includes the inverted brace assemblies 1400A and 1400B. The inverted brace assembly 1400A includes the inverted shelf support 170A and the long center base 1306B. The inverted brace assembly 1400B includes the inverted shelf support 170B and the long center base 1306C. The long center base 1306D is positioned between the inverted brace assemblies 1400A and 1400B. The front plate 1022A is positioned adjacent the free end portions 1316 (see FIG. 27E) of the bases 1306B, 1306D, and 1306C. Thus, the front plate 1022A is positioned between the free end portion 1316 (see FIG. 27E) of the long center base 1306B and the first leg 200 of the inverted shelf support 170A. Similarly, the front plate 1022A is positioned between the free end portion 1316 (see FIG. 27E) of the long center base 1306C and the first leg 200 of the inverted shelf support 170A. The front plate 1022A is attached to the free end portions 1316 (see FIG. 27E) of the bases 1306B, 1306D, and 1306C by the fasteners 130A. The front plate 1022A is fastened to the bases 1306B, 1306D, and 1306C in the second orientation in which the first edge 1056 faces downwardly.

The wall mount brackets 180 of the inverted shelf supports 170A and 1708 are attached to the wall 190 by the fasteners 130B, which are inserted into the through-holes 188 of the wall mount brackets 180. Similarly, the first legs 1310 of the long center bases 1306B-1306D are attached to the wall 190 by the fasteners 130B, which are inserted into the through-holes 1314 of the first legs 1310 of the long center bases 1306B-1306D.

The first end portions 1032 (see FIG. 24) of the rod supports 1020-5 are snapped into the upwardly opening slots 1352 of the second sidewall 1324 of the long center base 1306B and the second end portions 1033 (see FIG. 24) of the rod supports 1020-5 are snapped into the upwardly opening slots 1350 of the first sidewall 1322 of the long center base 1306D. The first end portions 1032 (see FIG. 24) of the rod supports 1020-6 are snapped into the upwardly opening slots 1352 of the second sidewall 1324 of the long center base 1306D and the second end portions 1033 (see FIG. 24) of the rod supports 1020-6 are snapped into the upwardly opening slots 1350 of the first sidewall 1322 of the long center base 1306C.

While the inverted shelf 1500 illustrated includes only the single long center base 1306D positioned between the inverted brace assemblies 1400A and 1400B, in alternate embodiments, more than one long center base may be positioned between the inverted brace assemblies 1400A and 1400B.

As shown in FIG. 34, any of the shelves 1500-1504 may be lengthened by adding more of the components 1000 (see FIG. 23) to an existing shelf. FIG. 34 illustrates the small shelf 1502 lengthened by adding a front plate 1022B, a short center base 1304B, a short angled brace assembly 1420C, and rod supports 1020-7 and 1020-8. The front plate 1022B is substantially identical to the front plate 1022A. The short angled brace assembly 1420C includes the angled support 1074E and the short shelf base 13000.

As described above, the small shelf 1502 includes the short angled brace assemblies 1420A and 1420B with the short center base 1304A positioned therebetween. Together, the short angled brace assemblies 1420B and 1420C may be characterized as forming a second small shelf that shares the short angled brace assembly 1420B with the small shelf 1502. The front plate 1022B is attached to the free end portions 1316 (see FIGS. 27A and 27B) of the bases 1300B, 1304B, and 1300C by the fasteners 130A. For example, one of the fasteners 130A may be inserted through the through-hole 1064A (see FIGS. 25 and 31A) of the front plate 1022B and the through-hole 1318C (see FIG. 27A) of the short shelf base 1300B, one of the fasteners 130A may be inserted through the through-hole 1064B (see FIGS. 25 and 31A) of the front plate 1022B and the through-hole 1318C (see FIG. 27B) of the short center base 1304B, and one of the fasteners 130A may be inserted through the through-hole 1064C (see FIGS. 25, 30, and 31A) of the front plate 1022B and the through-hole 1318C (see FIG. 27A) of the short shelf base 1300C. Alternatively, if the lip 1340 (see FIGS. 30 and 33) is desired, the front plate 1022B may be rotated into the second orientation.

The first end portions 1032 (see FIG. 24) of the rod supports 1020-7 are snapped into the upwardly opening slots 1352 (see FIG. 27A) of the second sidewall 1324 of the short shelf base 1300B and the second end portions 1033 (see FIG. 24) of the rod supports 1020-7 are snapped into the upwardly opening slots 1350 (see FIG. 27B) of the first sidewall 1322 of the short center base 1304B. The first end portions 1032 (see FIG. 24) of the rod supports 1020-8 are snapped into the upwardly opening slots 1352 (see FIG. 27B) of the second sidewall 1324 of the short center base 1304B and the second end portions 1033 (see FIG. 24) of the rod supports 1020-8 are snapped into the upwardly opening slots 1350 (see FIG. 27A) of the first sidewall 1322 of the short shelf base 1300C.

Optionally, if desired, one or more of the optional crossbar(s) 1034 (e.g., the crossbar 1034A) may be inserted into the through-hole(s) 1256 of the angled supports 1074A, 1074B, and 1074E to construct one or more of the short angled racks 1462.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the invention is not limited except as by the appended claims.

The invention claimed is:

1. A kit comprising:

a first plurality of rod supports each comprising a first end portion opposite a second end portion;

a second plurality of rod supports each comprising a first end portion opposite a second end portion, the second plurality of rod supports comprising a corresponding second rod support for each of the first plurality of rod supports;

three shelf bases each comprising first and second base legs, the first base leg being directly positionable against a wall and couplable thereto, the second base leg extending outwardly from the first base leg, the second base leg having upwardly opening slots formed therein, each of the upwardly opening slots of a first of the three shelf bases being configured to receive the first end portion of a different one of the first plurality of rod supports, each of the upwardly opening slots of a second of the three shelf bases being configured to receive both the second end portion of a different one of the first plurality of rod supports and the first end portion of the corresponding second rod support, each of the upwardly opening slots of a third of the three shelf bases being configured to receive the second end portion of a different one of the second plurality of rod supports;

a first shelf support that is separate from the three shelf bases, the first shelf support being couplable to the second base leg of the first shelf base at a first location to form a first brace, the first shelf support comprising a first wall mount bracket that is directly positionable against the wall and is couplable thereto, the first location being spaced apart from the first base leg of the first shelf base along the second base leg of the first shelf base, the first shelf support being configured to extend from the first wall mount bracket toward the first location; and a second shelf support that is separate from the three shelf bases, the second shelf support being couplable to the second base leg of the third shelf base at a second location to form a second brace, the second shelf support comprising a second wall mount bracket that is directly positionable against the wall and is couplable thereto, the second location being spaced apart from the first base leg of the third shelf base along the second base leg of the third shelf base, the second shelf support being configured to extend from the second wall mount bracket toward the second location.

2. The kit of claim 1, wherein the first shelf support comprises a first series of through-holes arranged linearly along the first shelf support, the second shelf support comprises a second series of through-holes arranged linearly along the second shelf support, the first and second series of through-holes are configured to be aligned with one another, and the kit further comprises a crossbar configured to extend between the first and second shelf supports, the crossbar being positionable in both a first selected one of the first series of through-holes and a second selected one of the second series of through-holes, the first and second selected through-holes being aligned with one another and allowing the crossbar to pass therethrough.

3. The kit of claim 2, wherein the first shelf support extends from the first location toward the wall at a first angle, and the second shelf support extends from the second location toward the wall at a second angle, the first angle is substantially identical to the second angle, and the first and second angles range from about 25 degrees to about 55 degrees.

4. The kit of claim 2, wherein the crossbar comprises a pair of spaced apart retractable pins configured to trap the first or second shelf support therebetween.

5. The kit of claim 2, further comprising:

at least one hook configured to be supported by the crossbar.

6. The kit of claim 1, wherein the second base leg of each of the three shelf bases comprises a free end portion, and the kit further comprises:

a front plate couplable to the free end portion of each of the three shelf bases.

7. The kit of claim 1, wherein the second base leg of the first shelf base comprises a free end portion, and the first shelf support comprises:

an inverted shelf bracket comprising a first bracket leg connected to a second bracket leg; and a body member that extends between the first wall mount bracket and the inverted shelf bracket, the first wall mount bracket is configured to be coupled to the wall at a third location positioned above the first shelf base, the first bracket leg being configured to extend along the free end portion of the first shelf base, the second bracket leg being configured to be coupled to the first location, the first location being on an underside of the second base leg of the first shelf base.

8. The kit of claim 7, wherein the first shelf support extends from the first shelf base toward the wall at an angle, and the second wall mount bracket is configured to be coupled to the wall at a fourth location positioned below the second shelf base.

9. The kit of claim 1, wherein the second base leg of the first shelf base has a first slot positioned at the first location, the first shelf support comprises a first shelf support member that is substantially orthogonal to the first wall mount bracket, the first shelf support member comprises a first forward extending portion configured to be received inside the first slot and to couple the first shelf support to the second base leg of the first shelf base, the second base leg of the third shelf base has a second slot positioned at the second location, the second shelf support comprises a second shelf support member that is substantially orthogonal to the second wall mount bracket, and the second shelf support member comprises a second forward extending portion configured to be received inside the second slot and couple the second shelf support to the second base leg of the third shelf base.

10. The kit of claim 1, wherein the second base leg of each of the three shelf bases comprises first and second sidewalls, the upwardly opening slots formed in the second base leg of the first shelf base extend through both the first and second sidewalls of the first shelf base, the first end portion of each of the first plurality of rod supports is configured to be received inside a first portion of a different one of the upwardly opening slots formed in the second base leg of the first shelf base, the first portion is formed in the second sidewall of the first shelf base, the upwardly opening slots formed in the second base leg of the second shelf base extend through both the first and second sidewalls of the second shelf base, the second end portion of each of the first plurality of rod supports is configured to be received inside a second portion of a different one of the upwardly opening slots formed in the second base leg of the second shelf base, the second portion is formed in the first sidewall of the second shelf base, the first end portion of each of the second plurality of rod supports is configured to be received inside a third portion of a different one of the upwardly opening slots formed in the second base leg of the second shelf base, the third portion is formed in the second sidewall of the second shelf base, the upwardly opening slots formed in the second base leg of the third shelf base extend through both the first and second sidewalls of the third shelf base, the second end portion of each of the second plurality of rod supports is configured to be received inside a fourth portion of a different one of the upwardly opening slots formed in the second base leg of the third shelf base, and the fourth portion is formed in the first sidewall of the third shelf base.

11. The kit of claim 1, wherein the first shelf support comprises a first inverted shelf support comprising a first body member extending between the first wall mount bracket and a first inverted shelf bracket, the first wall mount bracket being directly positionable against the wall and couplable thereto at a third location positioned above the first shelf base, the first inverted shelf bracket comprising first and second bracket legs, the first bracket leg being configured to extend downwardly along a free end portion of the second base leg of the first shelf base, the second bracket leg being positionable under the second base leg of the first shelf base and couplable to the first location; and the second shelf support comprises a second inverted shelf support comprising a second body member extending between the second wall mount bracket and a second inverted shelf bracket, the second wall mount bracket being directly positionable against the wall and couplable thereto at a fourth location positioned above the third shelf base, the second inverted shelf bracket comprising third and fourth bracket legs, the third bracket leg being configured to extend downwardly along a free end portion of the second base leg of the third shelf base, the fourth bracket leg being positionable under the second base leg of the third shelf base and couplable to the second location.

12. The kit of claim 11, further comprising:

a front plate positioned against the free end portion of the first shelf base, a free end portion of the second shelf base, and the free end portion of the third shelf base, the front plate being positioned between the free end portion of the first shelf base and the first bracket leg, and the front plate being positioned between the free end portion of the third shelf base and the third bracket leg.

13. A shelf assembly comprising:

a first plurality of rod supports each comprising a first end portion opposite a second end portion;

a second plurality of rod supports each comprising a first end portion opposite a second end portion, the second plurality of rod supports comprising a corresponding second rod support for each of the first plurality of rod supports;

first and second end shelf bases each having first and second base legs, the first base leg of each of the first and second end shelf bases being directly positionable against a wall and couplable thereto, the second base leg of the first end shelf base extending outwardly from the first base lea of the first end shelf base, the second base leg of the second end shelf base extending outwardly from the first base leg of the second end shelf base, the second base leg of the first end shelf base being configured to support the first end portion of each of the first plurality of rod supports, the second base leg of the second end shelf base being configured to support the second end portion of each of the second plurality of rod supports;

a center shelf base positioned between the first and second end shelf bases, the center shelf base having first and second base legs, the first base leg of the center shelf base being directly positionable against the wall and couplable thereto, the second base leg of the center shelf base being configured to support the second end portion of each of the first plurality of rod supports and the first end portion of each of the second plurality of rod supports;

a first angled shelf support separate from the first end shelf base, the first angled shelf support being coupled to both the wall and a first location along the second base leg of the first end shelf base, the first location being spaced apart from the first base leg of the first end shelf base, the first angled shelf support comprising a first wall mount bracket directly positionable against the wall and couplable thereto at a second location positioned under the first end shelf base, the first angled shelf support extending upwardly from the second location toward the first location; and a second angled shelf support separate from the second end shelf base, the second angled shelf support being coupled to both the wall and a third location along the second base leg of the second end shelf base, the third location being spaced apart from the first base leg of the second end shelf base, the second angled shelf support comprising a second wall mount bracket directly positionable against the wall and couplable thereto at a fourth location positioned under the second end shelf base, the second angled shelf support extending upwardly from the fourth location toward the third location.

14. The shelf assembly of claim 13, wherein the first angled shelf support extends from the second location toward the first location at a first angle, the second angled shelf support extends from the fourth location toward the third location at a second angle, the first angle is substantially identical to the second angle, and the first and second angles range from about 35 degrees to about 65 degrees.

15. The shelf assembly of claim 13, wherein the first angled shelf support comprises a first series of through-holes arranged linearly along the first angled shelf support, the second angled shelf support comprises a second series of through-holes arranged linearly along the second angled shelf support, the first and second series of through-holes are configured to be aligned with one another, and the shelf assembly further comprises a crossbar configured to extend between the first and second angled shelf supports, the crossbar being positionable in both a first selected one of the first series of through-holes and a second selected one of the second series of through-holes, the first and second selected through-holes being aligned with one another and allowing the crossbar to pass therethrough.

16. The shelf assembly of claim 15, wherein the crossbar comprises a pair of spaced apart retractable pins configured to trap one of the first or second angled shelf supports therebetween.

17. The shelf assembly of claim 15, further comprising: at least one hook mounted on the crossbar.

18. The shelf assembly of claim 13, wherein the second base leg of each of the first and second end shelf bases comprises a free end portion, the second base leg of the center shelf base comprises a free end portion, and the shelf assembly further comprises a front plate couplable to the free end portion of the first end shelf base, the free end portion of the second end shelf base, and the free end portion of the center shelf base.

19. The shelf assembly of claim 13, wherein the second base leg of the first end shelf base comprises a first slot positioned at the first location, the second base leg of the second end shelf base comprises a second slot positioned at the third location, the first angled shelf support comprises a first shelf support member that extends forwardly into the first slot of the first end shelf base and couples the first angled shelf support to the second base leg of the first end shelf base, and the second angled shelf support comprises a second shelf support member that extends forwardly into the second slot of the second end shelf base and couples the second angled shelf support to the second base leg of the second end shelf base.

* * * * *